US008294702B2

(12) United States Patent
Tanikame

(10) Patent No.: US 8,294,702 B2
(45) Date of Patent: Oct. 23, 2012

(54) DISPLAY DEVICE, METHOD FOR DRIVING SAME, AND ELECTRONIC APPARATUS

(75) Inventor: Takao Tanikame, Kanagawa (JP)

(73) Assignee: Sony Corporation, Tokyo (JP)

( * ) Notice: Subject to any disclaimer, the term of this patent is extended or adjusted under 35 U.S.C. 154(b) by 813 days.

(21) Appl. No.: 12/314,342

(22) Filed: Dec. 9, 2008

(65) Prior Publication Data

US 2009/0160847 A1 Jun. 25, 2009

(30) Foreign Application Priority Data

Dec. 21, 2007 (JP) ..... 2007-330803

(51) Int. Cl.
*G09G 5/00* (2006.01)
*G09G 3/34* (2006.01)

(52) U.S. Cl. ..... 345/214; 345/84

(58) Field of Classification Search ..... 345/214
See application file for complete search history.

(56) References Cited

U.S. PATENT DOCUMENTS

| | | | | |
|---|---|---|---|---|
| 7,057,588 | B2 | 6/2006 | Asano et al. | |
| 7,102,202 | B2 | 9/2006 | Kobayashi et al. | |
| 7,109,952 | B2 | 9/2006 | Kwon et al. | |
| 2002/0097002 | A1* | 7/2002 | Lai et al. | 315/169.3 |
| 2005/0206590 | A1 | 9/2005 | Sasaki et al. | |
| 2006/0138600 | A1* | 6/2006 | Miyazawa | 257/630 |
| 2006/0170628 | A1* | 8/2006 | Yamashita et al. | 345/76 |
| 2006/0232519 | A1* | 10/2006 | DuHwan et al. | 345/76 |

FOREIGN PATENT DOCUMENTS

| | | | |
|---|---|---|---|
| JP | 2002-215093 | A | 7/2002 |
| JP | 2003-050564 | A | 2/2003 |
| JP | 2003-255856 | A | 9/2003 |
| JP | 2003-271095 | A | 9/2003 |
| JP | 2004-29791 | | 1/2004 |
| JP | 2004-093682 | A | 3/2004 |
| JP | 2004-133240 | A | 4/2004 |
| JP | 2005-157277 | A | 6/2005 |
| JP | 2006-003744 | A | 1/2006 |

OTHER PUBLICATIONS

Japanese Office Action issued Jul. 20, 2010 for related Japanese Application No. 2009-281076.
Japanese Office Action issued Oct. 20, 2009 for corresponding Japanese Application No. 2007-330803.

* cited by examiner

*Primary Examiner* — Alexander S Beck
*Assistant Examiner* — Mihir Rayan
(74) *Attorney, Agent, or Firm* — Rader Fishman & Grauer, PLLC

(57) ABSTRACT

Disclosed herein is a display device including: a pixel array part including row first drive lines, row second drive lines, and column signal lines; and a drive part including a horizontal drive circuit, a first vertical drive circuit, and a second vertical drive circuit, wherein the first vertical drive circuit simultaneously drives pixels on two rows adjacent to each other, the second vertical drive circuit simultaneously drives pixels on two rows adjacent to each other, and a pair of rows of the pixels simultaneously driven by the first vertical drive circuit and a pair of rows of the pixels simultaneously driven by the second vertical drive circuit are shifted from each other by one row, for light-emission operation of the pixels on a row-by-row basis.

7 Claims, 45 Drawing Sheets

FIG.3A

| | | | | | | | | | | | | | |
|---|---|---|---|---|---|---|---|---|---|---|---|---|---|
| WS(1) | R1 | G1 | B1 | R1 | G1 | B1 | R1 | G1 | B1 | R1 | G1 | B1 | DS(1) |
| WS(2) | R2 | G2 | B2 | R2 | G2 | B2 | R2 | G2 | B2 | R2 | G2 | B2 | DS(2) |
| WS(3) | R3 | G3 | B3 | R3 | G3 | B3 | R3 | G3 | B3 | R3 | G3 | B3 | DS(3) |
| WS(4) | R4 | G4 | B4 | R4 | G4 | B4 | R4 | G4 | B4 | R4 | G4 | B4 | DS(4) |
| WS(5) | R5 | G5 | B5 | R5 | G5 | B5 | R5 | G5 | B5 | R5 | G5 | B5 | DS(5) |
| WS(6) | R6 | G6 | B6 | R6 | G6 | B6 | R6 | G6 | B6 | R6 | G6 | B6 | DS(6) |
| WS(7) | R7 | G7 | B7 | R7 | G7 | B7 | R7 | G7 | B7 | R7 | G7 | B7 | DS(7) |
| WS(8) | R8 | G8 | B8 | R8 | G8 | B8 | R8 | G8 | B8 | R8 | G8 | B8 | DS(8) |
| WS(9) | R9 | G9 | B9 | R9 | G9 | B9 | R9 | G9 | B9 | R9 | G9 | B9 | DS(9) |
| WS(10) | R10 | G10 | B10 | R10 | G10 | B10 | R10 | G10 | B10 | R10 | G10 | B10 | DS(10) |
| WS(11) | R11 | G11 | B11 | R11 | G11 | B11 | R11 | G11 | B11 | R11 | G11 | B11 | DS(11) |
| WS(12) | R12 | G12 | B12 | R12 | G12 | B12 | R12 | G12 | B12 | R12 | G12 | B12 | DS(12) |
| WS(13) | R13 | G13 | B13 | R13 | G13 | B13 | R13 | G13 | B13 | R13 | G13 | B13 | DS(13) |
| WS(14) | R14 | G14 | B14 | R14 | G14 | B14 | R14 | G14 | B14 | R14 | G14 | B14 | DS(14) |
| WS(15) | R15 | G15 | B15 | R15 | G15 | B15 | R15 | G15 | B15 | R15 | G15 | B15 | DS(15) |
| WS(16) | R16 | G16 | B16 | R16 | G16 | B16 | R16 | G16 | B16 | R16 | G16 | B16 | DS(16) |

FIG.3B

| | | | | | | | | | | | | | |
|---|---|---|---|---|---|---|---|---|---|---|---|---|---|
| WS(1) | R1 | G1 | B1 | R1 | G1 | B1 | R1 | G1 | B1 | R1 | G1 | B1 | DS(0) |
| | R2 | G2 | B2 | R2 | G2 | B2 | R2 | G2 | B2 | R2 | G2 | B2 | DS(1) |
| WS(2) | R3 | G3 | B3 | R3 | G3 | B3 | R3 | G3 | B3 | R3 | G3 | B3 | |
| | R4 | G4 | B4 | R4 | G4 | B4 | R4 | G4 | B4 | R4 | G4 | B4 | DS(2) |
| WS(3) | R5 | G5 | B5 | R5 | G5 | B5 | R5 | G5 | B5 | R5 | G5 | B5 | |
| | R6 | G6 | B6 | R6 | G6 | B6 | R6 | G6 | B6 | R6 | G6 | B6 | DS(3) |
| WS(4) | R7 | G7 | B7 | R7 | G7 | B7 | R7 | G7 | B7 | R7 | G7 | B7 | |
| | R8 | G8 | B8 | R8 | G8 | B8 | R8 | G8 | B8 | R8 | G8 | B8 | DS(4) |
| WS(5) | R9 | G9 | B9 | R9 | G9 | B9 | R9 | G9 | B9 | R9 | G9 | B9 | |
| | R10 | G10 | B10 | R10 | G10 | B10 | R10 | G10 | B10 | R10 | G10 | B10 | DS(5) |
| WS(6) | R11 | G11 | B11 | R11 | G11 | B11 | R11 | G11 | B11 | R11 | G11 | B11 | |
| | R12 | G12 | B12 | R12 | G12 | B12 | R12 | G12 | B12 | R12 | G12 | B12 | DS(6) |
| WS(7) | R13 | G13 | B13 | R13 | G13 | B13 | R13 | G13 | B13 | R13 | G13 | B13 | |
| | R14 | G14 | B14 | R14 | G14 | B14 | R14 | G14 | B14 | R14 | G14 | B14 | DS(7) |
| WS(8) | R15 | G15 | B15 | R15 | G15 | B15 | R15 | G15 | B15 | R15 | G15 | B15 | |
| | R16 | G16 | B16 | R16 | G16 | B16 | R16 | G16 | B16 | R16 | G16 | B16 | DS(8) |

FIG.5A1
: DS ON
: Vth CANCEL
: Vth CANCEL & CORRECTION
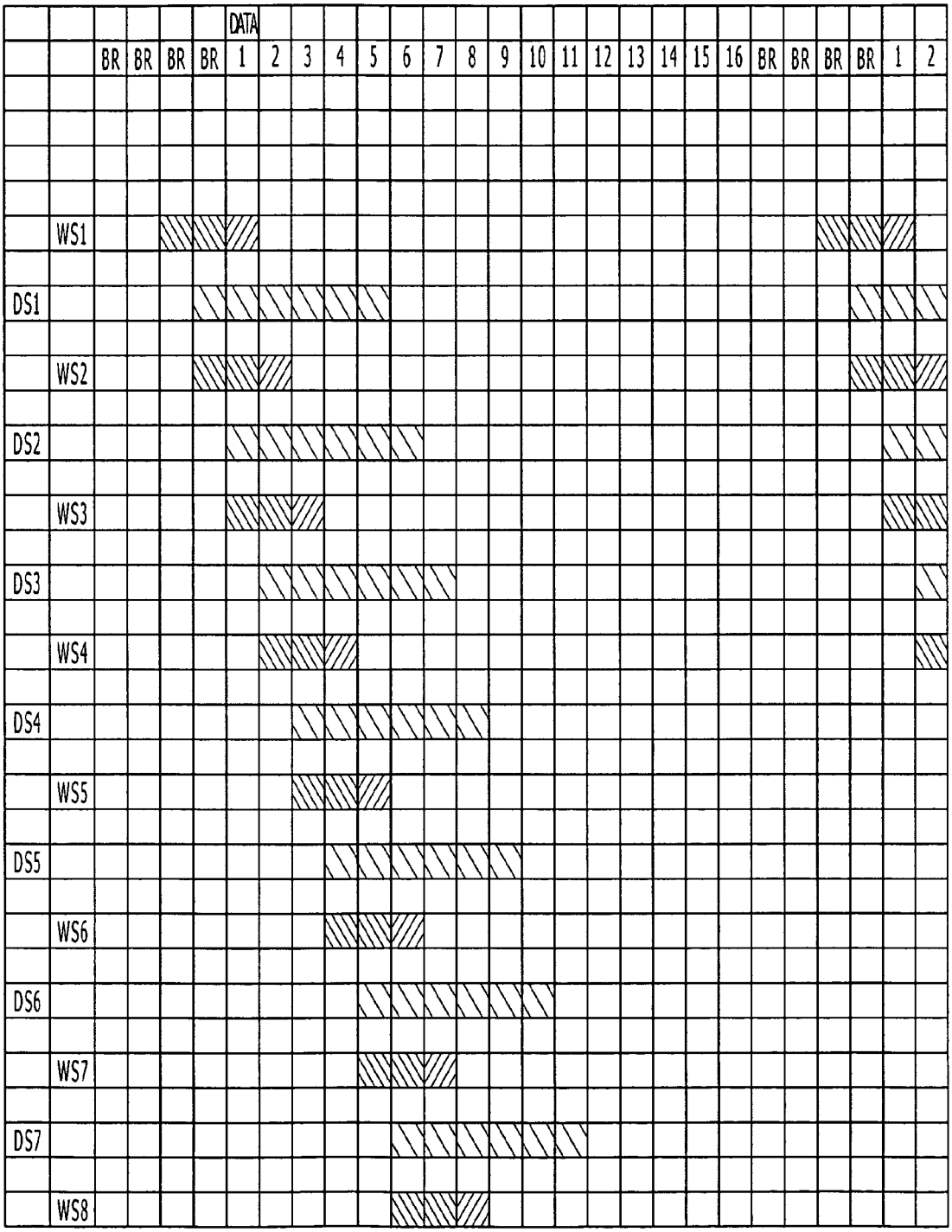

FIG.5A2
: DS ON
: Vth CANCEL
: Vth CANCEL & CORRECTION
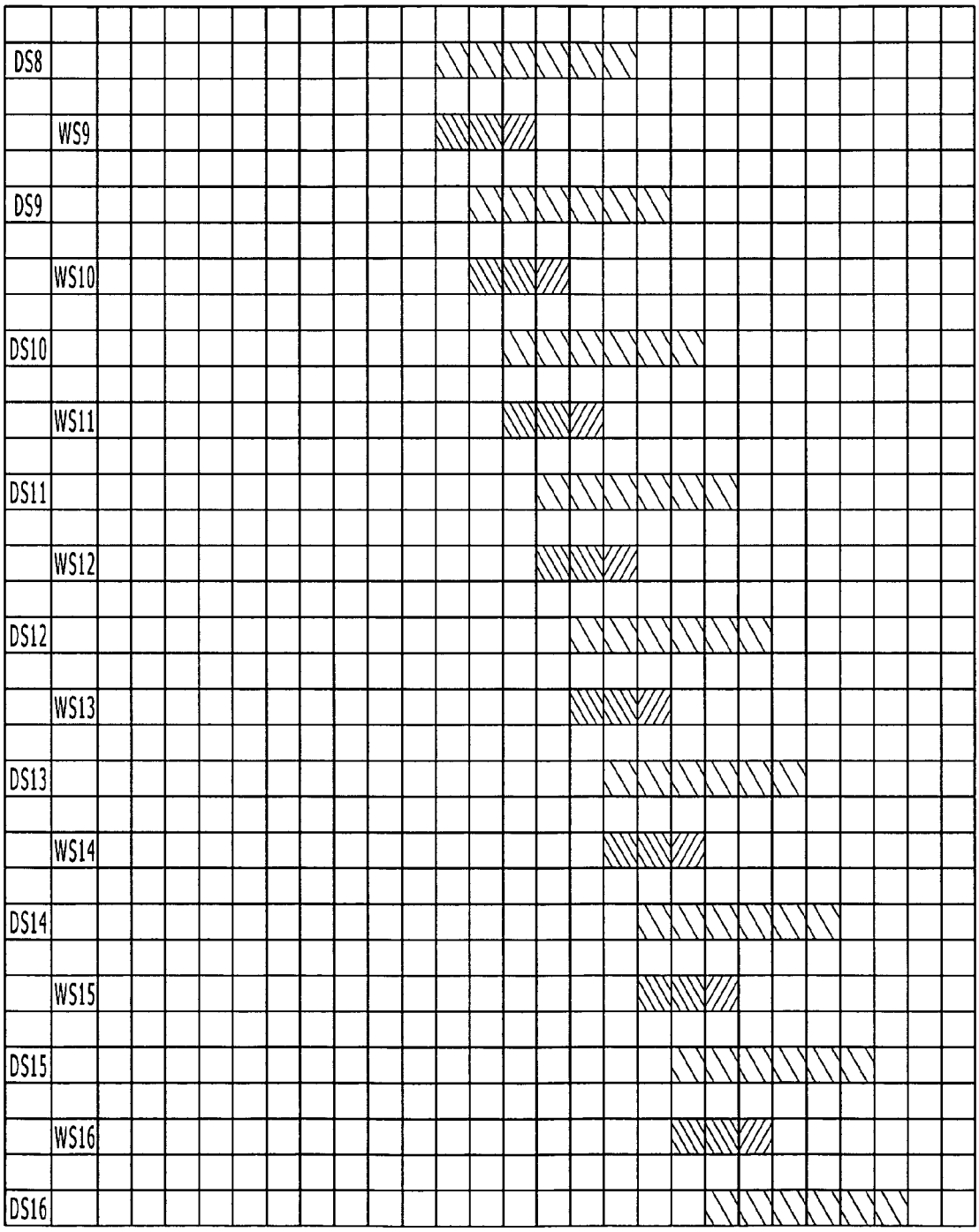

FIG.5B1
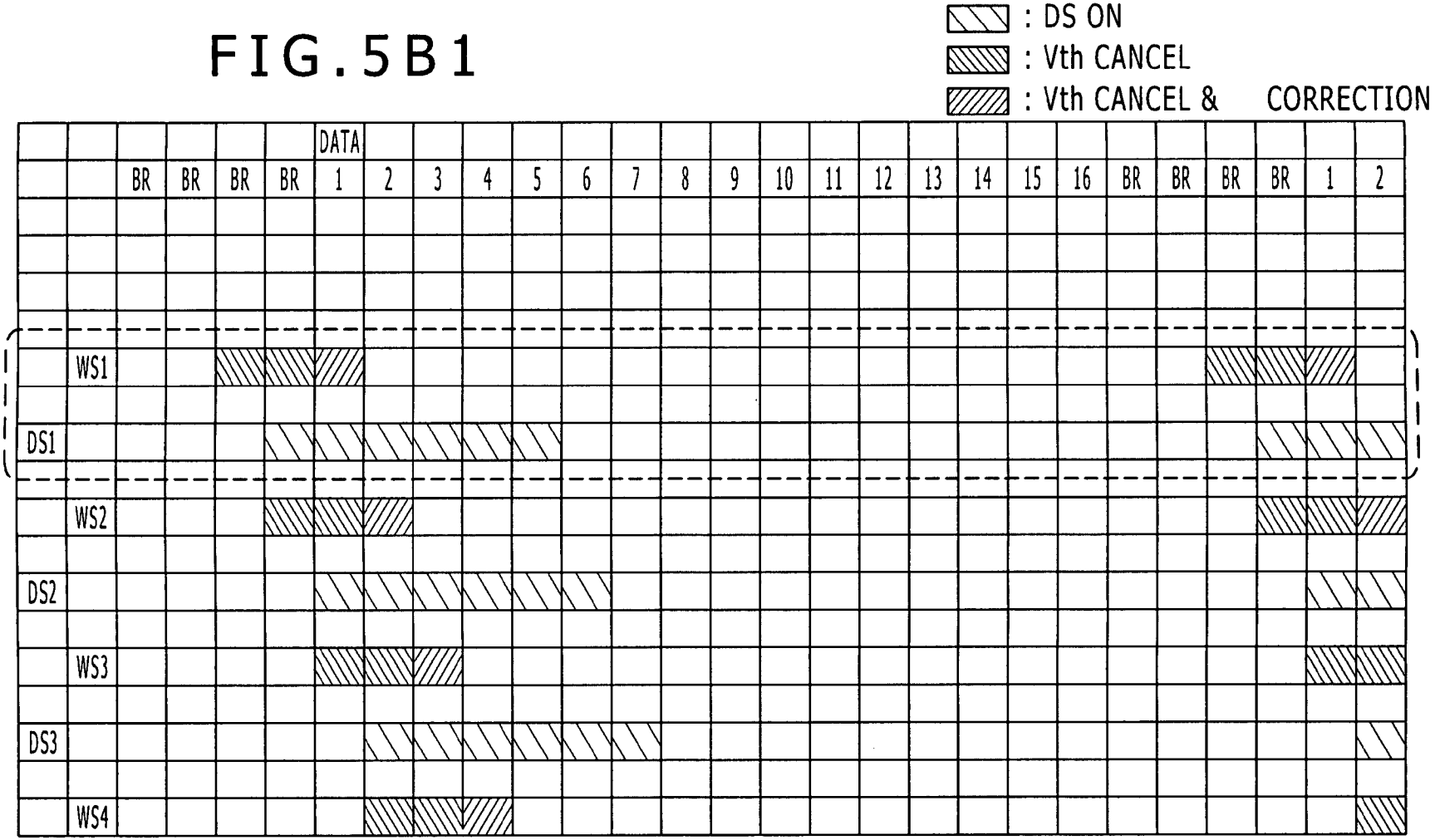

FIG.5B2
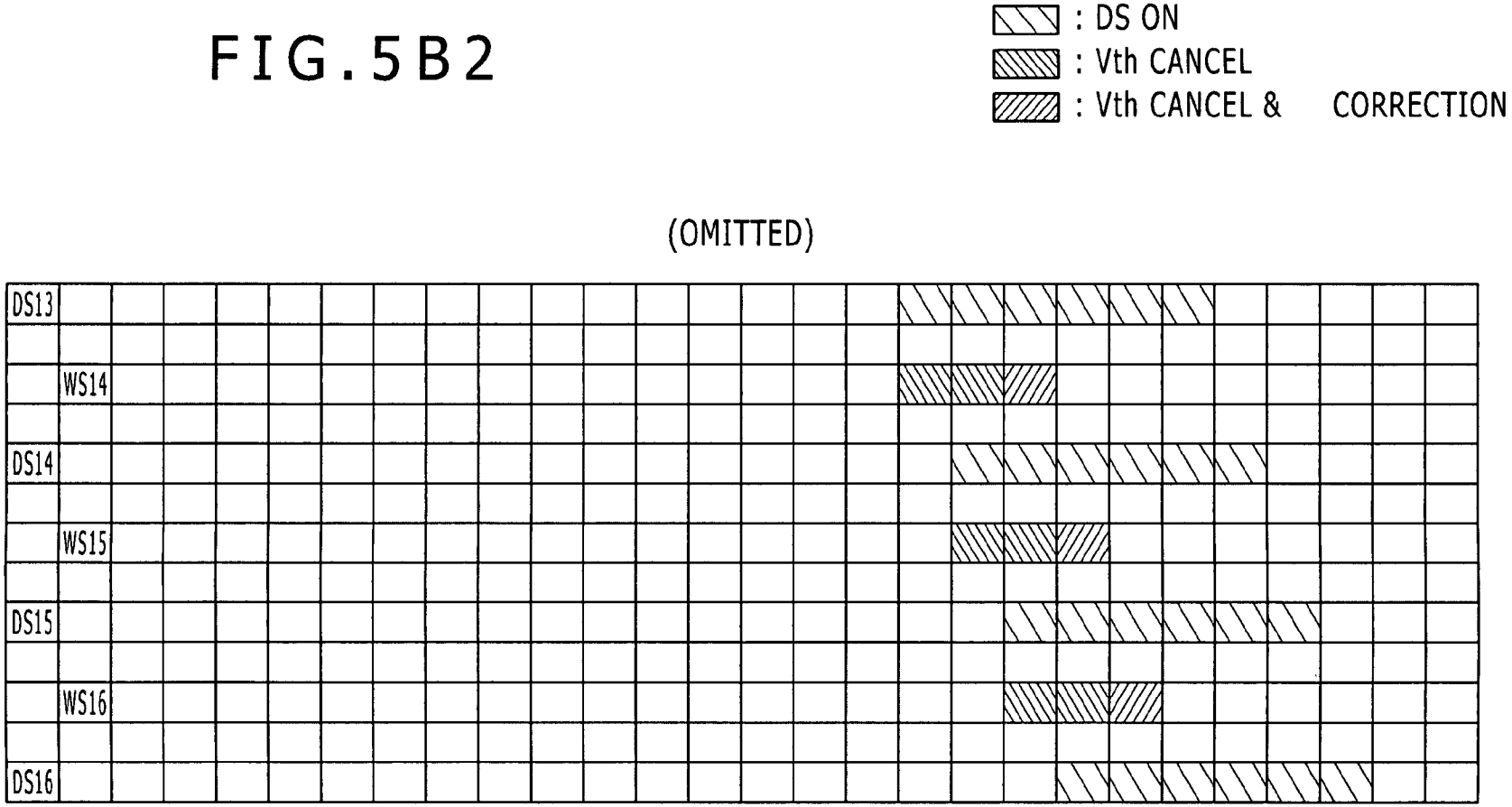

FIG.5C1
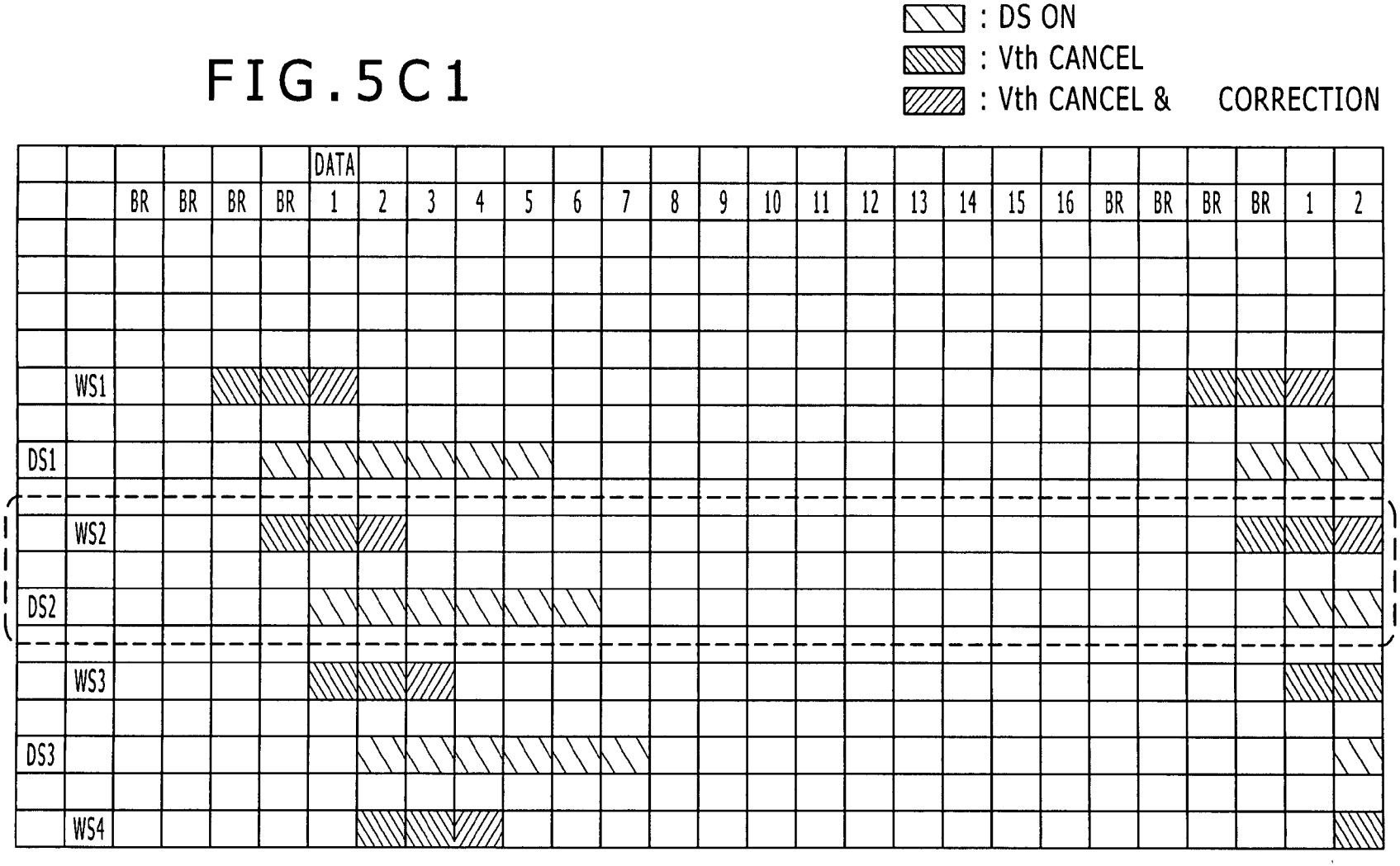

FIG.5C2
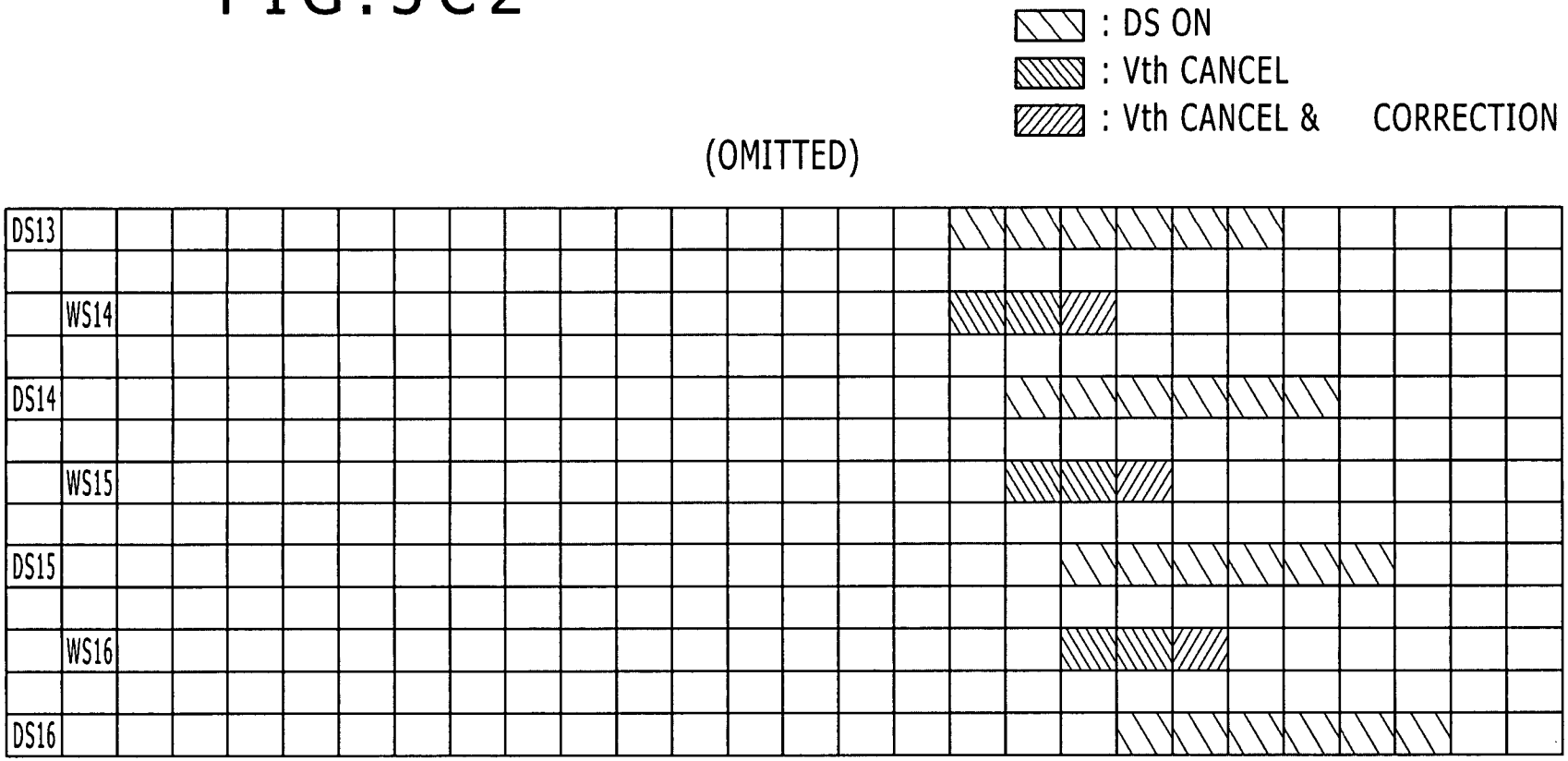

FIG.5D1
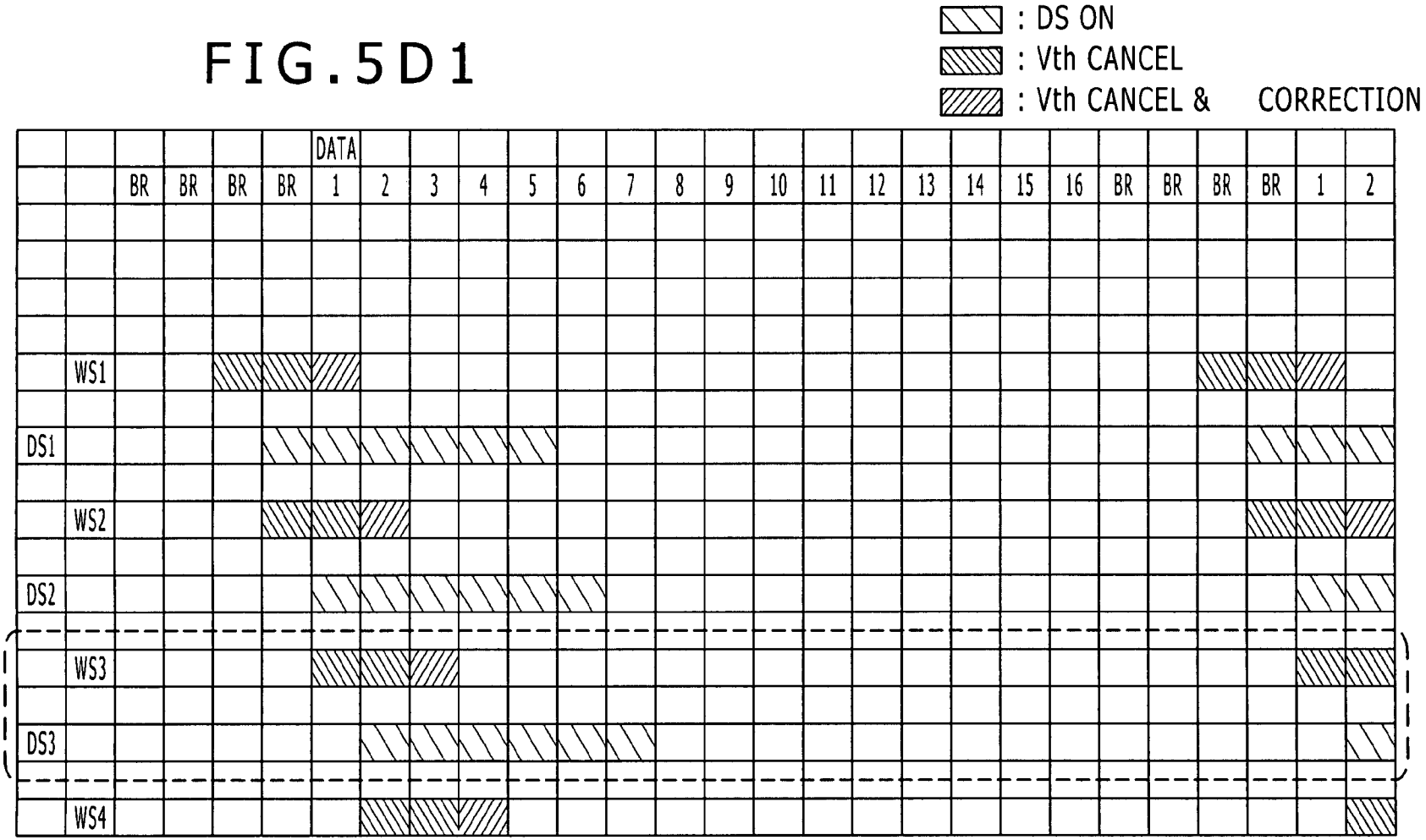

FIG.5D2
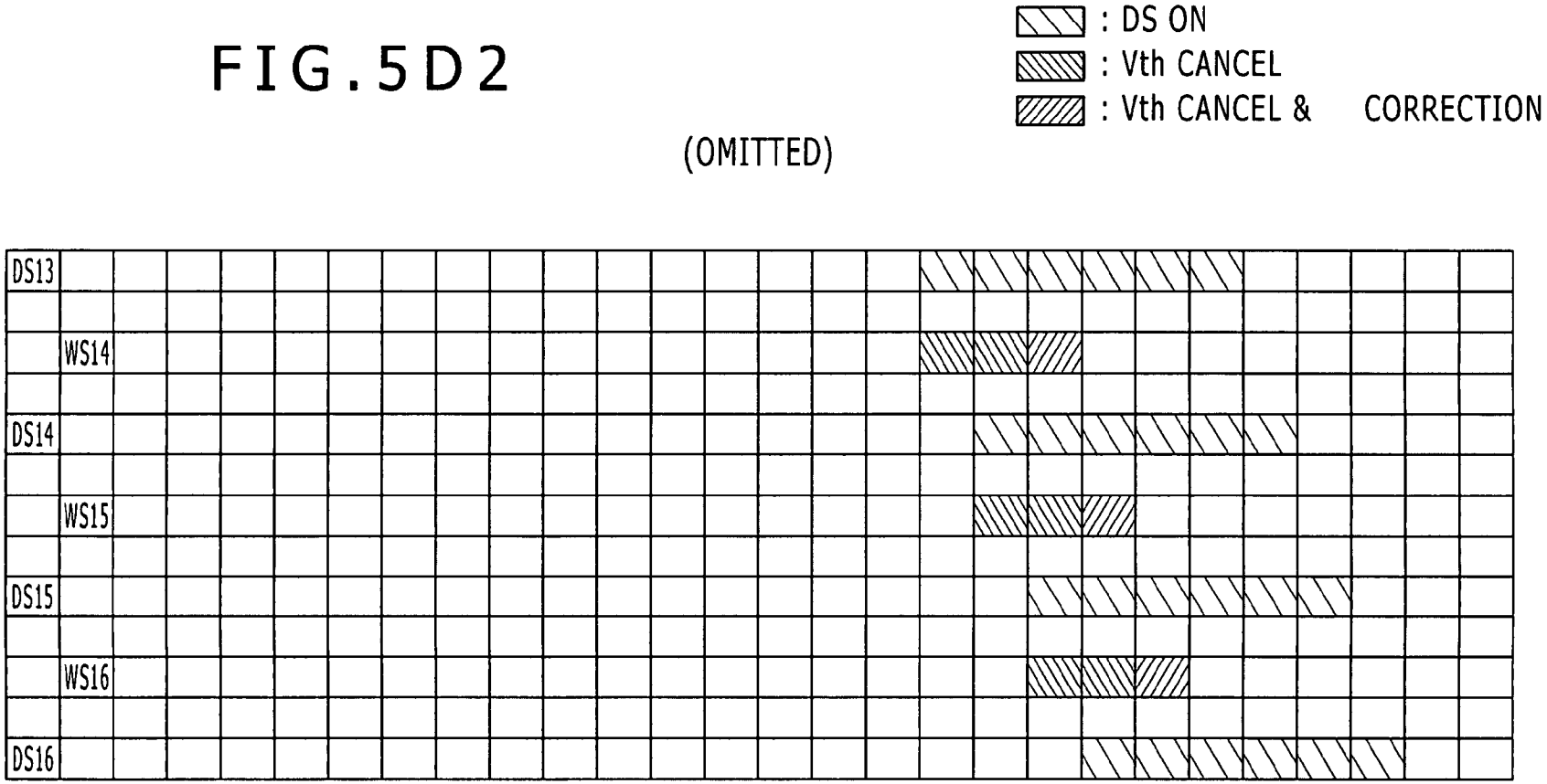

FIG.5E1
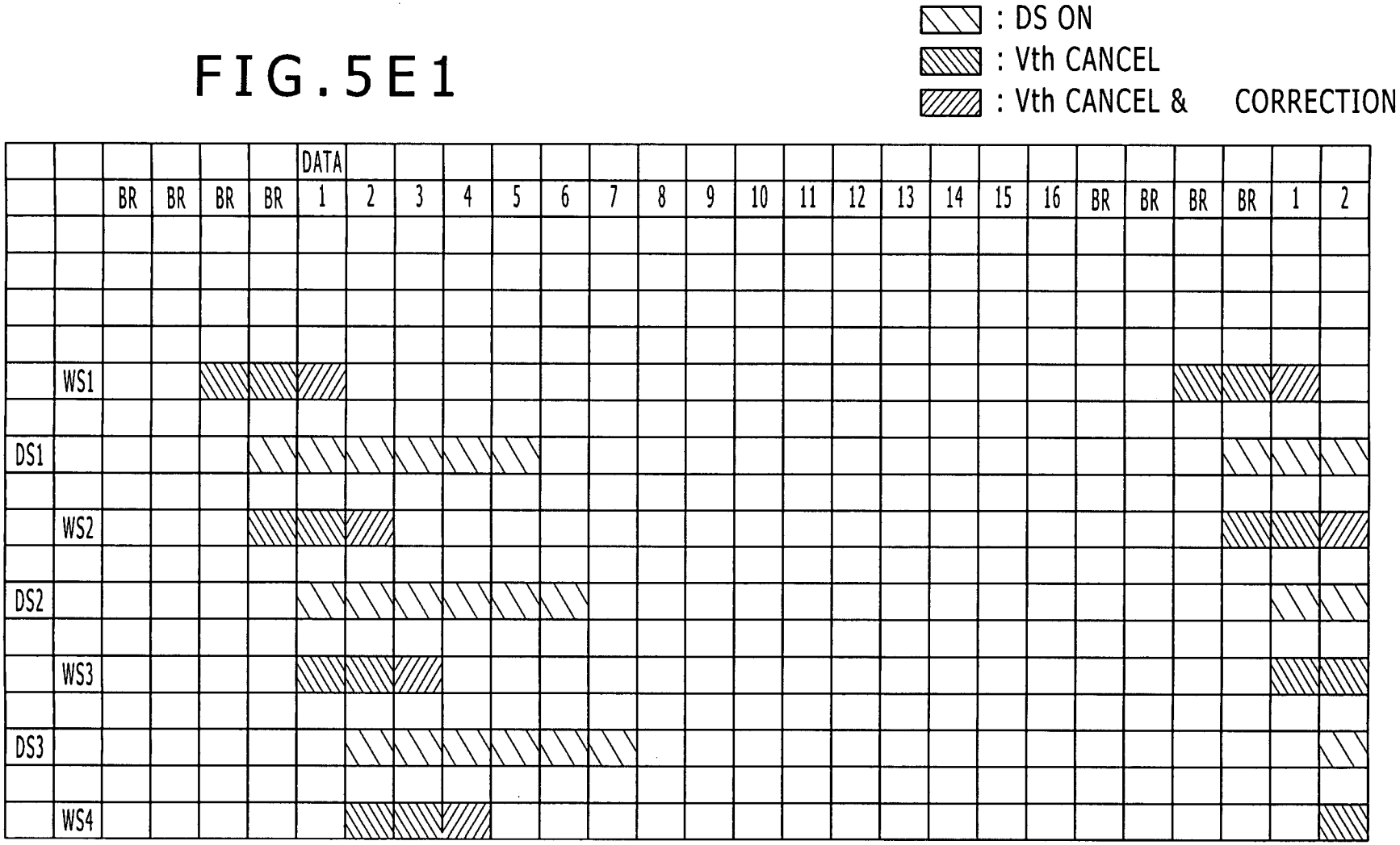

FIG.5E2
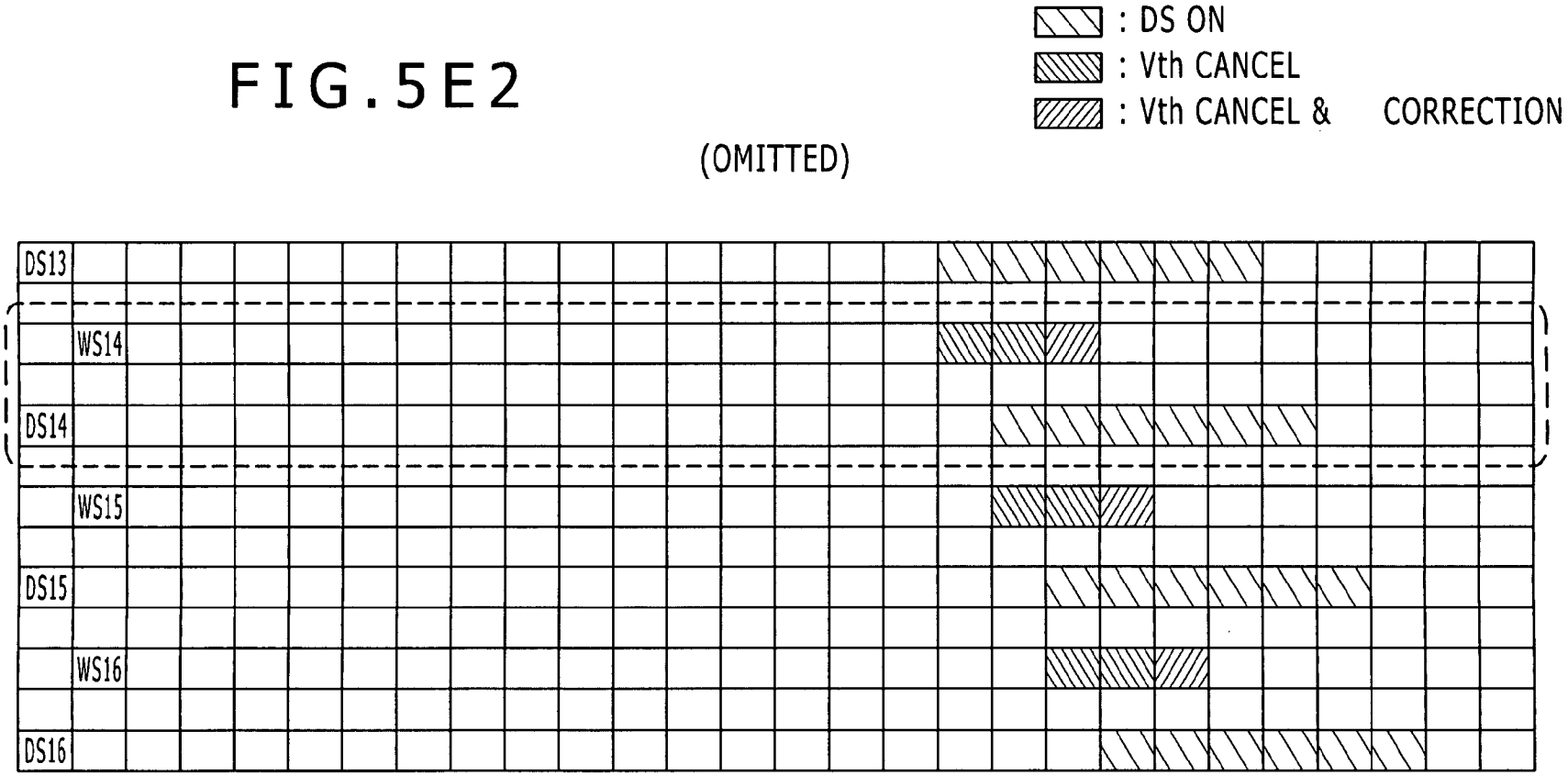

FIG.5F1
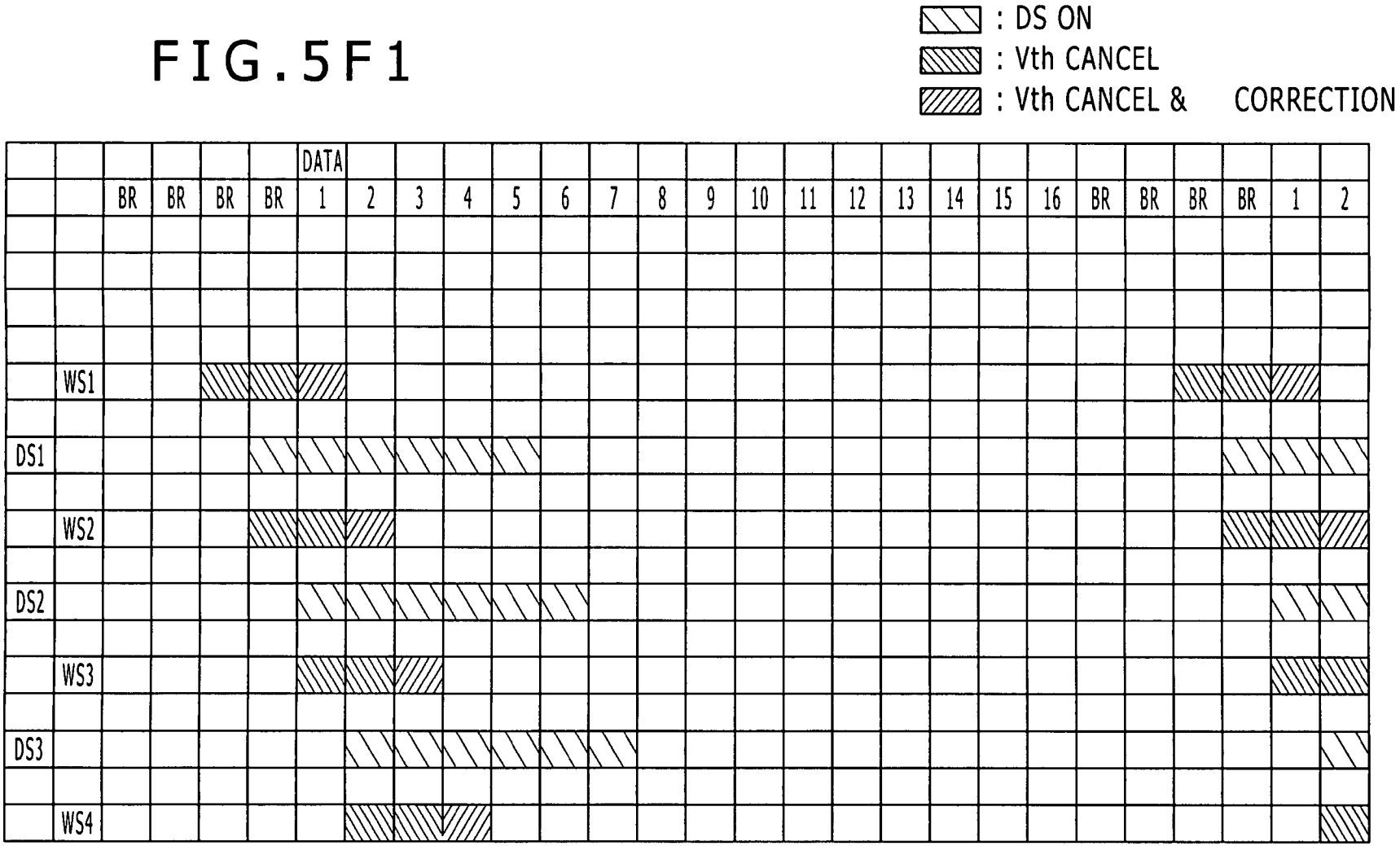

FIG.5F2
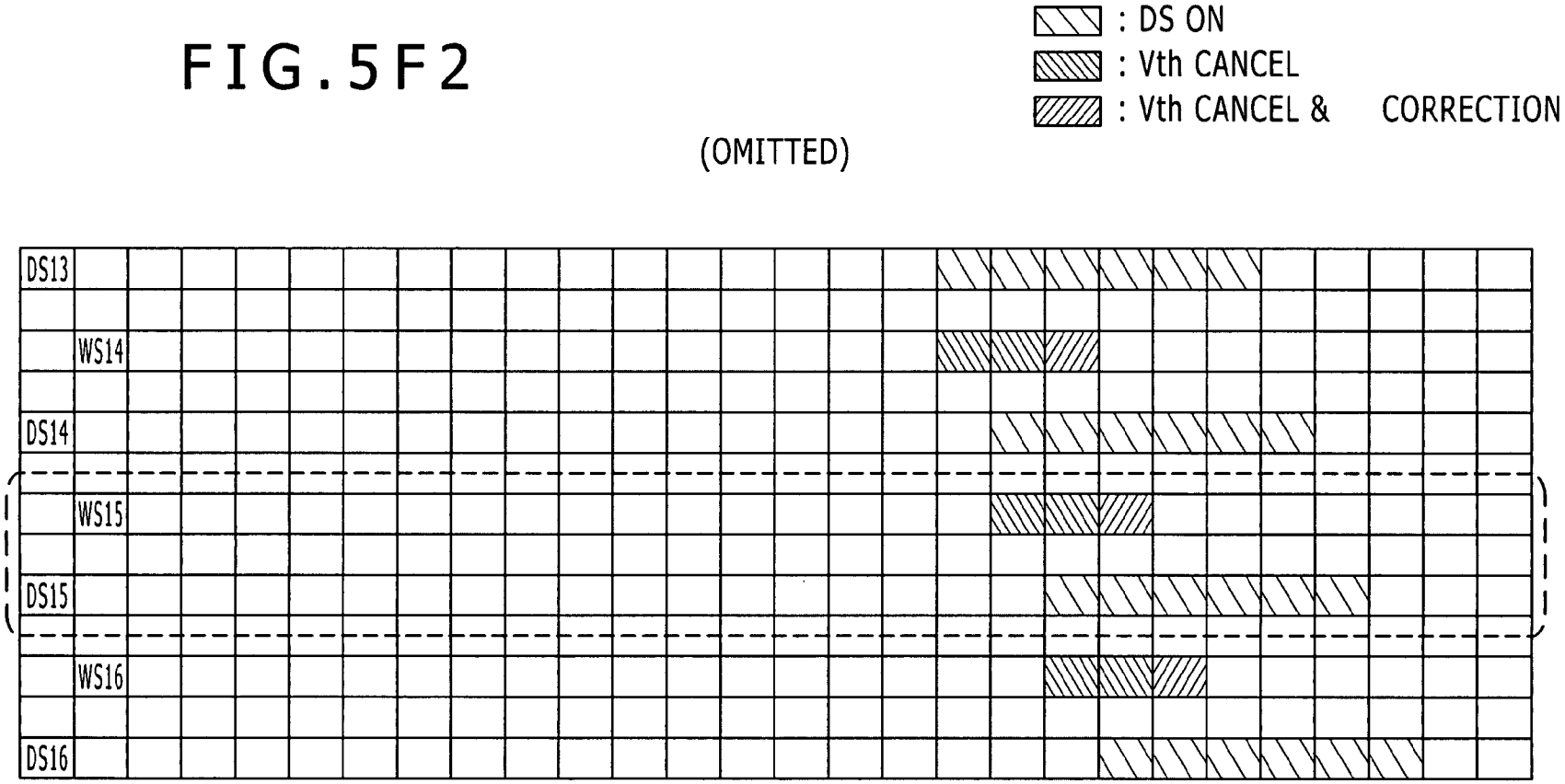

FIG.5G1
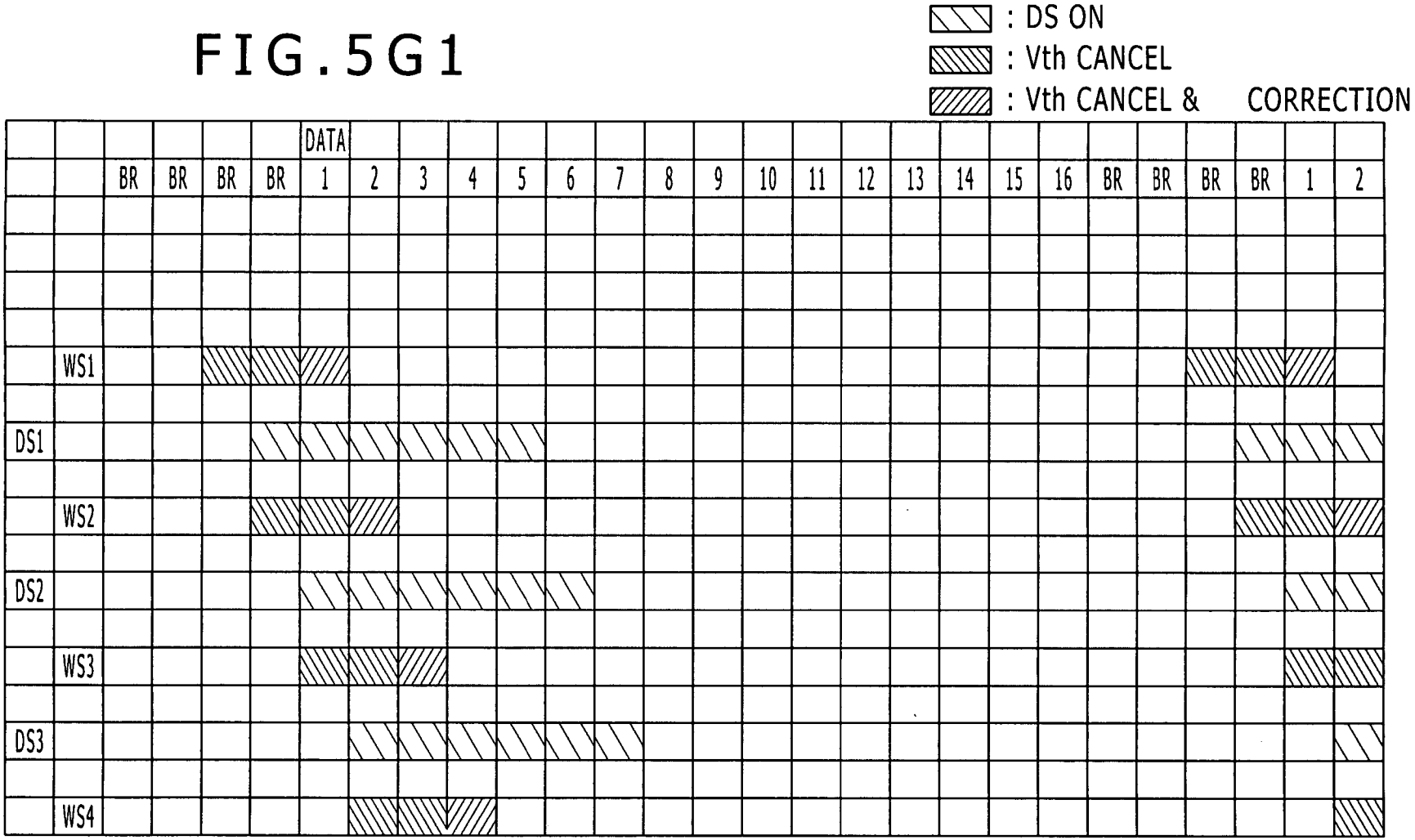

FIG.5G2
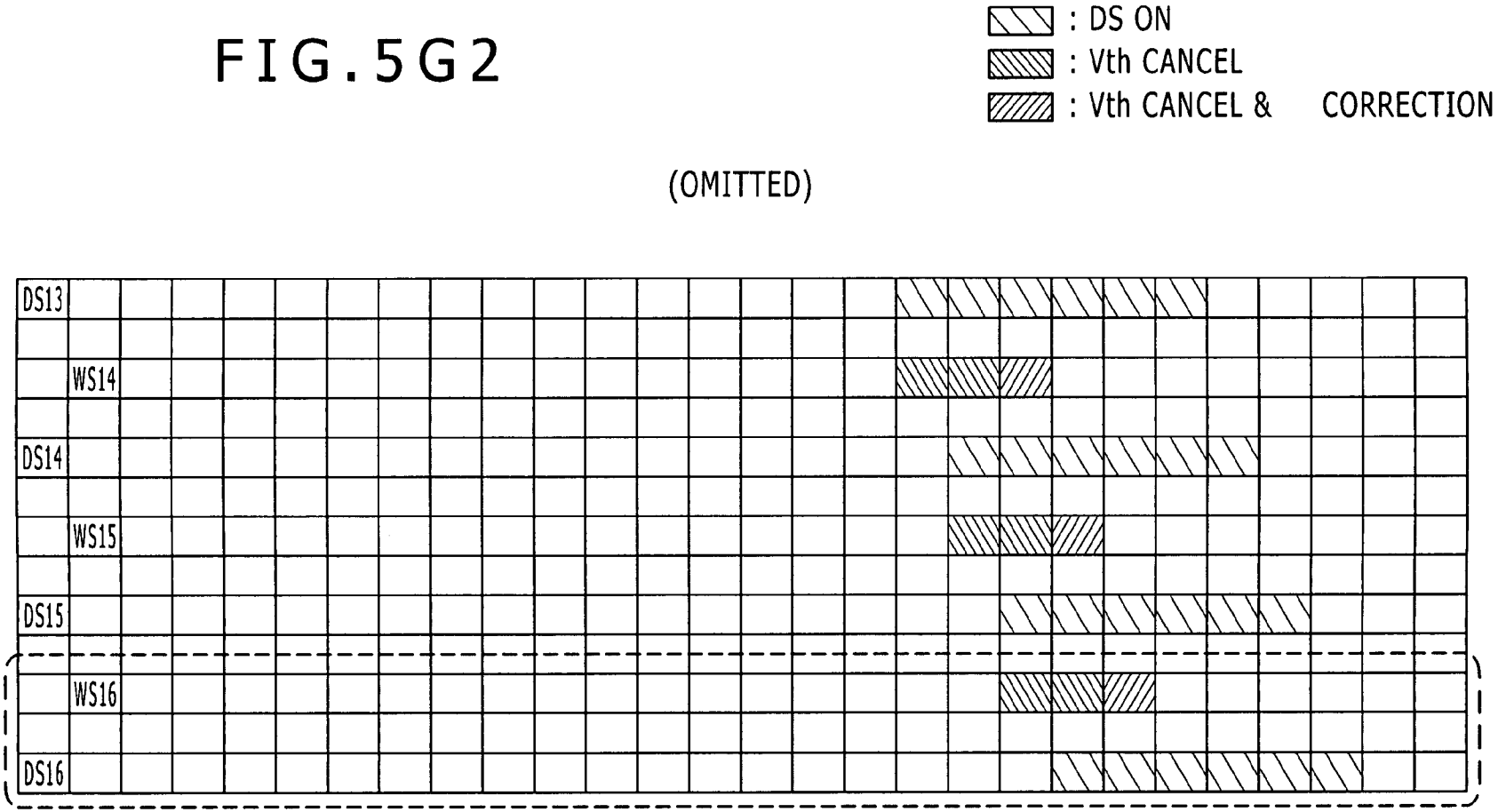

FIG.6A1
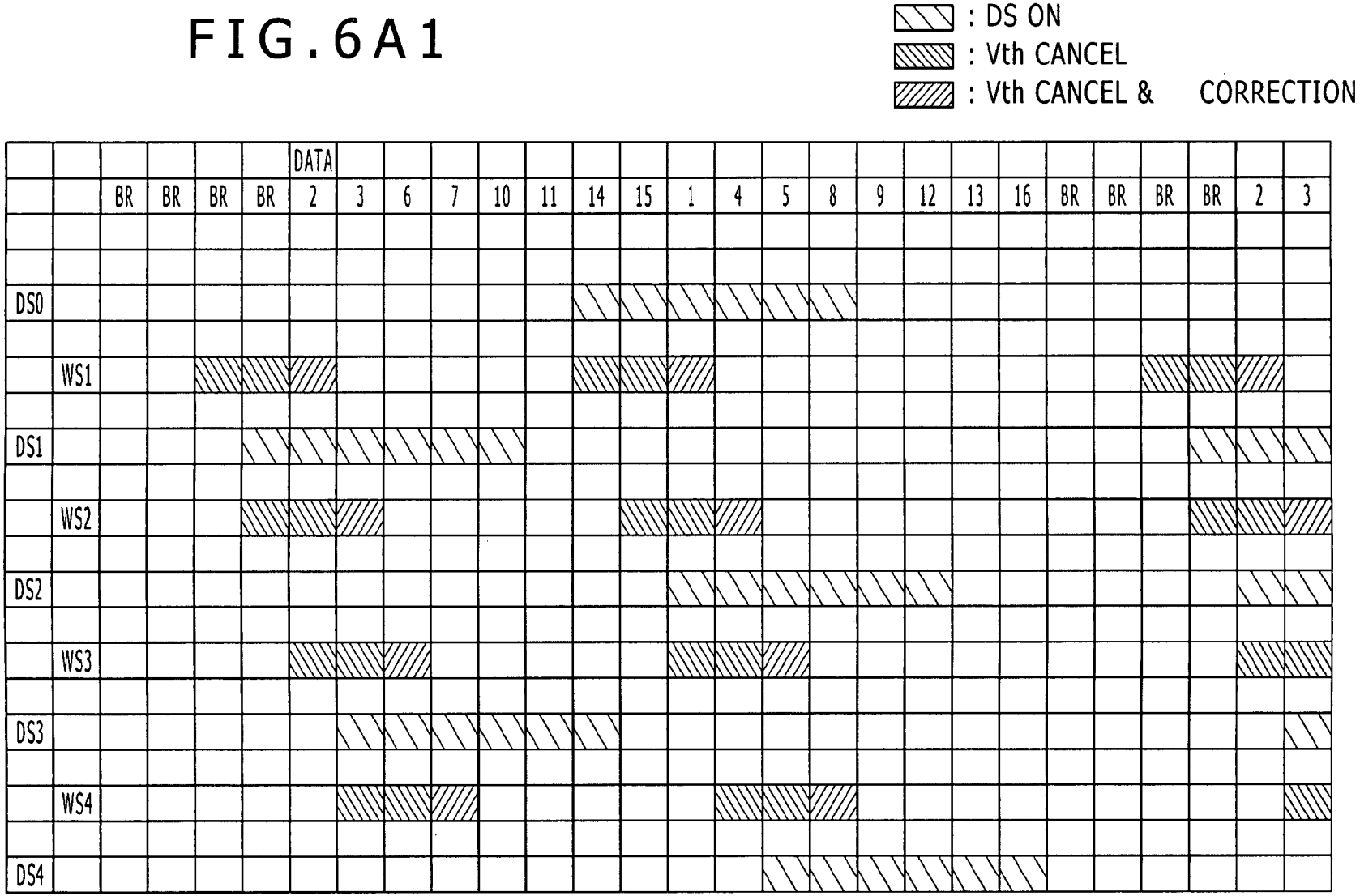

FIG.6A2
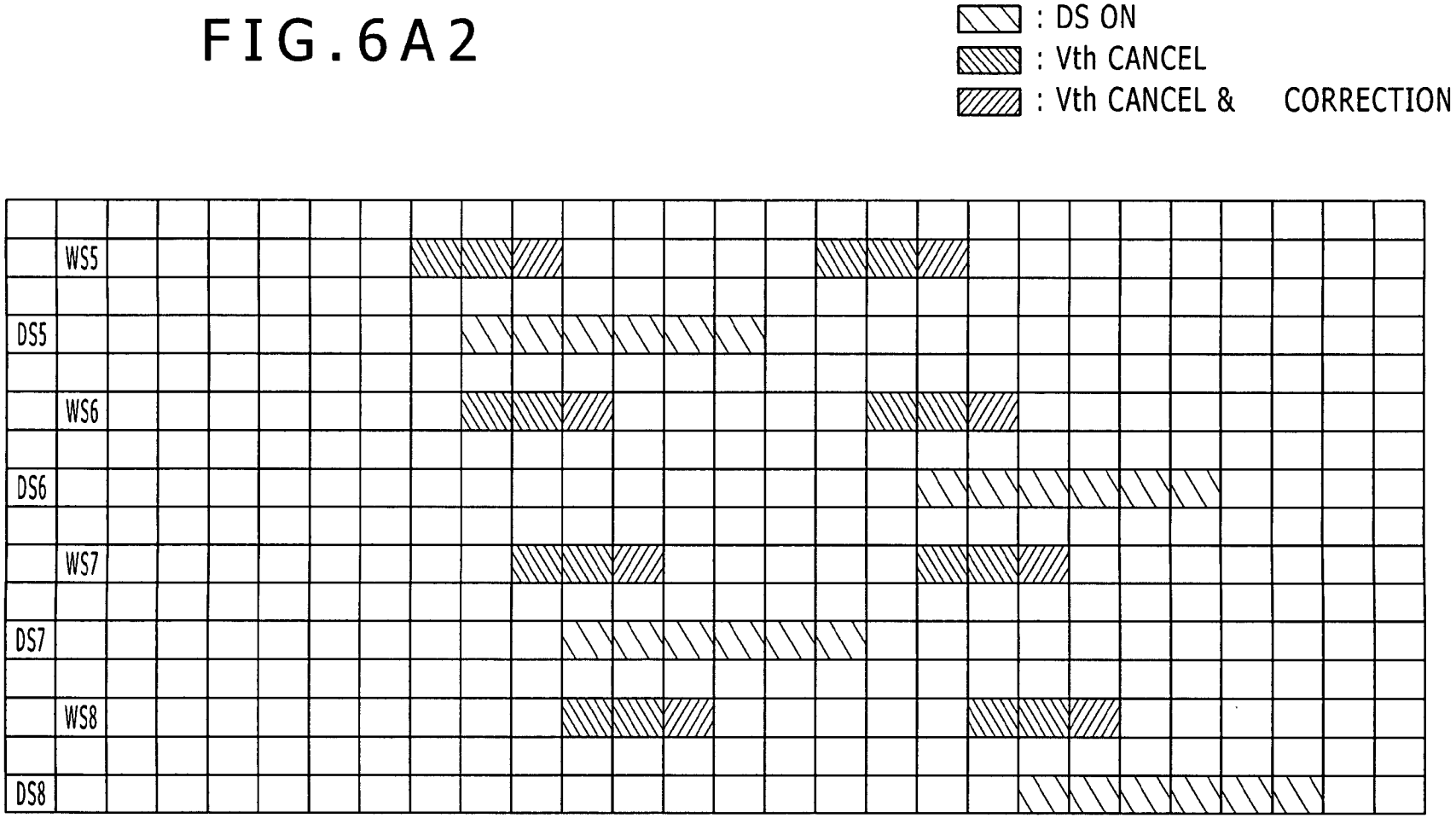

FIG.6B1
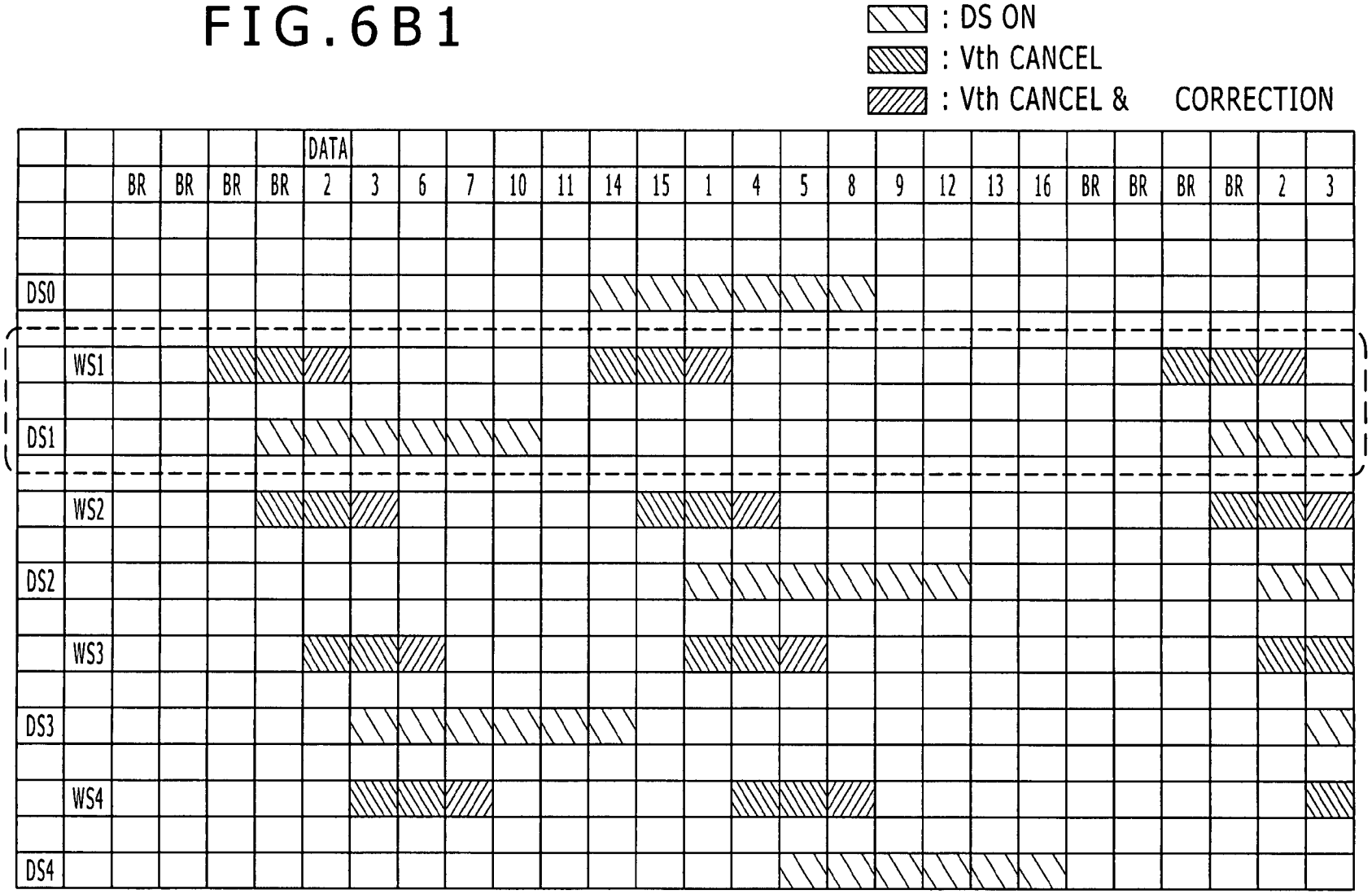

FIG.6B2
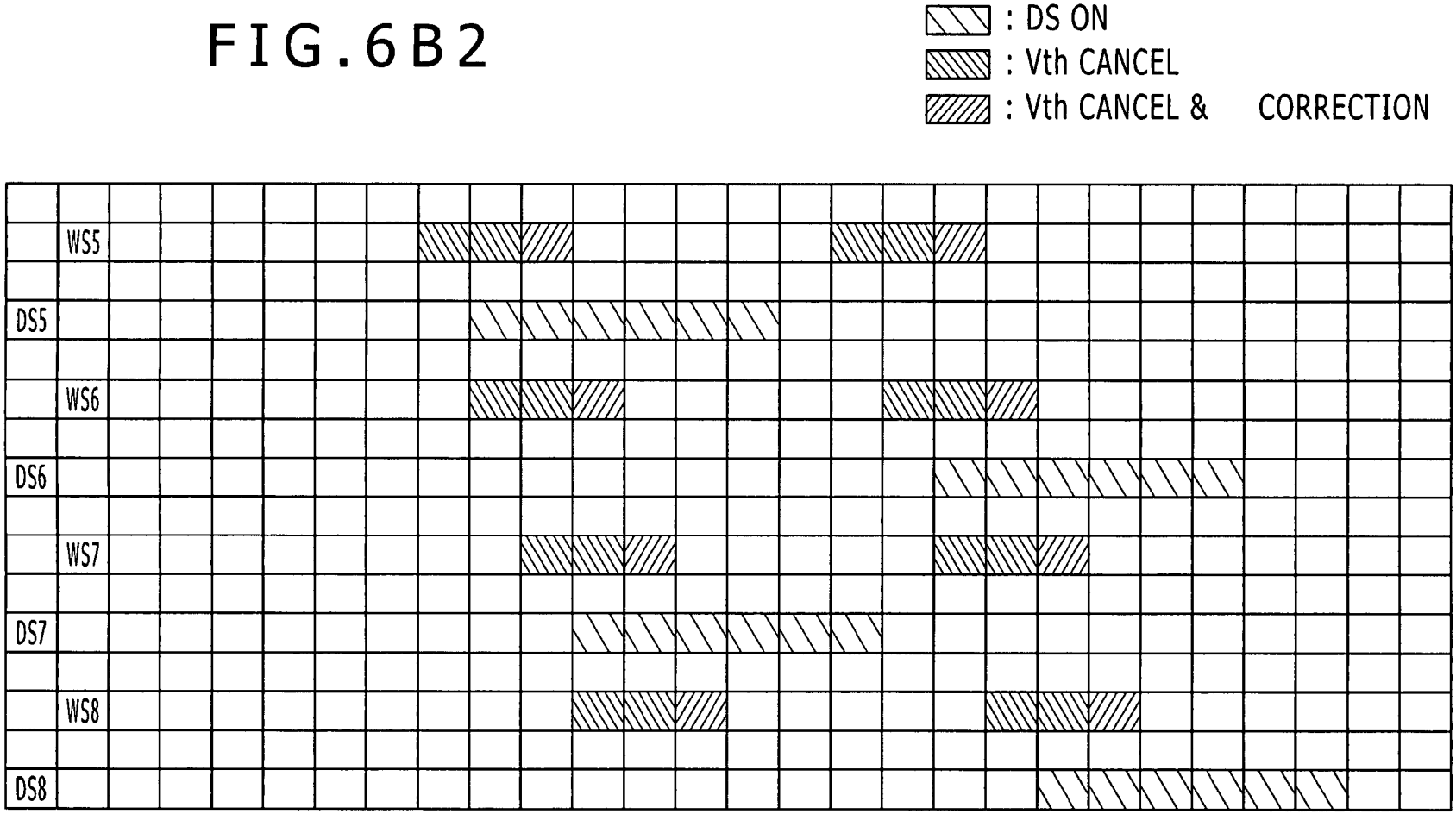

FIG.6C1
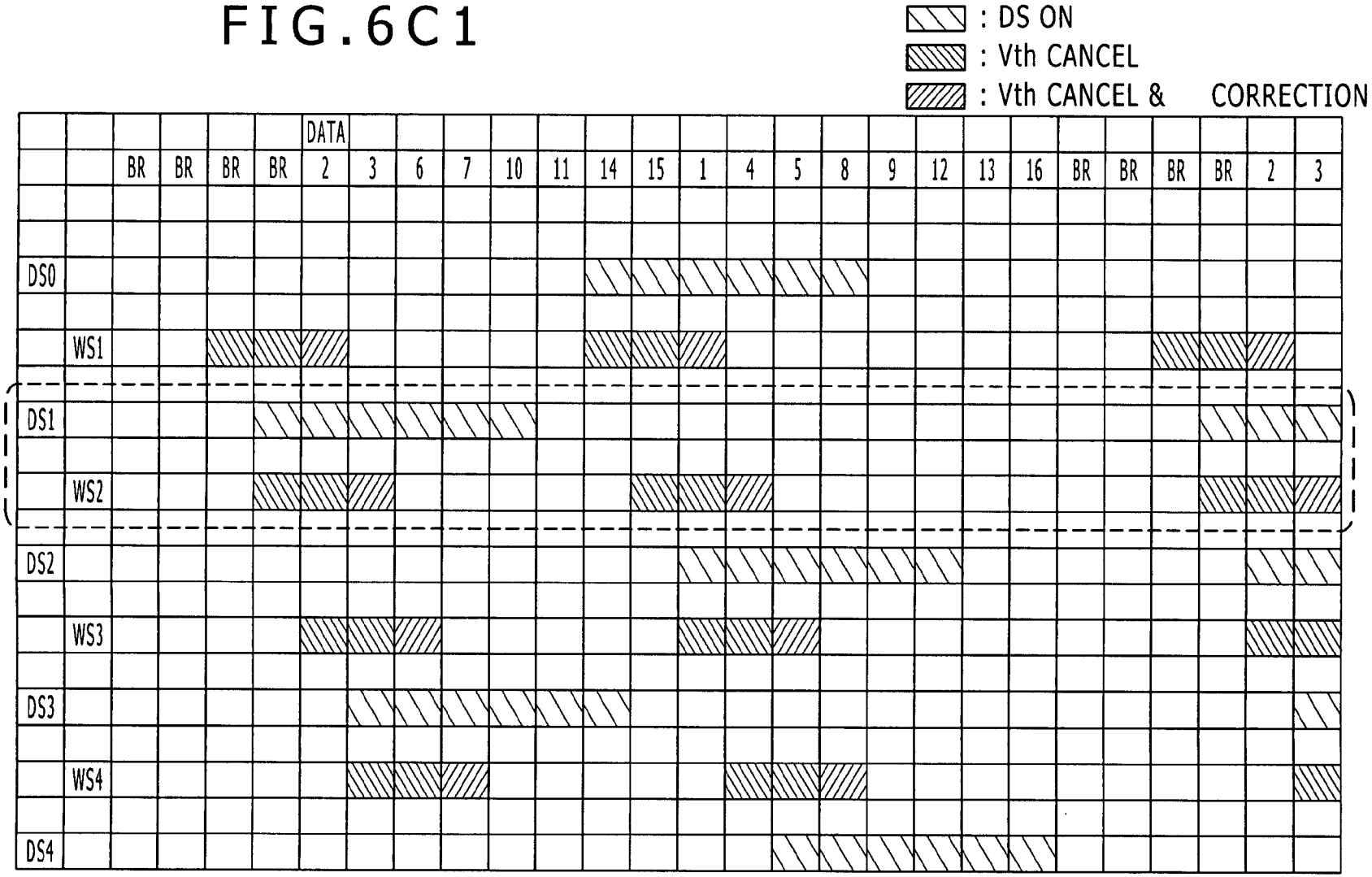

FIG.6C2
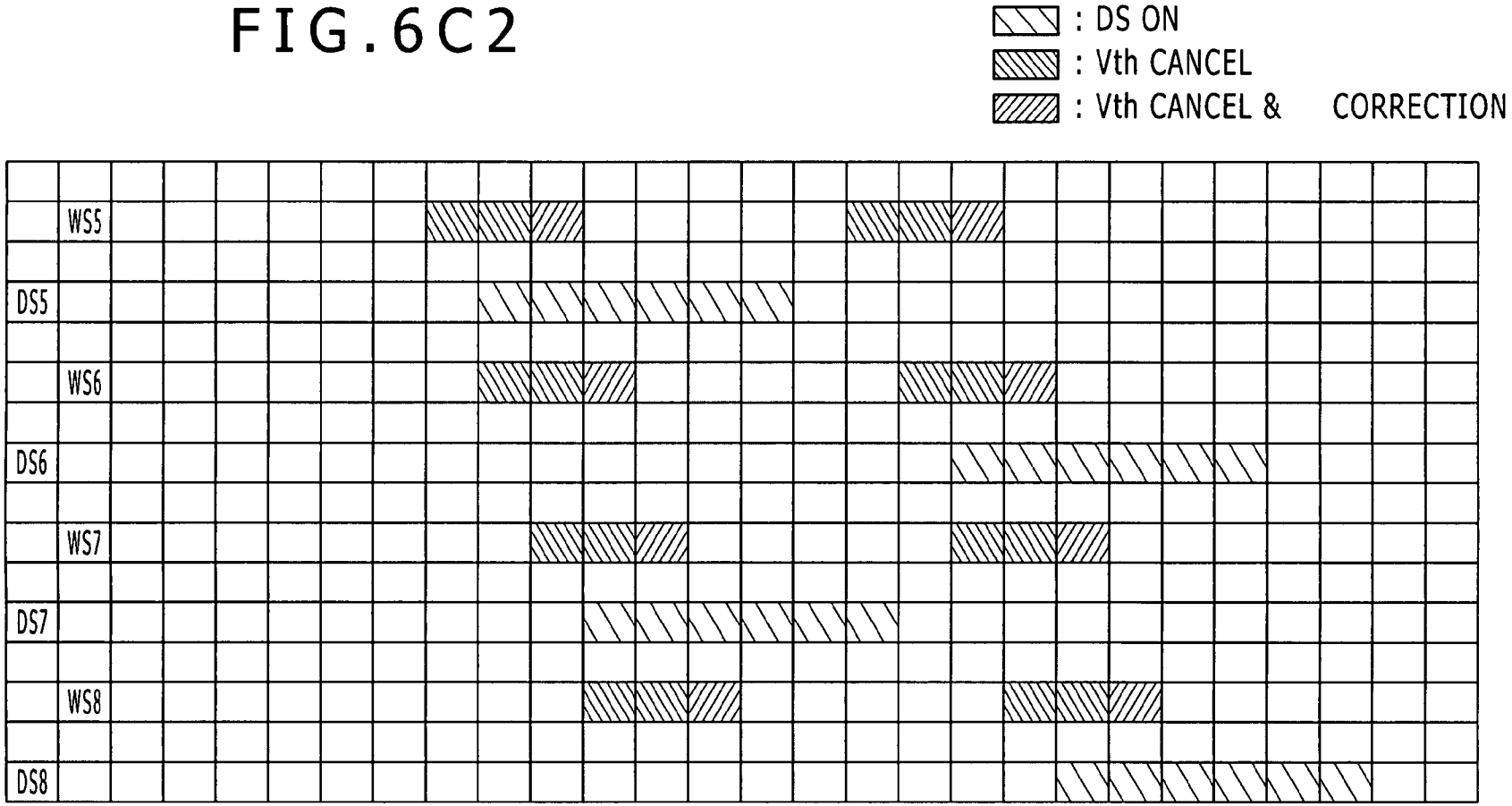

FIG.6D1
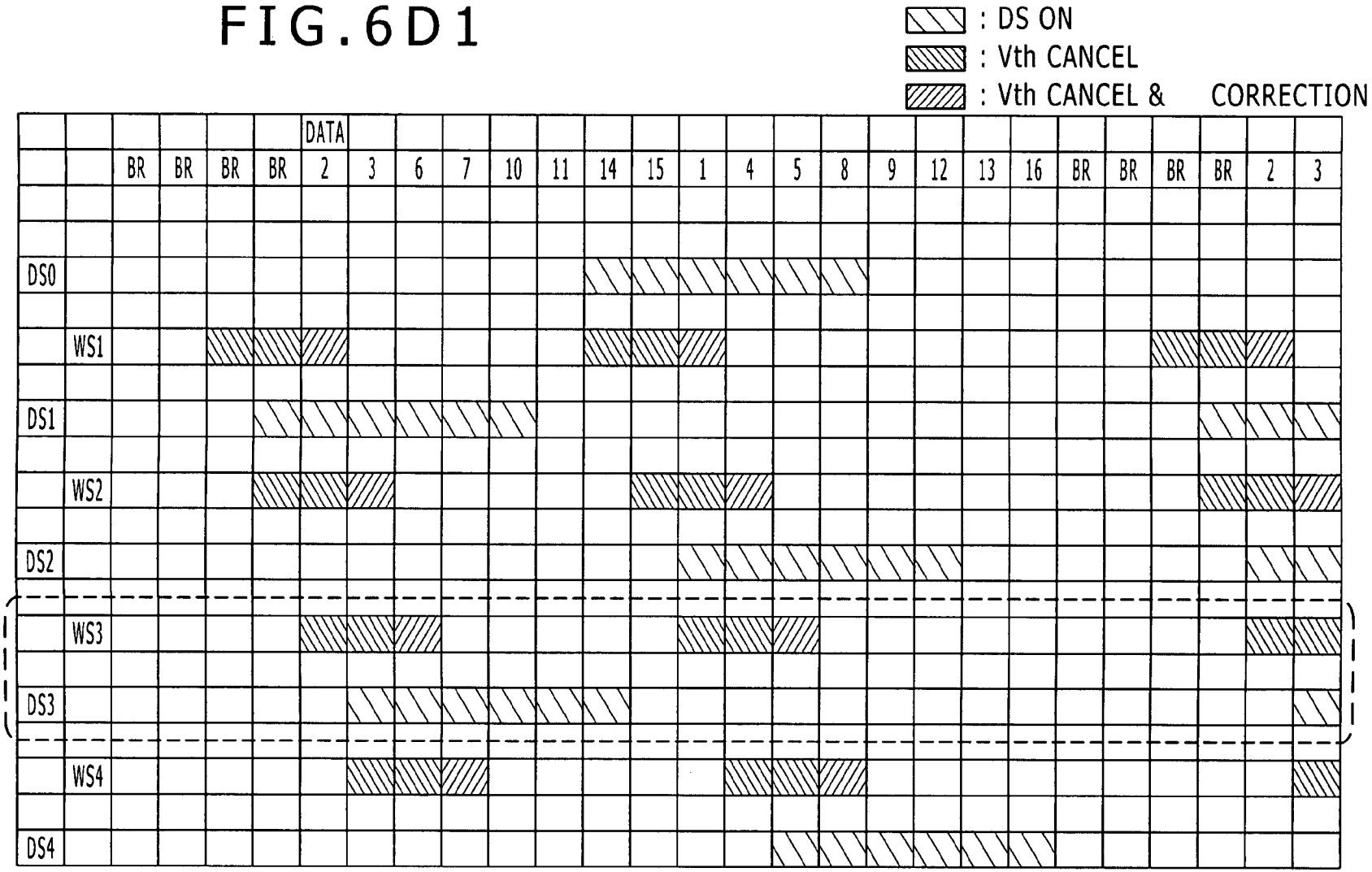

FIG.6D2
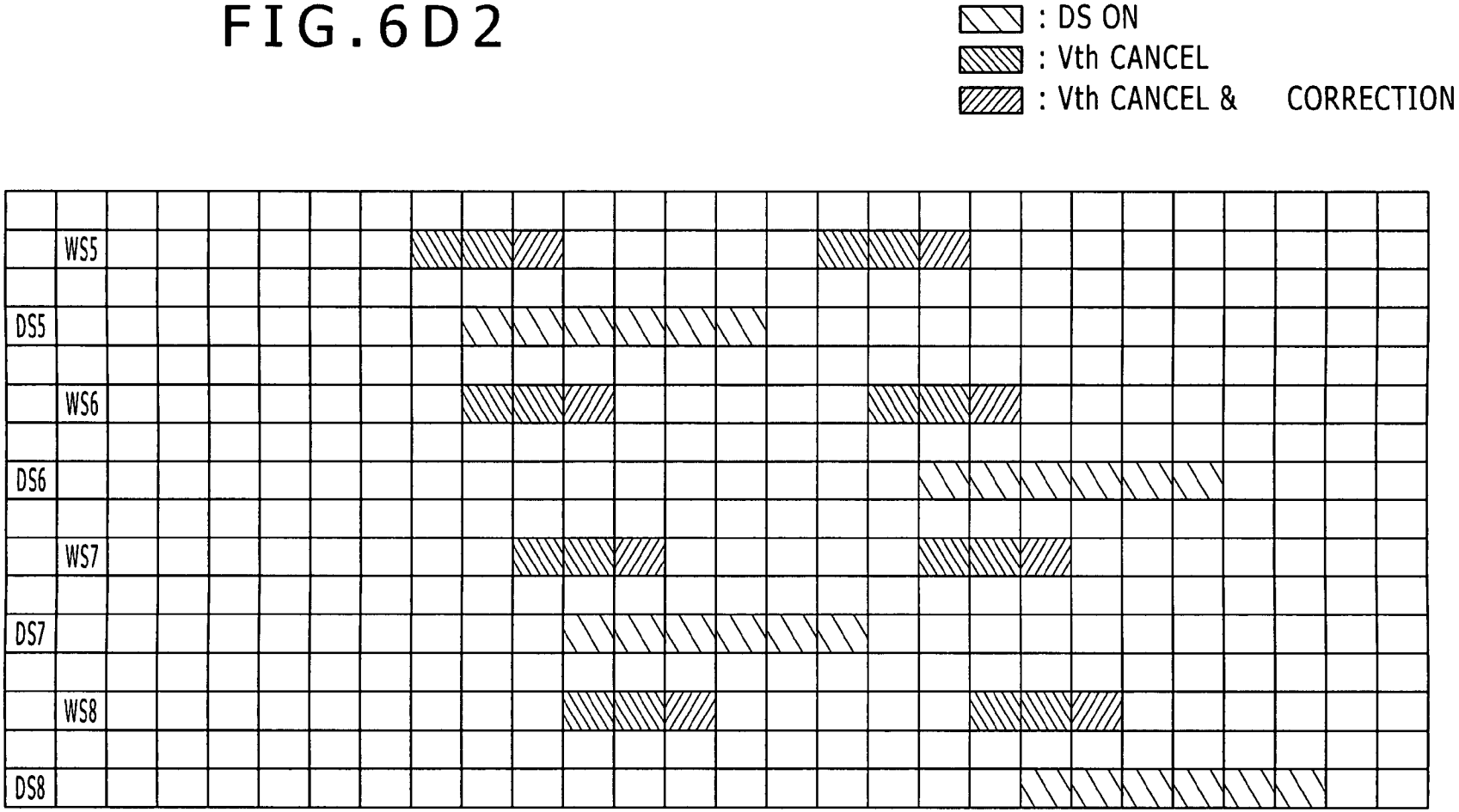

FIG.6E1
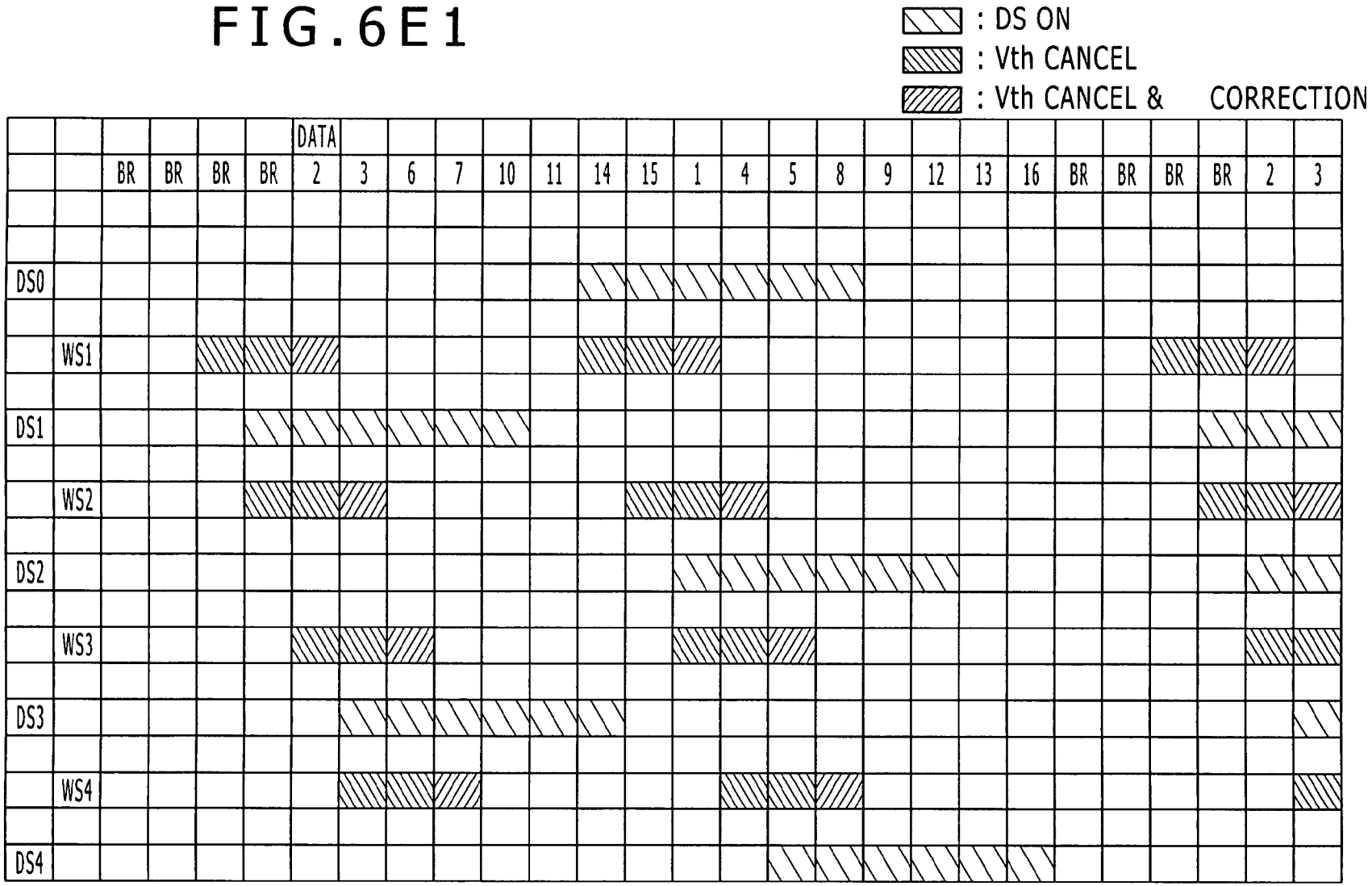

FIG.6E2
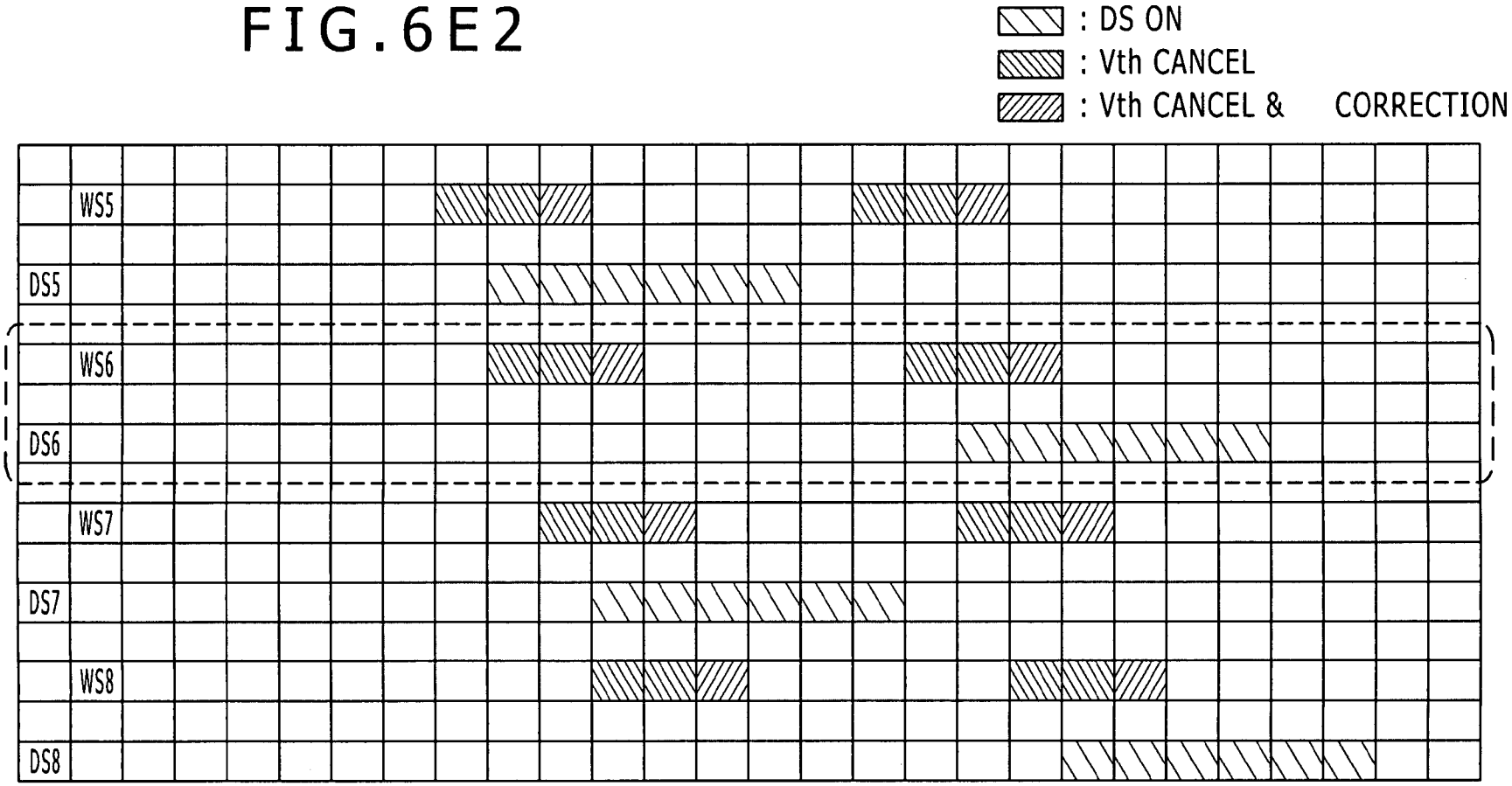

FIG.6F1
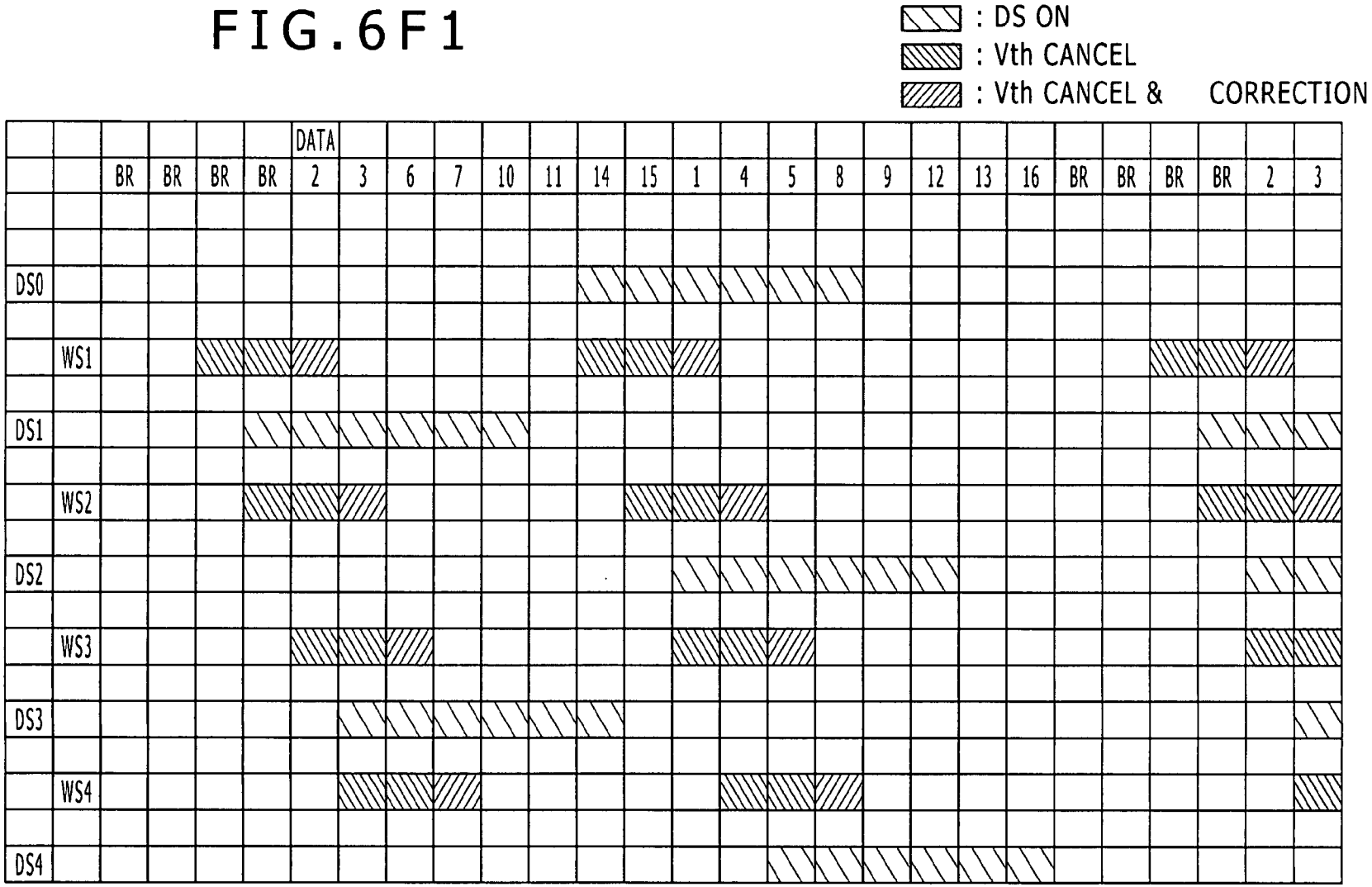

FIG.6F2
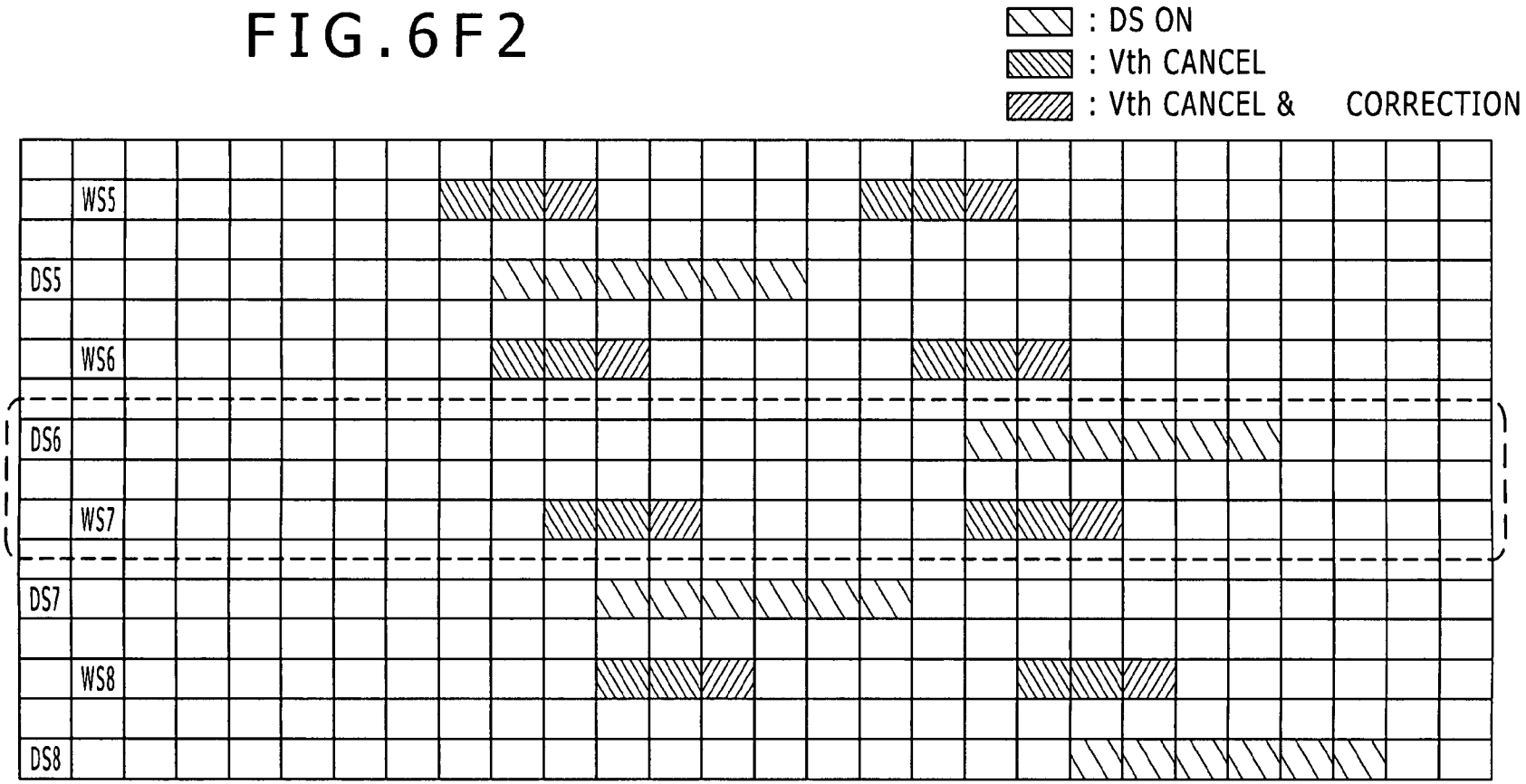

FIG.6G1
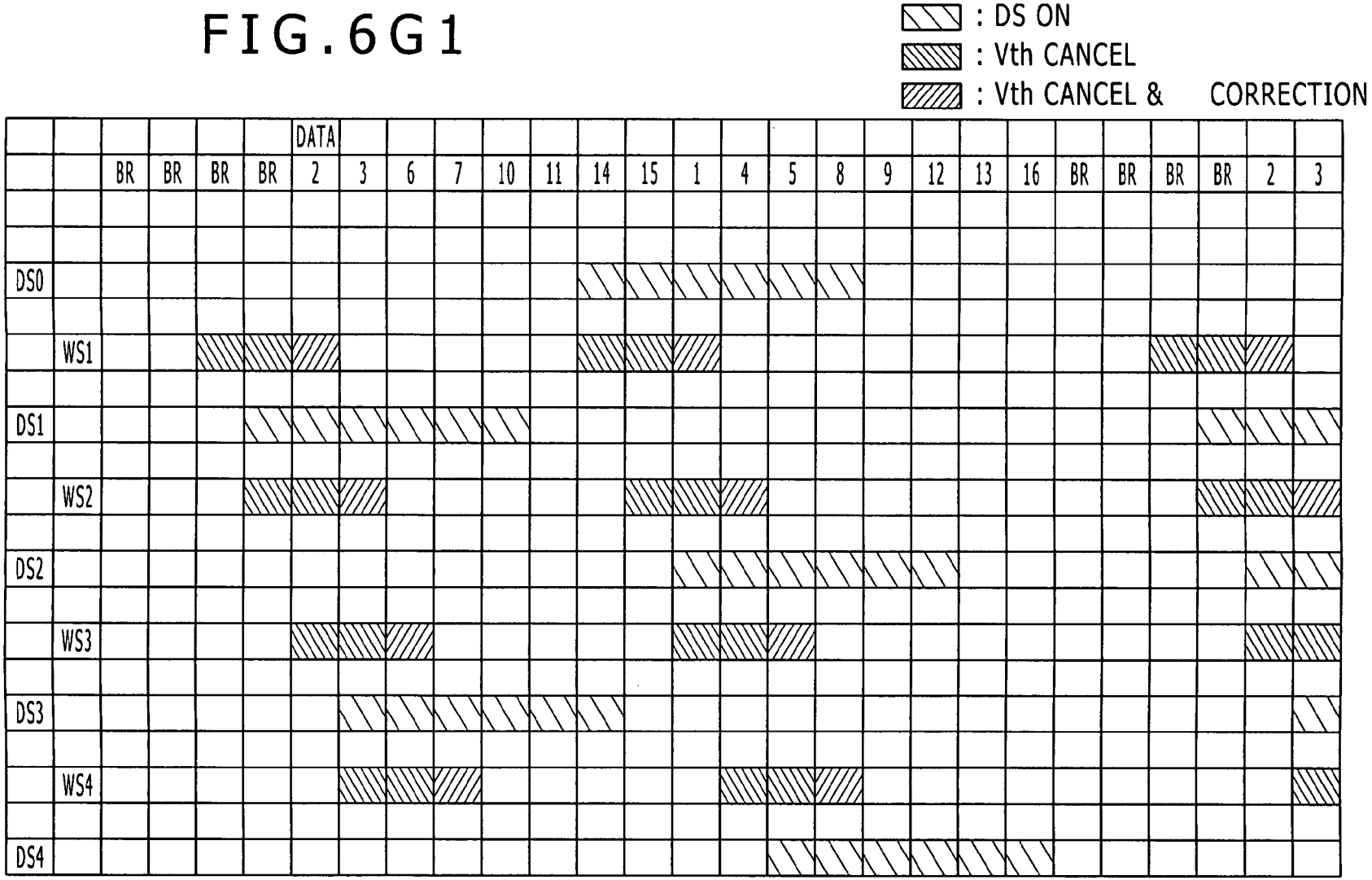

FIG.6G2
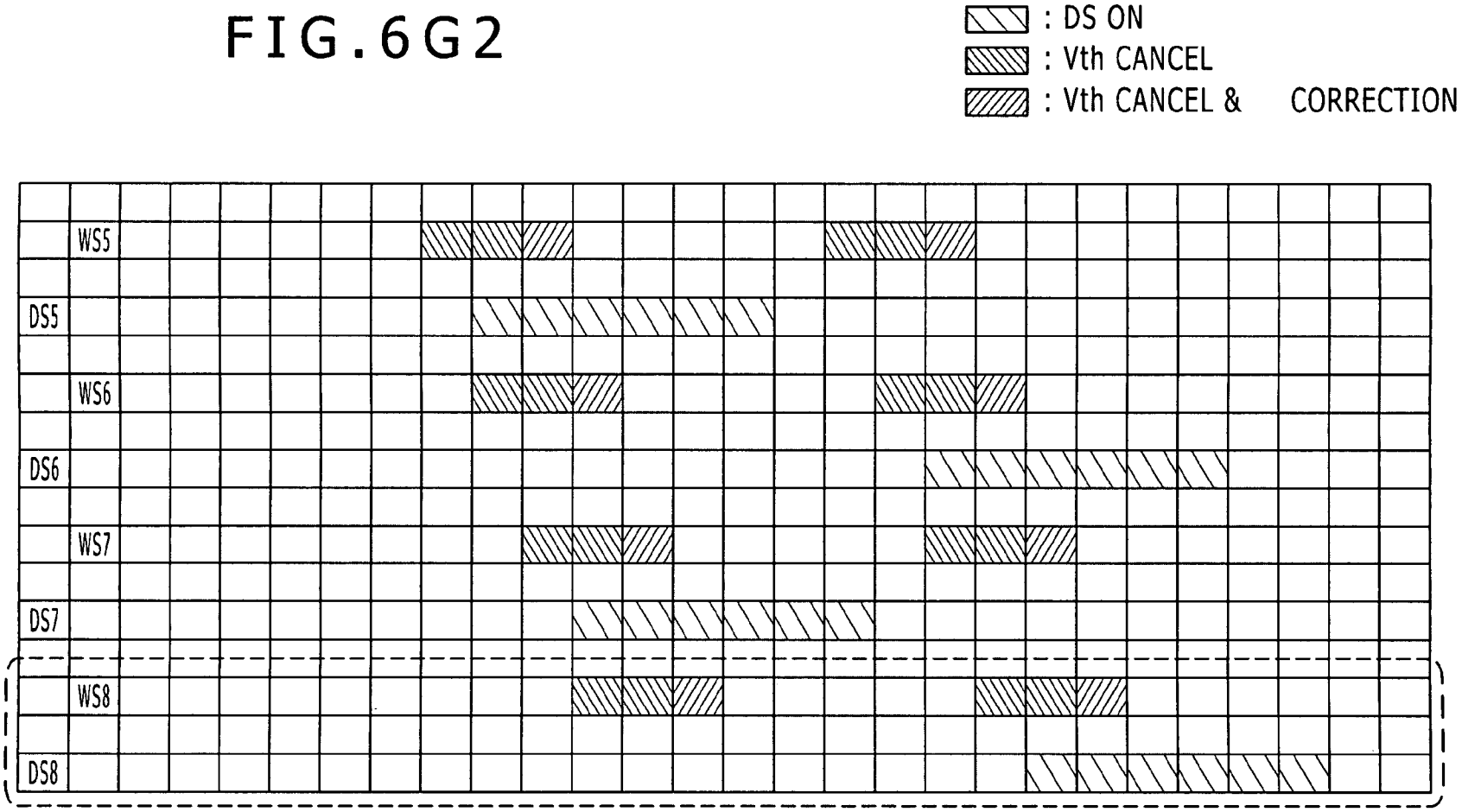

DISPLAY DEVICE, METHOD FOR DRIVING SAME, AND ELECTRONIC APPARATUS

CROSS REFERENCES TO RELATED APPLICATIONS

The present invention contains subject matter related to Japanese Patent Application JP 2007-330803 filed in the Japan Patent Office on Dec. 21, 2007, the entire contents of which being incorporated herein by reference.

BACKGROUND OF THE INVENTION

1. Field of the Invention

The present invention relates to an active-matrix display device including light-emitting elements in its pixels, and a method for driving the same. Furthermore, the present invention relates to an electronic apparatus in which such a display device is incorporated as a display or a monitor.

2. Description of the Related Art

In recent years, development of flat self-luminous display devices including organic EL (electroluminescence) devices as light-emitting elements is being actively promoted. The organic EL device is based on a phenomenon that an organic thin film emits light in response to application of an electric field thereto. The organic EL device can be driven by application voltage of 10 V or lower, and thus has low power consumption. Furthermore, because the organic EL device is a self-luminous element that emits light by itself, it does not need an illuminating unit and thus easily allows reduction in the weight and thickness of a display device. Moreover, the response speed of the organic EL device is as very high as about several microseconds, which causes no image lag in displaying of a moving image.

Among the flat self-luminous display devices including the organic EL devices in the pixels, particularly an active-matrix display device in which thin film transistors are integrally formed as drive elements in the respective pixels is being actively developed. Active-matrix flat self-luminous display devices are disclosed in e.g. Japanese Patent Laid-Open Nos. 2003-255856, 2003-271095, 2004-133240, 2004-029791, and 2004-093682.

SUMMARY OF THE INVENTION

The related-art display devices have a configuration in which a pixel array part and a drive part are integrally formed over one panel. The pixel array part at the center of the panel is formed of an aggregation of pixels arranged in a matrix. The drive part is disposed in the peripheral frame area surrounding the center pixel array part, and drives the pixel array part disposed in the center area from the periphery. The pixel array part includes row first drive lines disposed corresponding to the rows of the pixels, row second drive lines disposed corresponding to the rows of the pixels similarly, and column signal lines disposed corresponding to the columns of the pixels. In matching with this configuration, the drive part includes a horizontal drive circuit that supplies a video signal to the column signal lines, and a first vertical drive circuit and a second vertical drive circuit that cause the light-emission operation of the pixels on a row-by-row basis via the row first drive lines and the row second drive lines, respectively. Based on this configuration, the drive part allows displaying of the image dependent upon the video signal on the pixel array part.

The first vertical drive circuit carries out control for writing the video signal to the respective pixels on a row-by-row basis. The second vertical drive circuit carries out control of the emission-start/emission-stop operation of the pixels on a row-by-row basis. The first vertical drive circuit and the second vertical drive circuit cooperate with each other for the light-emission of the pixels on a row-by-row basis.

As enhancement in the definition and the density of the pixel array part in a display device is progressed, the number of rows of the pixels (the number of lines) is correspondingly increased. The vertical drive circuit is basically composed of shift registers, and sequentially transfers a start pulse input from the external to thereby output a drive signal for each stage. The stages of the shift registers each correspond to a respective one of the rows of the pixels. Increase in the number of rows of the pixels inevitably leads to increase in the number of stages of the shift registers. This causes increases in the degree of complexity and the scale of the vertical drive circuit, which is a problem that should be solved. Because the vertical drive circuit is disposed on a panel, the increase in the scale of the vertical drive circuit requires enlargement of the peripheral frame area surrounding the center pixel array part. This contradicts the trend toward smaller frame size and thus is not preferable.

If the number of rows of the pixels (the number of lines) is increased along with enhancement in the definition and the density of the pixel array part, the number of drive lines for driving the pixels on a row-by-row basis is also correspondingly increased. In linkage with the increase in the density of the drive lines, the size of the interconnect pattern thereof needs to be decreased and the distance between adjacent interconnect patterns also needs to be decreased. This results in a problem that short-circuit defects in the pixel array part frequently occur and therefore the yield is lowered.

It is desirable to provide a display device that is allowed to have a reduced scale of peripheral vertical drive circuitry and a reduced number of drive lines, and a method for driving the same. According to an embodiment of the present invention, there is provided a display device including a pixel array part configured to be formed of an aggregation of pixels arranged in a matrix and include row first drive lines disposed corresponding to rows of the pixels, row second drive lines disposed corresponding to the rows of the pixels, and column signal lines disposed corresponding to columns of the pixels. The display device further includes a drive part configured to drive the pixel array part and include a horizontal drive circuit that supplies a video signal to the column signal lines and a first vertical drive circuit and a second vertical drive circuit that cause light-emission operation of the pixels on a row-by-row basis via the row first drive lines and the row second drive lines, respectively, to thereby allow displaying of an image dependent upon a video signal on the pixel array part. The first vertical drive circuit simultaneously drives the pixels on two rows adjacent to each other. The second vertical drive circuit simultaneously drives the pixels on two rows adjacent to each other. A pair of rows of the pixels simultaneously driven by the first vertical drive circuit and a pair of rows of the pixels simultaneously driven by the second vertical drive circuit are shifted from each other by one row, for light-emission operation of the pixels on a row-by-row basis.

According to the embodiment of the present invention, the first vertical drive circuit simultaneously drives the pixels on two rows adjacent to each other. In other words, each stage of the shift registers included in the first vertical drive circuit corresponds to the pixels on two rows (two lines), and thus the scale of the shift registers can be halved. Similarly, the second vertical drive circuit also simultaneously drives the pixels on two rows adjacent to each other, which allows reduction in the circuit scale thereof. The pair of pixel rows simultaneously driven by the first vertical drive circuit and the pair of pixel rows simultaneously driven by the second vertical drive circuit are shifted from each other by one row (i.e. are so set as to be in a staggered relationship). This allows the light-emission operation of the pixels on a row-by-row basis. That is, it is possible to sequentially-drive the pixel rows while reducing the scale of the peripheral vertical drive circuitry. By thus simplifying the peripheral vertical drive circuitry, the frame size of the panel can be decreased and an effect of reduction in the power consumption can also be achieved.

By employing the operation sequence in which the pixels on two rows adjacent to each other are simultaneously driven, the drive line can be shared by the pixels on two rows adjacent to each other depending on the pixel layout. That is, the number of drive lines can be halved compared with the related arts. This allows achievement of enhancement in the definition of the pixel array part, increase in the pixel capacitance, and reduction in short-circuit defects between interconnects.

BRIEF DESCRIPTION OF THE DRAWINGS

FIG. 3A is a table diagram showing the operation sequence of the display device according to the reference example;

FIG. 3B is a table diagram showing the operation sequence of a display device according to an embodiment of the present invention;

FIGS. 5A to 5G are charts showing the operation sequence of the display device according to the reference example;

FIGS. 6A to 6C are charts showing the operation sequence of the display device according to the embodiment of the present invention;

FIGS. 6D to 6G are charts for explaining the operation of the display device according to the embodiment of the present invention;

DETAILED DESCRIPTION OF THE PREFERRED EMBODIMENTS

Figure 1A:
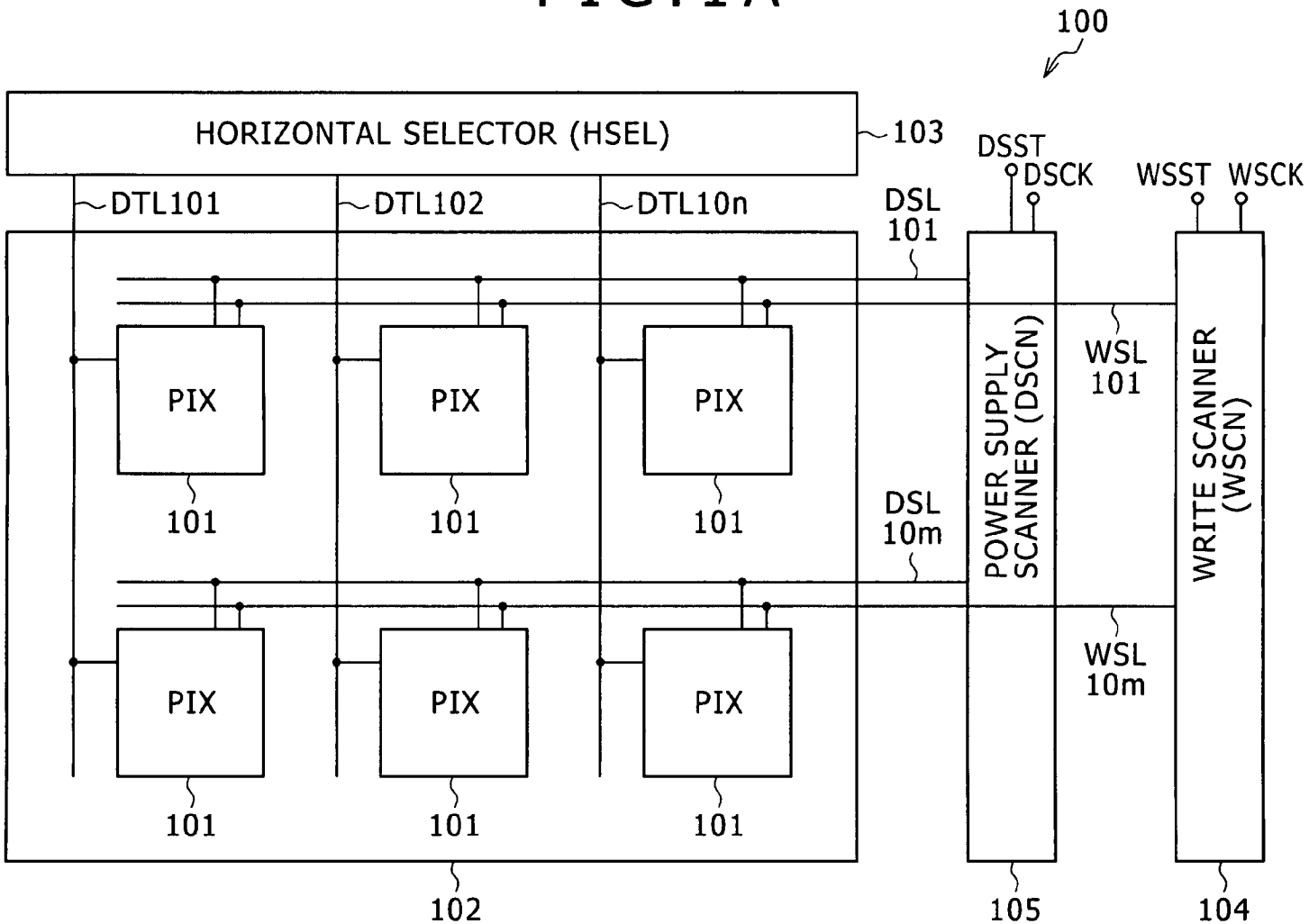
FIG. 1A is a block diagram showing the entire configuration of a display device according to a reference example.

Embodiments of the present invention will be described in detail below with reference to the drawings. Initially, in order to clearly show the background of the present invention and facilitate understanding thereof, the general configuration of an active-matrix display device will be described below as a reference example. FIG. 1A is a block diagram showing the entire configuration of the display device according to the reference example. As shown in FIG. 1A, this display device 100 includes a pixel array part 102 and a drive part (103, 104, 105) for driving the pixel array part 102. The pixel array part 102 includes row scan lines WSL101 to WSL10*m*, column signal lines DTL101 to DTL10*n*, pixels (PIX) 101 disposed near the intersections of both the lines so as to be arranged in a matrix, and power feed lines DSL101 to DSL10*m* disposed corresponding to the respective rows of the pixels 101. The drive part (103, 104, 105) includes a main scanner (write scanner WSCN) 104, a power supply scanner (DSCN) 105, and a signal selector (horizontal selector HSEL) 103. The write scanner 104 sequentially supplies a control signal to the respective scan lines WSL101 to WSL10*m* to thereby line-sequentially scan the pixels 101 on a row-by-row basis. The power supply scanner 105 provides a supply voltage that is switched between a first potential and a second potential to the respective power feed lines DSL101 to DSL10*m* in matching with the line-sequential scanning. The signal selector 103 supplies a signal potential and a reference potential as a video signal to the column signal lines DTL101 to DTL10*n* in matching with the line-sequential scanning.

The write scanner 104 includes shift registers. The shift registers operate in response to a clock signal WSCK supplied from the external and sequentially transfer a start pulse WSST supplied from the external similarly, to thereby generate a shift pulse as the basis of the control signal. The power supply scanner 105 is also formed by using shift registers and sequentially transfers a start pulse DSST supplied from the external in response to a clock signal DSCK supplied from the external, to thereby control the switching of the potentials of the respective power feed lines DSL.

In the present reference example, the write scanner (WSCN) is one of the first vertical drive circuit and the second vertical drive circuit, and the power supply scanner (DSCN) is the other. Furthermore, the scan line WSL is one of the first drive line and the second drive line, and the power feed line DSL is the other. The horizontal selector (HSEL) is equivalent to the horizontal drive circuit. In this manner, the peripheral drive part of the active-matrix display device generally includes one horizontal drive circuit and at least two vertical drive circuits. The peripheral drive part including these drive circuits 103, 104, and 105 is disposed on the same panel as that of the center pixel array part 102.

Figure 1B:
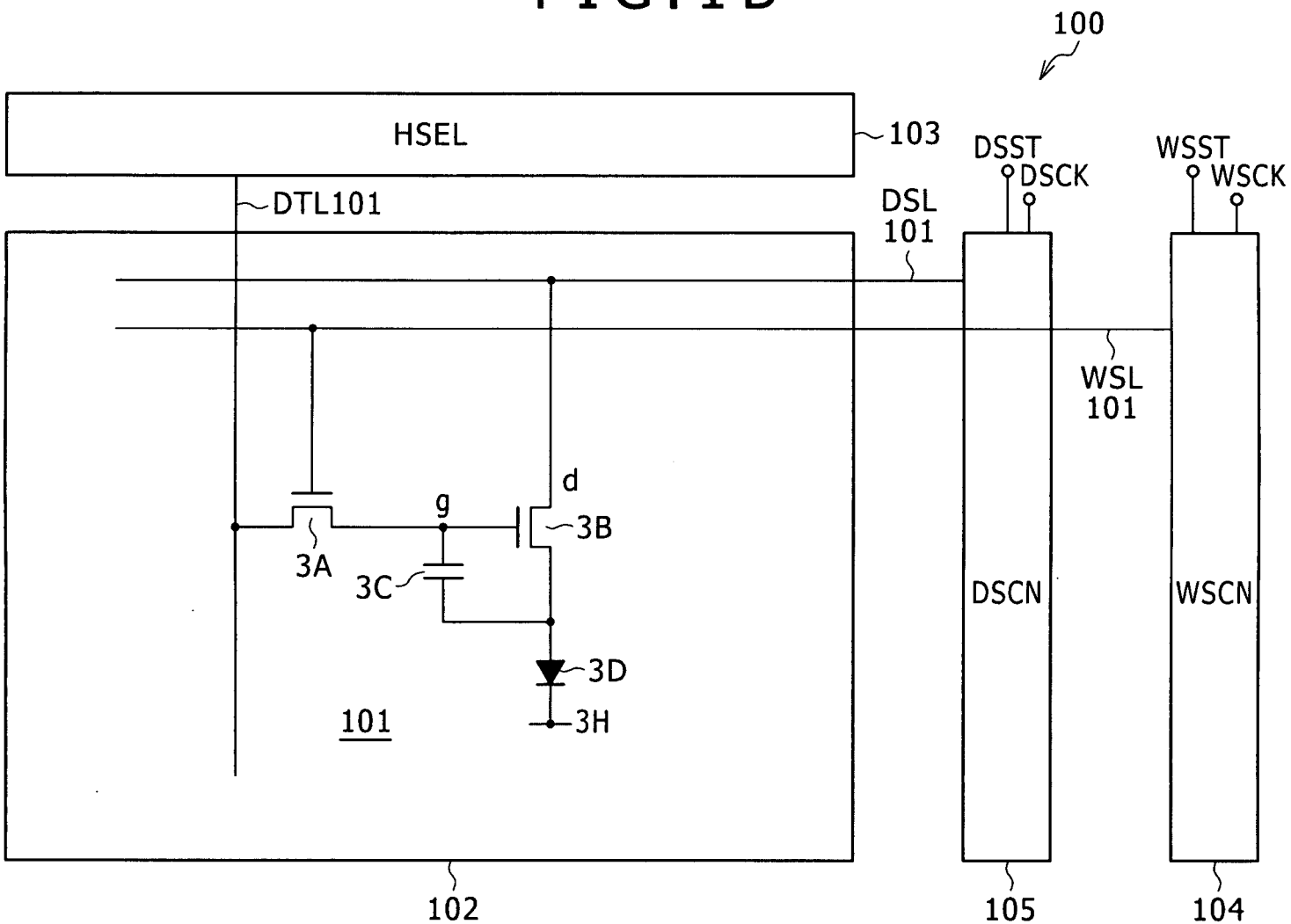
FIG. 1B is a circuit diagram showing the configuration of a pixel included in the display device shown in FIG. 1A.

FIG. 1B is a circuit diagram showing the concrete configuration and the connection relationship of the pixel 101 included in the display device 100 shown in FIG. 1A. As shown in FIG. 1B, this pixel 101 includes a light-emitting element 3D typified by an organic EL device, a sampling transistor 3A, a drive transistor 3B, and a hold capacitor 3C. The gate of the sampling transistor 3A is connected to the corresponding scan line WSL101. One of the source and drain thereof is connected to the corresponding signal line DTL101, and the other is connected to the gate g of the drive transistor 3B. One of the source s and drain d of the drive transistor 3B is connected to the light-emitting element 3D, and the other is connected to the corresponding power feed line DSL101. In the present reference example, the drive transistor 3B is an N-channel transistor, and the drain d thereof is connected to the power feed line DSL101 and the source s thereof is connected to the anode of the light-emitting element 3D. The cathode of the light-emitting element 3D is connected to a ground interconnect 3H. The ground interconnect 3H is disposed in common to all the pixels 101. The hold capacitor 3C is connected between the source s and the gate g of the drive transistor 3B.

In this configuration, the sampling transistor 3A is turned on in response to the control signal supplied from the scan line WSL101, to thereby sample the signal potential supplied from the signal line DTL101 and hold the sampled potential in the hold capacitor 3C. The drive transistor 3B receives current supply from the power feed line DSL101 at the first potential (higher potential) and applies a drive current to the light-emitting element 3D depending on the signal potential held in the hold capacitor 3C. The main scanner (WSCN) 104 outputs the control signal having a predetermined pulse width to the scan line WSL101 so that the sampling transistor 3A may be in the conductive state in the time zone during which the signal line DTL101 is at the signal potential. Thereby, the signal potential is held in the hold capacitor 3C, and simultaneously correction relating to the mobility μ of the drive transistor 3B is added to the signal potential.

The pixel circuit 101 shown in FIG. 1B has a threshold voltage correction function in addition to the mobility correction function. Specifically, the power supply scanner (DSCN) 105 switches the potential of the power feed line DSL101 from the first potential (higher potential) to the second potential (lower potential) at a first timing before the sampling of the signal potential by the sampling transistor 3A. Furthermore, the main scanner (WSCN) 104 turns on the sampling transistor 3A at a second timing before the sampling of the signal potential by the sampling transistor 3A, to thereby apply the reference potential from the signal line DTL101 to the gate g of the drive transistor 3B and set the source of the drive transistor 3B to the second potential. In general, the first timing is previous to the second timing. However, the second timing may be previous to the first timing depending on the case. The power supply scanner (DSCN) 105 switches the potential of the power feed line DSL101 from the second potential to the first potential at a third timing after the second timing, to thereby hold the voltage equivalent to the threshold voltage Vth of the drive transistor 3B in the hold capacitor 3C. This threshold voltage correction function allows the display device 100 to cancel the influence of the threshold voltage of the drive transistor 3B, which involves variation in the threshold voltage from pixel to pixel.

The pixel circuit 101 shown in FIG. 1B further has a bootstrap function. Specifically, at the timing when the signal potential has been held in the hold capacitor 3C, the main scanner (WSCN) 104 turns off the sampling transistor 3A by stopping the application of the control signal to the scan line WSL101, to thereby electrically isolate the gate g of the drive transistor 3B from the signal line DTL101. This causes change in the gate potential (Vg) of the drive transistor 3B to be linked to change in the source potential (Vs) of the drive transistor 3B, and thus allows the voltage Vgs between the gate g and the source s to be kept constant.

Figure 2A:
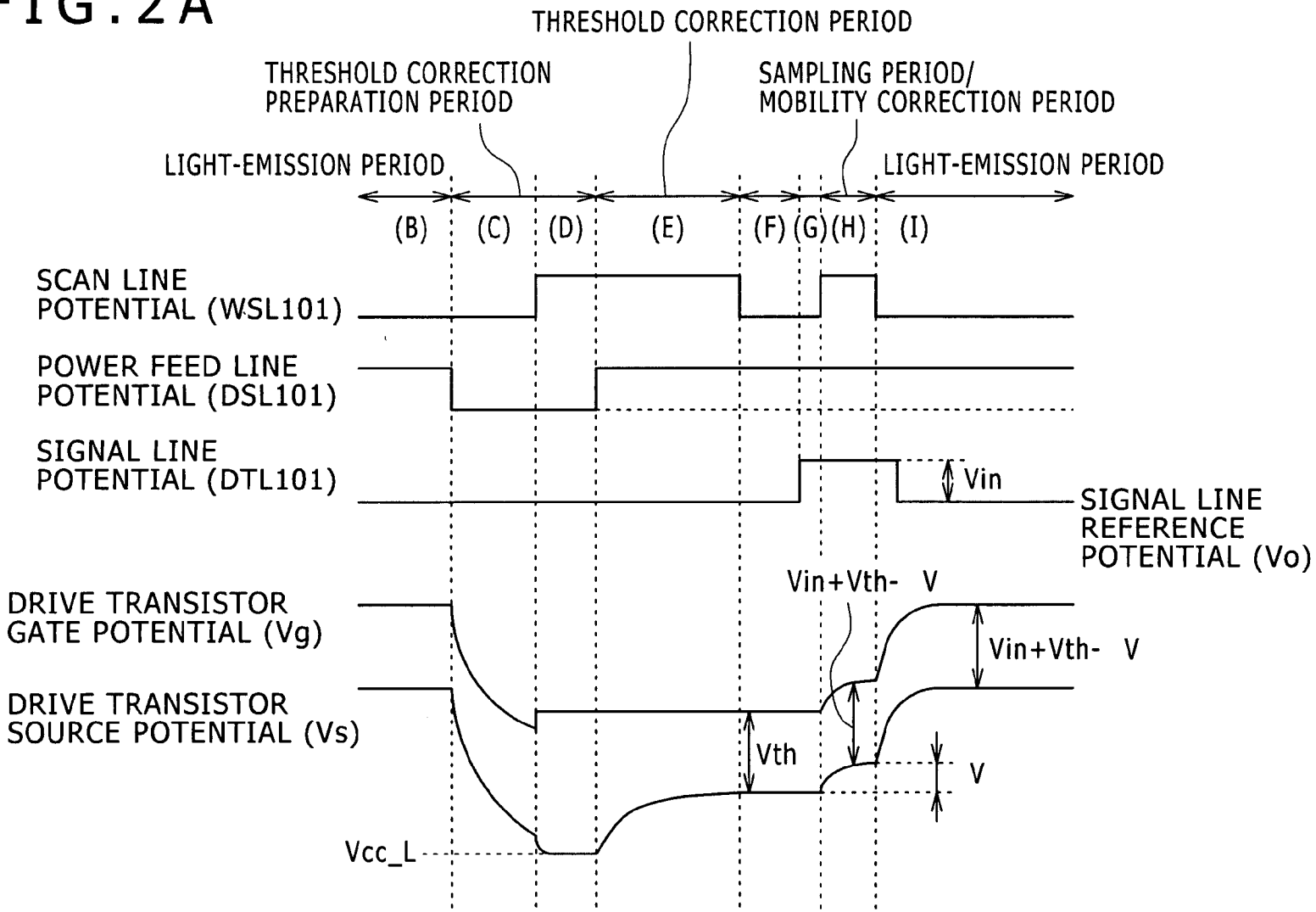
FIG. 2A is a timing chart for explaining the operation of the display device according to the reference example.

FIG. 2A is a timing chart for explaining the operation of the pixel 101 shown in FIG. 1B. In this timing chart, potential changes of the scan line (WSL101), the power feed line (DSL101), and the signal line (DTL101) are shown along the same time axis. Furthermore, in parallel to these potential changes, changes in the gate potential (Vg) and the source potential (Vs) of the drive transistor 3B are also shown.

In this timing chart, the operation period is divided into periods (B) to (I) corresponding to the transition of the operation of the pixel 101 for convenience. In the light-emission period (B), the light-emitting element 3D is in the light-emission state. Thereafter, a new field of the line-sequential scanning starts, and the potential of the power feed line is switched to the lower potential in the first period (C) of the new field. In the next period (D), the gate potential Vg and the source potential Vs of the drive transistor are initialized. By resetting the gate potential Vg and the source potential Vs of the drive transistor 3B in the threshold correction preparation periods (C) and (D), preparation for threshold voltage correction operation is completed. Subsequently, the threshold voltage correction operation is carried out in the threshold correction period (E), so that the voltage equivalent to the threshold voltage Vth is held between the gate g and the source s of the drive transistor 3B. In practice, the voltage equivalent to Vth is written to the hold capacitor 3C connected between the gate g and the source s of the drive transistor 3B.

Thereafter, the operation sequence proceeds to the sampling period/mobility correction period (H) through preparation periods (F) and (G) for mobility correction. In this period, the signal potential Vin of the video signal is written to the hold capacitor 3C in such a manner as to be added to Vth, and the voltage ΔV for the mobility correction is subtracted from the voltage held in the hold capacitor 3C. In this sampling period/mobility correction period (H), in order that the sampling transistor 3A may be kept at the conductive state in the time zone during which the signal line DTL101 is at the signal potential Vin, the control signal having a pulse width shorter than this time zone is output to the scan line WSL101. Thereby, the signal potential Vin is held in the hold capacitor 3C, and simultaneously the correction relating to the mobility μ of the drive transistor 3B is added to the signal potential Vin.

Thereafter, the light-emission period (I) starts, so that the light-emitting element emits light with the luminance dependent upon the signal voltage Vin. In this light emission, the light-emission luminance of the light-emitting element 3D is not affected by variations in the threshold voltage Vth and the mobility μ of the drive transistor 3B because the signal voltage Vin has been adjusted with the voltage equivalent to the threshold voltage Vth and the voltage ΔV for the mobility correction. At the initial stage of the light-emission period (I), bootstrap operation is carried out and thereby the gate potential Vg and the source potential Vs of the drive transistor 3B rise up in such a way that the gate-source voltage Vgs (=Vin+Vth−ΔV) of the drive transistor 3B is kept constant.

Figure 2B:
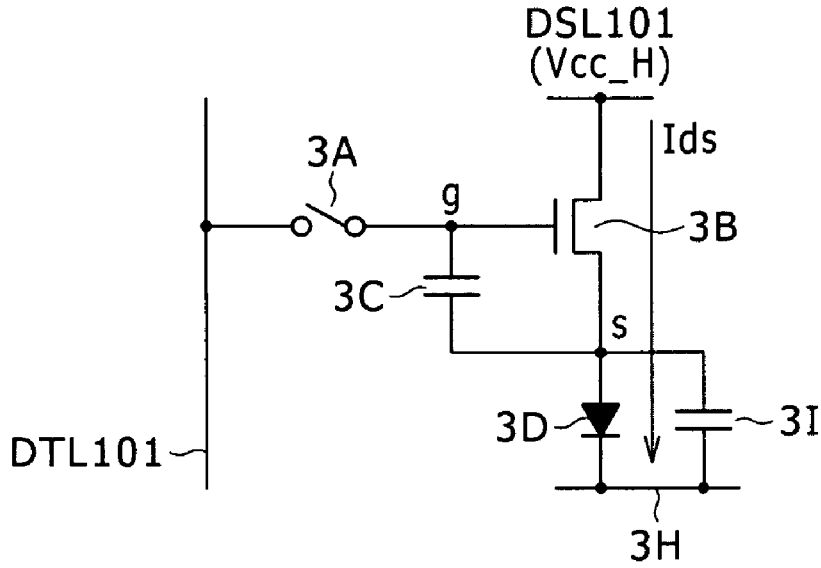
FIGS. 2B to 2I are schematic diagrams for explaining the operation of the display device according to the reference example.

With reference to FIGS. 2B to 2I, the operation of the pixel 101 shown in FIG. 1B will be described in detail below. The alphabets of the figure numbers of FIGS. 2B to 2I correspond to the periods (B) to (I), respectively, in the timing chart of FIG. 2A. To facilitate understanding, the capacitive component of the light-emitting element 3D is represented as a capacitive element 3I in FIGS. 2B to 2I for convenience of description. Referring initially to FIG. 2B, in the light-emission period (B), the power feed line DSL101 is at a higher potential Vcc_H (first potential), and the drive transistor 3B supplies a drive current Ids to the light-emitting element 3D. As shown in FIG. 2B, the drive current Ids flows from the power feed line DSL101 at the higher potential Vcc_H and passes through the light-emitting element 3D via the drive transistor 3B, so as to sink into the common ground interconnect 3H.

Figure 2C:
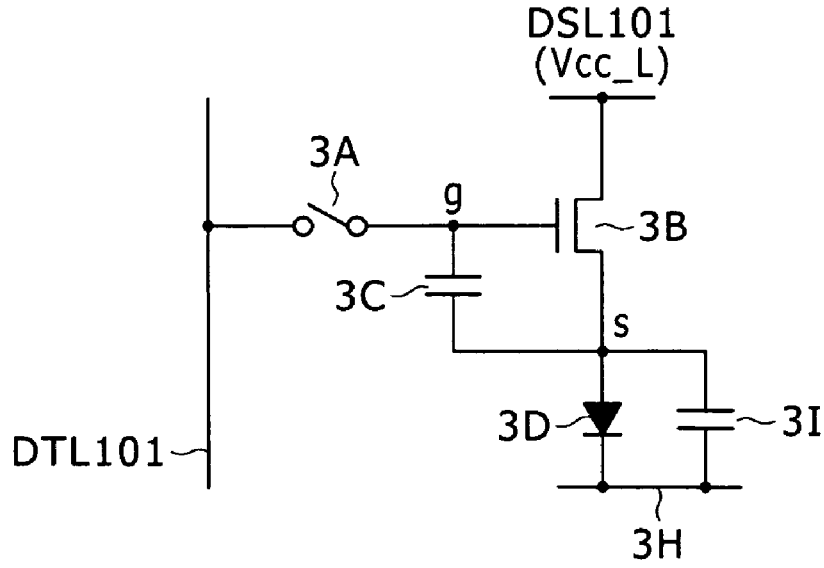

At the start of the subsequent period (C), as shown in FIG. 2C, the potential of the power feed line DSL101 is switched from the higher potential Vcc_H to a lower potential Vcc_L. Due to this operation, the power feed line DSL101 is discharged to Vcc_L, and the source potential Vs of the drive transistor 3B is shifted to a potential close to Vcc_L. If the interconnect capacitance of the power feed line DSL101 is high, it is preferable to switch the potential of the power feed line DSL101 from the higher potential Vcc_H to the lower potential Vcc_L at a comparatively-early timing. By ensuring the sufficiently-long period (C), the influence of the interconnect capacitance and another pixel parasitic capacitance is avoided.

Figure 2D:
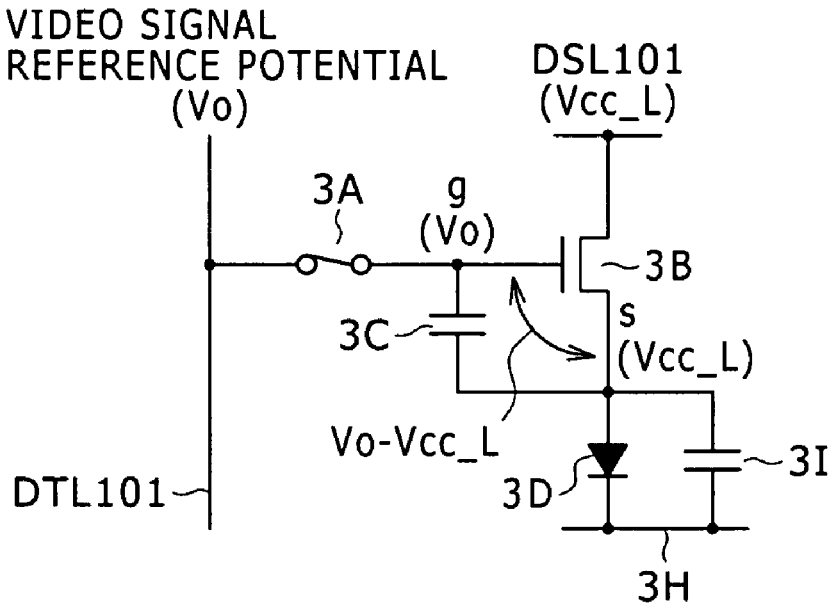

At the start of the next period (D), as shown in FIG. 2D, the scan line WSL101 is switched from the low level to the high level, and thereby the sampling transistor 3A is turned on. At this time, the video signal line DTL101 is at a reference potential Vo. Thus, the gate potential Vg of the drive transistor 3B is changed to the reference potential Vo of the video signal line DTL101 via the turned-on sampling transistor 3A. Simultaneously, the source potential Vs of the drive transistor 3B is immediately fixed to the lower potential Vcc_L. Through the above-described operation, the source potential Vs of the drive transistor 3B is initialized (reset) to the potential Vcc_L sufficiently lower than the reference potential Vo of the video signal line DTL101. Specifically, the lower potential Vcc_L (second potential) of the power feed line DSL101 is so set that the gate-source voltage Vgs of the drive transistor 3B (the difference between the gate potential Vg and the source potential Vs) becomes higher than the threshold voltage Vth of the drive transistor 3B.

Figure 2E:
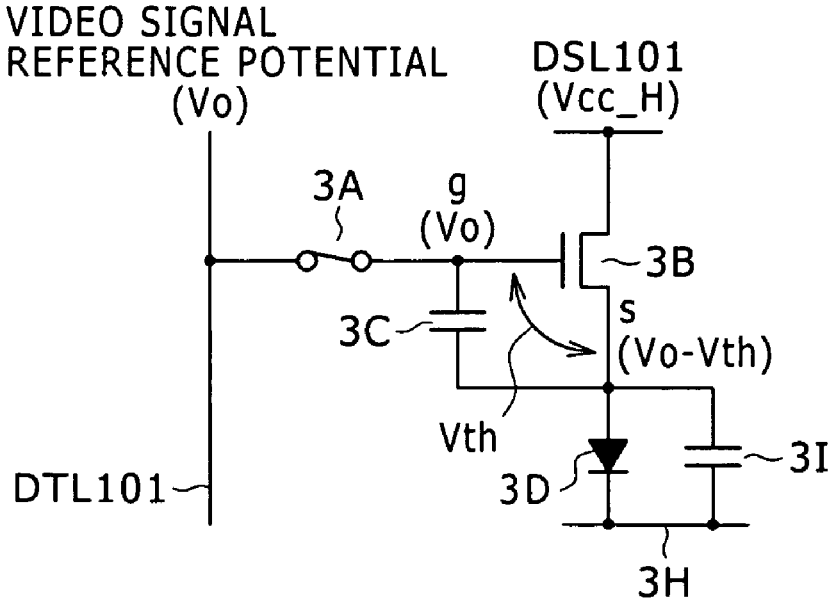

At the start of the subsequent threshold correction period (E), as shown in FIG. 2E, the potential of the power feed line DSL101 is shifted from the lower potential Vcc_L to the higher potential Vcc_H, so that the source potential Vs of the drive transistor 3B starts to rise up. When the gate-source voltage Vgs of the drive transistor 3B reaches the threshold voltage Vth in due course, the current is cut off. In this way, the voltage equivalent to the threshold voltage Vth of the drive transistor 3B is written to the hold capacitor 3C. This is the threshold voltage correction operation. In order that the current may not flow toward the light-emitting element 3D but flow exclusively toward the hold capacitor 3C during the threshold voltage correction operation, the potential of the common ground interconnect 3H is so set that the light-emitting element 3D is cut off during the threshold voltage correction operation.

Figure 2F:
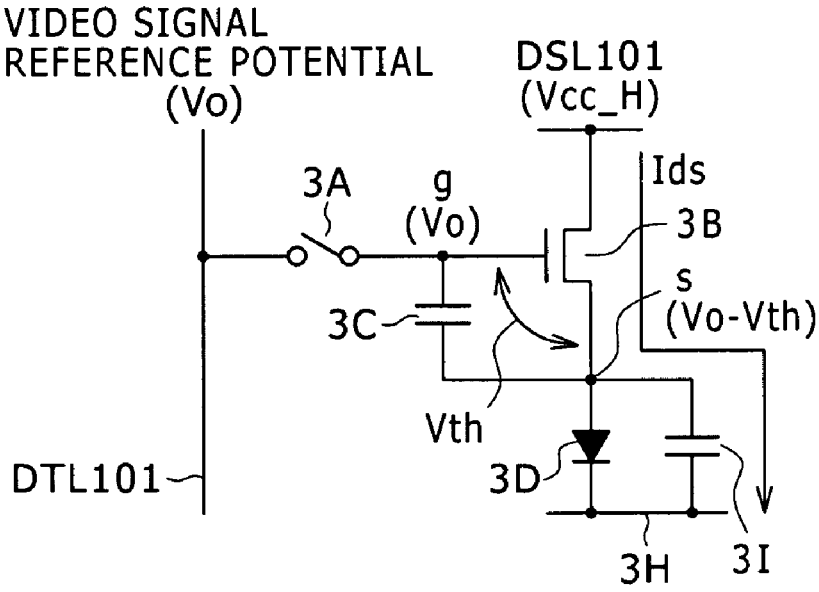

At the start of the period (F), as shown in FIG. 2F, the potential of the scan line WSL101 is shifted to the lower potential, so that the sampling transistor 3A is set to the off-state temporarily. At this time, the gate g of the drive transistor 3B becomes the floating state. However, because the gate-source voltage Vgs is equal to the threshold voltage Vth of the drive transistor 3B, the drive transistor 3B is in the cut-off state and hence the drive current Ids does not flow.

Figure 2G:
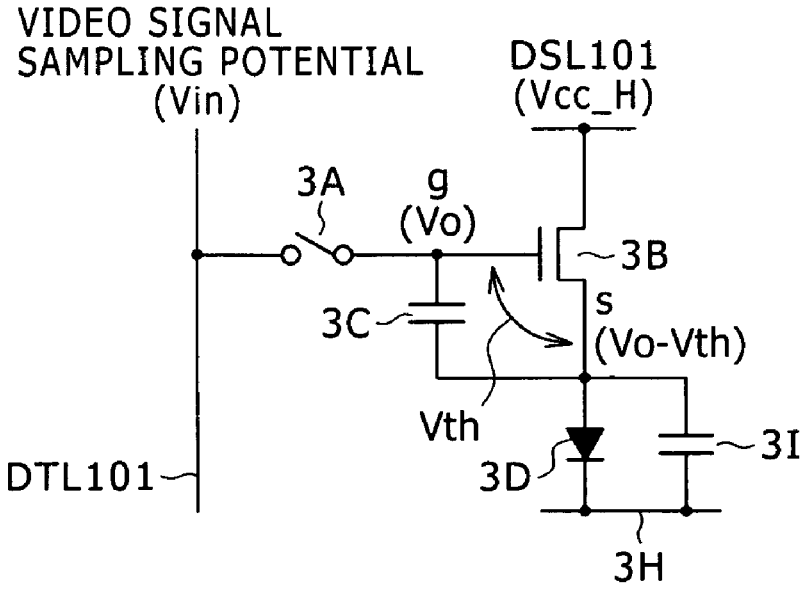

At the start of the subsequent period (G), as shown in FIG. 2G, the potential of the video signal line DTL101 is shifted from the reference potential Vo to the sampling potential (signal potential) Vin. By this operation, preparation for the subsequent sampling operation and mobility correction operation is completed.

Figure 2H:
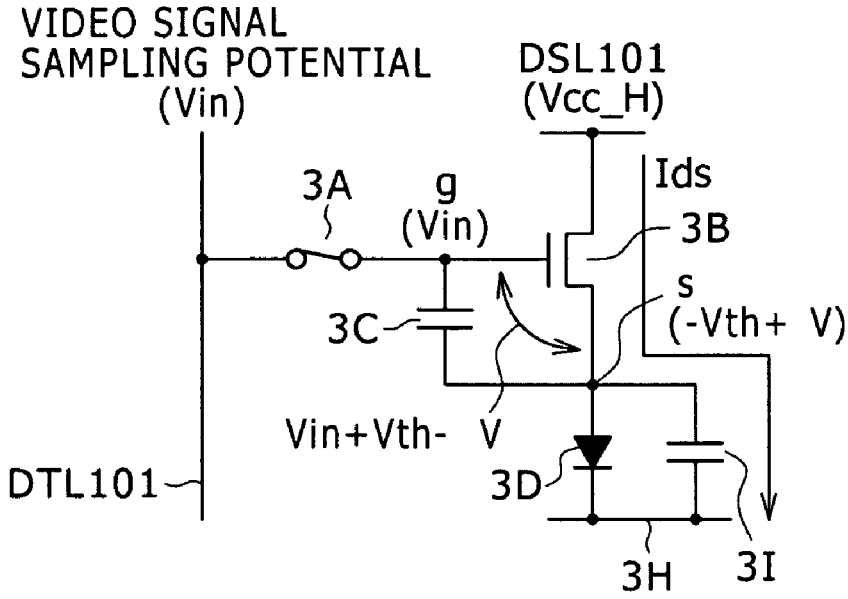

At the start of the sampling period/mobility correction period (H), as shown in FIG. 2H, the potential of the scan line WSL101 is shifted to the higher potential and thereby the sampling transistor 3A enters the on-state. Therefore, the gate potential Vg of the drive transistor 3B becomes the signal potential Vin. In the period (H), the light-emitting element 3D is in the cut-off state (high-impedance state), and thus the drain-source current Ids from the drive transistor 3B flows into the capacitor 3I of the light-emitting element, so that charging thereof is started. Therefore, the source potential Vs of the drive transistor 3B starts to rise up, and the gate-source voltage Vgs of the drive transistor 3B becomes Vin+Vth−ΔV in due course. In this manner, the sampling of the signal potential Vin and the adjustment with the correction amount ΔV are simultaneously carried out. The higher Vin is, the larger Ids and hence the absolute value of ΔV are. Consequently, the mobility correction dependent upon the light-emission luminance level is carried out. If Vin is constant, higher mobility μ of the drive transistor 3B provides a larger absolute value of ΔV. In other words, higher mobility μ provides a larger negative feedback amount ΔV, and thus variation in the mobility μ from pixel to pixel can be removed.

Figure 2I:
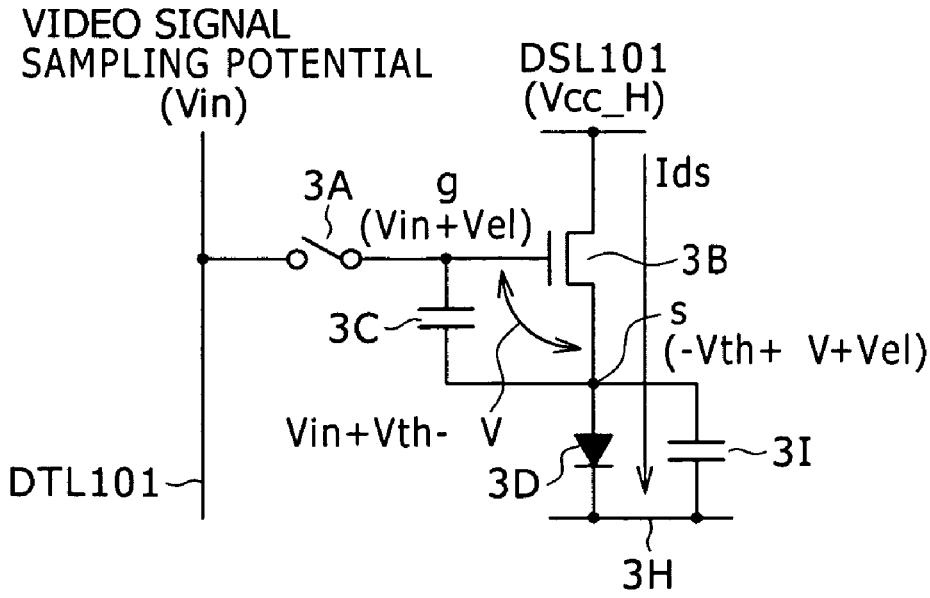

Finally, at the start of the light-emission period (I), as shown in FIG. 2I, the potential of the scan line WSL101 is shifted to the lower potential and thereby the sampling transistor 3A enters the off-state. This isolates the gate g of the drive transistor 3B from the signal line DTL101. Simultaneously, the drain current Ids starts to flow through the light-emitting element 3D. This causes the anode potential of the light-emitting element 3D to rise up by Vel depending on the drive current Ids. The rise of the anode potential of the light-emitting element 3D is equivalent to the rise of the source potential Vs of the drive transistor 3B. In linkage with the rise of the source potential Vs of the drive transistor 3B, the gate potential Vg of the drive transistor 3B also rises up based on the bootstrap operation due to the hold capacitor 3C. The rise amount Vel of the gate potential Vg is equal to the rise amount Vel of the source potential Vs. Therefore, during the light-emission period, the gate-source voltage Vgs of the drive transistor 3B is kept constant at Vin+Vth−ΔV.

FIG. 3A is a table diagram schematically showing the line-sequential scanning of the display device according to above-described reference example. For easy understanding, the configuration of the display device is simply shown in this diagram: the number of rows of the pixels (the number of lines) in the pixel array part is 16 in this diagram. The write scanner (WSCN) is defined as the first vertical drive circuit, and the respective output stages thereof are represented by WS(1) to WS(16). The power supply scanner (DSCN) is defined as the second vertical drive circuit, and the respective output stages thereof are represented by DS(1) to DS(16).

As shown in FIG. 3A, a pixel row of one line corresponds to one stage of each vertical drive circuit. For example, the pixel row of the first line is driven by the first output stage WS(1) of the first vertical drive circuit and the first output stage DS(1) of the second vertical drive circuit so as to carry out light-emission operation. Because the pixels on one row include pixels of RGB three primary colors, the pixels on one row are represented by the repletion of a group of R1, G1, and B1 in the diagram. Upon the progression of the line-sequential scanning by one horizontal period (1H), the pixel row of the second line is driven by the second output stage WS(2) of the first vertical drive circuit and the second output stage DS(2) of the second vertical drive circuit. In this manner, the display device according to the reference example line-sequentially drives the respective lines of the pixels on a 1H-by-1H basis. Therefore, the number of output stages of each vertical drive circuit is equal to the number of lines of the pixels. If the number of lines of the pixels is increased, the number of output stages of the vertical drive circuits is also increased and therefore the scale of the peripheral drive circuitry is forced to be enlarged, which is a problem that should be solved. The display device according to the reference example is based on a system in which the periods during which the respective output stages of the vertical drive circuit are in the active state are shifted from each other by every 1H, and one output stage of the vertical drive circuit is used for driving of the pixels of only one line.

FIG. 3B is a table diagram showing the basic principle of the display device according to the embodiment of the present invention. For FIG. 3B, the same representation manner as that of the table diagram of FIG. 3A relating to the reference example is employed, for easy understanding. As is apparent from this table diagram, the pixel array part includes pixel rows of 16 lines. On the other hand, the first vertical drive circuit has eight output stages: the number of output stages is half the number of lines of the pixels. The first output stage WS(1) of the first vertical drive circuit simultaneously drives the pixel rows of the first line and the second line. Similarly, the second output stage WS(2) simultaneously drives the pixel rows of the third line and the fourth line. Similar simultaneous driving is sequentially carried out, and finally the eighth output stage WS(8) simultaneously drives the pixel rows of the fifteenth line and the sixteenth line.

The second vertical drive circuit has nine output stages DS(0) to DS(8): the number of output stages thereof is substantially half the number of lines of the pixels. Except for the first output stage DS(0) and the last output stage DS(8), each output stage simultaneously drives pixel rows of two lines. For example, the output stage DS(1) simultaneously drives the pixel rows of the second line and the third line. The next output stage DS(2) simultaneously drives the pixel rows of the fourth line and the fifth line.

The pair of pixel rows simultaneously driven by the first vertical drive circuit and the pair of pixel rows simultaneously driven by the second vertical drive circuit are shifted from each other by one row, so as to be in a staggered relationship. This staggered relationship allows the light-emission operation of the pixels on a row-by-row basis as with the reference example. The output of the first vertical drive circuit and the output of the second vertical drive circuit are staggered from each other, which makes it possible to use one output as outputs for two lines. For example, the pixel row of the second line is caused to carry out light-emission operation by the output stage WS(1) of the first vertical drive circuit and the output stage DS(1) of the second vertical drive circuit. The light-emission operation of the pixel row of the third line is caused by WS(2) and DS(1). The light-emission operation of the pixel row of the fourth line is caused by the combination of the output stage WS(2) and the output stage DS(2). In this manner, each line is driven by a respective one of different combinations of WS(i) and DS(j) necessarily, and therefore sequential driving on a line-by-line basis is allowed as with the reference example although the number of output stages is halved.

However, in practical operation sequence, the line-sequential scanning needs to be repeated twice, i.e. carried out in the former field and the latter field, for displaying an image of one frame. In the former field, the output stages of the first vertical drive circuit are sequentially driven from WS(1) to WS(8) for example. In contrast, for the second vertical drive circuit, only e.g. the odd-numbered output stages DS(1), DS(3), DS(5), and DS(7) are selectively driven. Thus, in the former field, the light-emission operation of the pixel rows of the following lines can be carried out, namely, second line, third line, sixth line, seventh line, tenth line, eleventh line, fourteenth line, and fifteenth line. In the subsequent latter field, the output stages WS(1) to WS(8) are sequentially driven as with in the former field. On the other hand, for the second vertical drive circuit, only the even-numbered output stages DS(0), DS(2), DS(4), DS(6), and DS(8) are driven. This allows the light-emission operation of the pixel rows of the following lines, which did not carry out the light-emission operation in the former field, namely, first line, fourth line, fifth line, eighth line, ninth line, twelfth line, thirteenth line, and sixteenth line. By the combination of the former field and the latter field, the line-sequential light-emission operation of all the lines is completed, so that an image of one frame is displayed on the pixel array part.

Figure 4A:
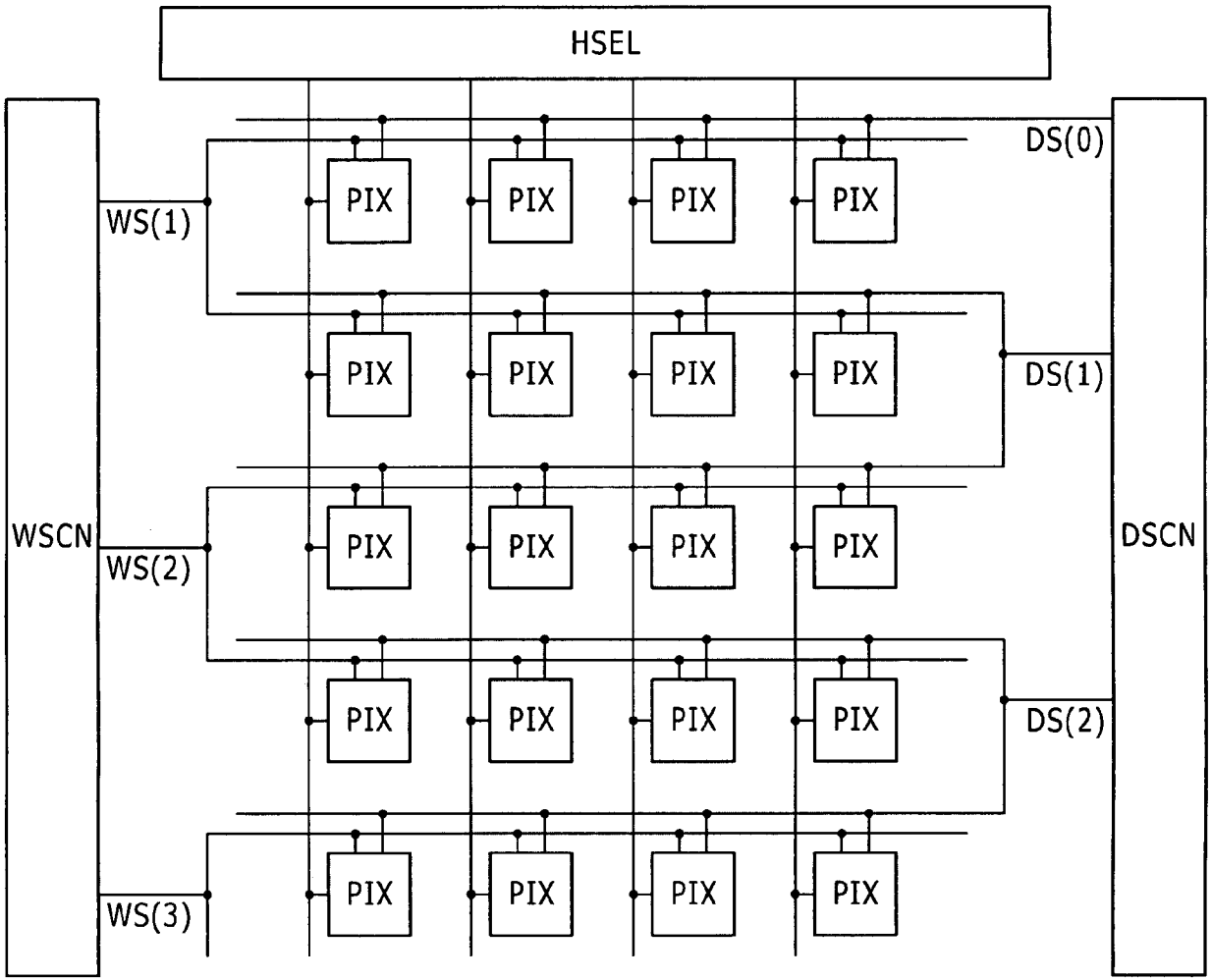
FIG. 4A is a block diagram showing a display device according to a first embodiment of the present invention.

FIG. 4A is a block diagram schematically showing a display device according to a first embodiment of the present invention. As shown in FIG. 4A, this display device includes a pixel array part formed of an aggregation of pixels PIX arranged in a matrix and a drive part for driving this pixel array part. Each pixel PIX has e.g. the circuit configuration shown in FIG. 1B. However, the embodiment of the present invention is not limited thereto but the pixel circuit configuration can be changed according to the case.

The pixel array part includes row first drive lines disposed corresponding to the rows of the pixels PIX, row second drive lines disposed corresponding to the rows of the pixels PIX similarly, and column signal lines disposed corresponding to the columns of the pixels. The drive part includes a horizontal drive circuit HSEL that supplies a video signal to the column signal lines, and a first vertical drive circuit WSCN and a second vertical drive circuit DSCN that cause the light-emission operation of the pixels PIX on a row-by-row basis via the row first drive lines and the row second drive lines, respectively. Based on this configuration, the drive part allows displaying of the image dependent upon the video signal on the pixel array part.

As a feature of the present embodiment, the first vertical drive circuit WSCN includes output stages WS(i) whose number is half that of output stages in the reference example, and simultaneously drives the pixels PIX on two rows adjacent to each other. Similarly, the second vertical drive circuit DSCN also includes output stages DS(j) whose number is half that of output stages in the reference example, and simultaneously drives the pixels on two rows adjacent to each other. The pair of pixel rows simultaneously driven by the first vertical drive circuit WSCN and the pair of pixel rows simultaneously driven by the second vertical drive circuit DSCN are shifted from each other by one row so as to be in a staggered relationship. This allows the light-emission operation of the pixels PIX on a row-by-row basis.

In the concrete operation sequence, the drive part divides the pixels of one frame into those driven in the former field and those driven in the latter field, for image displaying on the pixel array part. In the former field, the first vertical drive circuit WSCN sequentially drives pairs of rows of the pixels PIX, whereas the second vertical drive circuit DSCN selectively drives every other pair of rows of the pixels PIX. This causes the light-emission operation of the pixels on one row of each of the pairs of rows of the pixels driven by the first vertical drive circuit WSCN. In the latter field, the first vertical drive circuit WSCN sequentially drives the pairs of rows of the pixels PIX again, whereas the second vertical drive circuit DSCN selectively drives the pairs of rows of the pixels that were not driven in the former field, of all the pairs of rows of the pixels PIX. This causes the light-emission operation of the pixels on the other row of each of the pairs of rows of the pixels driven by the first vertical drive circuit WSCN.

The pixel PIX includes the sampling transistor 3A, the drive transistor 3B, the hold capacitor 3C, and the light-emitting element 3D as shown in FIG. 1B. The control terminal of the sampling transistor 3A is connected to the scan line WSL101 as one of the first drive line and the second drive line, and the pair of current terminals thereof are connected between the signal line DTL101 and the control terminal of the drive transistor 3B. One of the pair of current terminals of the drive transistor 3B is connected to the light-emitting element 3D, and the other is connected to the power feed line DSL101 as the other of the first drive line and the second drive line. The hold capacitor 3C is connected between the control terminal and the current terminal of the drive transistor 3B.

In the pixel PIX with this configuration, the sampling transistor 3A is turned on in response to a drive signal supplied from the scan line WSL101 to thereby sample a video signal from the signal line DTL101 and write it to the hold capacitor 3C. In addition, the drive transistor 3B operates in response to a drive signal supplied from the power feed line DSL101 to thereby supply the drive current dependent upon the video signal written to the hold capacitor 3C to the light-emitting element 3D.

At a timing before the writing of the video signal to the hold capacitor 3C, the pixel PIX carries out correction operation in response to the drive signals supplied from the scan line WSL101 and the power feed line DSL101, to thereby add a correction amount for cancelling variation in the threshold voltage Vth of the drive transistor 3B to the voltage held in the hold capacitor 3C. In addition, at the time of the writing of the video signal to the hold capacitor 3C, the pixel PIX subtracts a correction amount for cancelling variation in the mobility μ of the drive transistor 3B from the voltage held in the hold capacitor 3C.

Figure 4B:
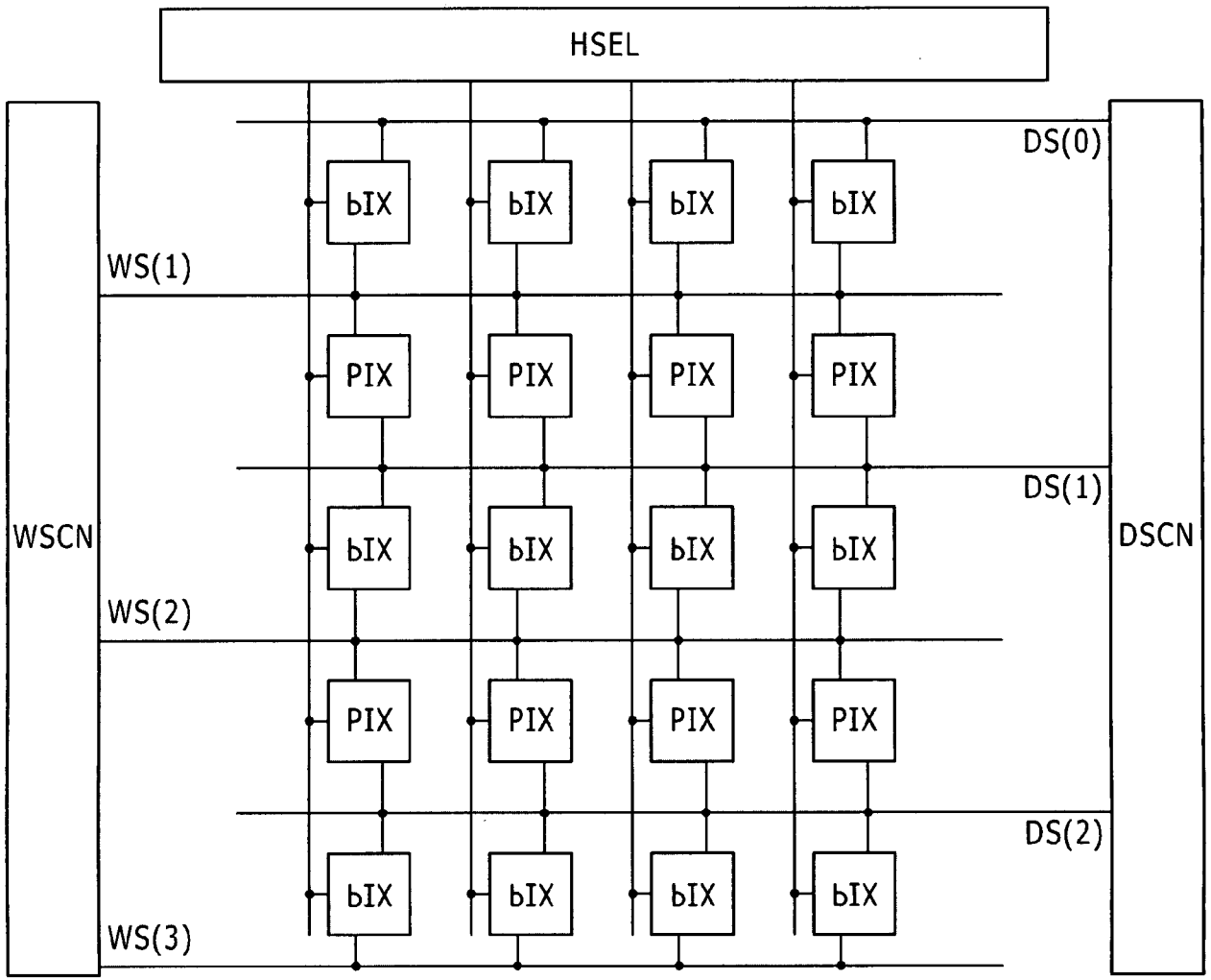
FIG. 4B is a block diagram showing a display device according to a second embodiment of the present invention.

FIG. 4B is a block diagram showing a display device according to a second embodiment of the present invention. For easy understanding, the part corresponding to that in the first embodiment shown in FIG. 4A is given the same reference symbol. A difference from the first embodiment is that the layouts of the individual pixels PIX are mirror-inverted on adjacent rows so as to be symmetrically arranged. As shown in FIG. 4B, the layouts inside the pixels on rows adjacent to each other are vertically inverted from each other. This is represented by schematically inverting the reference symbols PIX in FIG. 4B. This configuration makes it possible that the first drive line extending from the output stage WS(i) of the first vertical drive circuit WSCN toward the pixel array part is shared by the corresponding pair of pixel rows. Thus, the number of first drive lines can be halved compared with the reference example. Similarly, the second drive line extending from the output stage DS(j) of the second vertical drive circuit DSCN toward the pixel array part is shared by the corresponding pair of pixel rows, and thus the number of second drive lines can be halved compared with the reference example. In this manner, the present embodiment allows simplification of the interconnect layout in the pixel array part, and is sufficiently compatible with enhancement in the definition and the density of the pixel array part. The simplification of the interconnect layout suppresses short-circuit defects, which can improve the yield.

FIG. 5A is a chart showing the operation sequence for one frame in the display device according to the reference example, shown in FIGS. 1A and 3A. As described above, the display device according to the reference example sequentially drives the pixels of 16 lines for displaying of an image of one frame. According to the shown chart, one-frame period is interposed between blanking periods BR equivalent to four horizontal periods (4H) and the subsequent blanking periods BR equivalent to four horizontal periods (4H). This one-frame period is composed of 16 horizontal periods (16H). In the one-frame period, video signals (DATA) 1 to 16 are written to the pixel rows of the respective lines.

For the first line, the pixel row of the first line is driven by the first output stage WS1 of the first vertical drive circuit and the first output stage DS1 of the second vertical drive circuit. Vth cancel operation (threshold voltage correction operation) is carried out by the output stage WS1. In the present example, the Vth cancel operation is repeated three times in a time-division manner over three horizontal periods (3H). The voltage Vth is not necessarily written across the hold capacitor by one time of the Vth cancel operation. In particular, if one horizontal period (1H) is short, it is difficult to complete the threshold voltage correction operation through only one time of the Vth cancel operation. Therefore, the Vth cancel operation is repeated three times over 3H in the present example. In the third round of the Vth cancel operation, video signal writing operation and correction operation relating to the mobility μ are also simultaneously carried out. According to the chart, DATA1 is written to the pixel row of the first line in the first horizontal period of the frame period. The emission-start/emission-stop of the pixel row of the first line is controlled by the output stage DS1. According to the shown chart, DS1 is in the on-state and thus the corresponding pixels emit light during the period from the start of the blanking period immediately before the start of the field period to the end of the fifth horizontal period.

Upon the elapse of 1H, WS2 and DS2 enter the active state, so that the series of operation necessary for light emission (light-emission operation) including the Vth cancel time-division operation, the signal writing operation, the mobility correction operation, and the emission-start operation of the light-emitting element is carried out for the pixel row of the second line. Upon the further progression of the phase of the operation sequence by 1H, WS3 and DS3 enter the active state, so that the light-emission operation of the pixel row of the third line is carried out. The line-sequential scanning is carried out in turn in this manner. Upon the switching of the last output stages WS16 and DS16 to the active state, the light-emission operation of the pixel row of the sixteenth line is carried out, so that the one-frame period is completed. Thereafter, the line-sequential scanning returns to the first line and the next frame period starts.

FIG. 5B is a chart shown with focus on the operation of the first line particularly in the operation sequence for one frame, shown in FIG. 5A. The operation sequence of the first line, which is of interest, is surrounded by a dashed line. Upon the switching of WS1 to the active state, the pixels of the first line carry out the Vth cancel operation three times in a time-division manner. In the horizontal period for the third round of the Vth cancel operation, the signal writing operation is also carried out together with this last Vth cancel operation. This allows the writing of the video signal DATA1 assigned to the first line. At this time, the mobility correction for the drive transistor is also carried out simultaneously. The output of DS1 is also switched to the active state in matching with the output of WS1. Due to the switching of DS1 to the active state, the Vth cancel operation and the signal writing operation are normally carried out and the pixels enter the light-emission state. DS1 enters the inactive state after the elapse of the predetermined light-emission period, so that the pixels stop the light emission. By thus controlling the period during which the pixels emit light by DS1, the luminance of the screen can be controlled. Specifically, by setting the active period of DS1 longer, the ratio of the light-emission period to the one-frame period (duty) can be increased and thereby the screen luminance is enhanced.

FIG. 5C is a chart showing the switching of the pixels of the second line to the operating state. As shown in the diagram, WS2 and DS2 are in the active state.

FIG. 5D shows the operation state of the pixels of the third line. This diagram shows that the pixels of the third line carry out the series of operation due to the switching of WS3 and DS3 to the active state.

FIG. 5E is a chart showing the operation state of the pixel row of the third last line (i.e. the fourteenth line). As shown in the diagram, WS14 and DS14 enter the active state, so that the pixel row of the fourteenth line operates.

FIG. 5F shows the operation state of the pixels of the second last line. WS15 and DS15 enter the active state.

FIG. 5G shows the operation state of the pixels of the last line. WS16 and DS16 enter the active state, so that the pixels of the sixteenth line emit light. This is equivalent to the completion of the line-sequential scanning for one frame, followed by the start of the next frame.

FIG. 6A is a chart showing the operation sequence for one frame in the display device according to the embodiment of the present invention, shown in FIGS. 3B and 4A. For FIG. 6A, the same representation manner as that of the chart of FIG. 5A relating to the reference example is employed, for easy understanding. As shown in FIG. 6A, in the operation sequence according to the embodiment, a one-frame period is interposed between the previous and subsequent blanking periods, and an image of one frame is displayed in the one-frame period. The one-frame period is divided into the former field and the latter field, in each of which the sequential scanning is carried out. The combination of both the fields allows the displaying for one frame.

In the former field, the output stages WS1 to WS8 of the first vertical drive circuit sequentially enter the active state, whereas every other output stage DS1, DS3, DS5, and DS7 of the second vertical drive circuit enter the active state.

Also in the latter field, the output stages WS1 to WS8 of the first vertical drive circuit sequentially enter the active state. On the other hand, for the second vertical drive circuit, the even-numbered output stages DS0, DS2, DS4, DS6, and DS8 enter the active state differently from the former field.

FIG. 6B shows the operation state of the pixels of the second line, which is the first operation-target line. In the former field, WS1 and DS1 enter the active state, so that the time-division Vth cancel operation, the signal writing operation, the mobility correction operation, and the emission-start operation are carried out on the pixel row of the second line as the first operation-target line. In the latter field, WS1 enters the active state, whereas DS1 is kept at the inactive state. Therefore, the pixel row of the first operation-target line will not carry out the light-emission operation in the latter field. Consequently, in the operation sequence according to the embodiment, the ratio of the light-emission period to the one-frame period (duty) is at most 50%. Specifically, even when the whole of one of the former field and the latter field is used as the light-emission period, the whole of the other is the non-light-emission period, and hence the duty is at most 50%.

FIG. 6C is a chart showing the operation state of the pixels on the next row. As shown in FIG. 6C, upon the progression of the phase of the operation sequence by one horizontal period (1H) from the start of the active state of WS1, the output stage WS2 enters the active state. DS1 is kept at the active-state. Due to the switching of DS1 and WS2 to the active state, the series of operation of the pixels of the third line is carried out and the light-emitting elements emit light. The output of DS1 is shared by the second line and the third line. On the other hand, the phases of the outputs of WS1 and WS2 are shifted from each other by 1H. Therefore, the phase relationship between the outputs of WS1 and DS1 for the second line is different from that between the outputs of DS1 and WS2 for the third line. The phase relationship between WS1 and DS1 for the second line is similar to that in the reference example, and thus the time-division Vth cancel operation, the signal writing operation, and the light-emission operation can be carried out without any problem. On the other hand, for the third line, the output phase of WS2 is backward shifted by 1H with respect to the output phase of DS1. This shifted period is equivalent to the initial part of the period of the time-division Vth cancel driving, and therefore the first round of the time-division driving may not be sufficiently carried out depending on the case. To address this problem, in the embodiment of the present invention, the Vth cancel operation is repeated plural times in consideration of this phase difference. It is sufficient that the threshold voltage correction operation can be normally completed as a whole through the repetition of plural times of the operation, even if one time of the Vth cancel operation is insufficient. Therefore, no problem arises on the operation although the phase of the output stage WS of the first vertical drive circuit is shifted by 1H from the phase of the output stage DS of the second vertical drive circuit. To put it the other way around, by employing the operation sequence that permits the phase shift of 1H between DS and WS, the drive system according to the embodiment of the present invention can be implemented without any problem.

FIG. 6D is a chart showing the operation sequence of the pixels of the sixth line. Upon the progression of the phase by 1H from the start of the active state of WS2, the output stage WS3 enters the active state and thereafter the output stage DS3 also enters the active state, so that the pixels of the sixth line carry out the light-emission operation.

FIG. 6E is a chart showing the operation state of the pixels of the third last operation-target line. Due to the switching of WS6 and DS6 to the active state in the latter field, the pixels of the twelfth line carry out the light-emission operation.

FIG. 6F is a chart showing the operation state of the pixels of the second last operation-target line. Upon the progression of the phase by 1H from the start of the active state of WS6, the output stage WS7 enters the active state, with DS6 kept at the active state continuously. This causes the light-emission operation of the pixels of the thirteenth line.

FIG. 6G shows the state after the progression of the phase of the operation sequence by 1H from the start of the active state of WS7. Due to the switching of WS8 and DS8 to the active state, the pixels of the sixteenth line, which is the last operation-target line, carry out the light-emission operation. This is equivalent to the completion of the one-frame period, followed by the start of the next frame period.

Figure 7A:
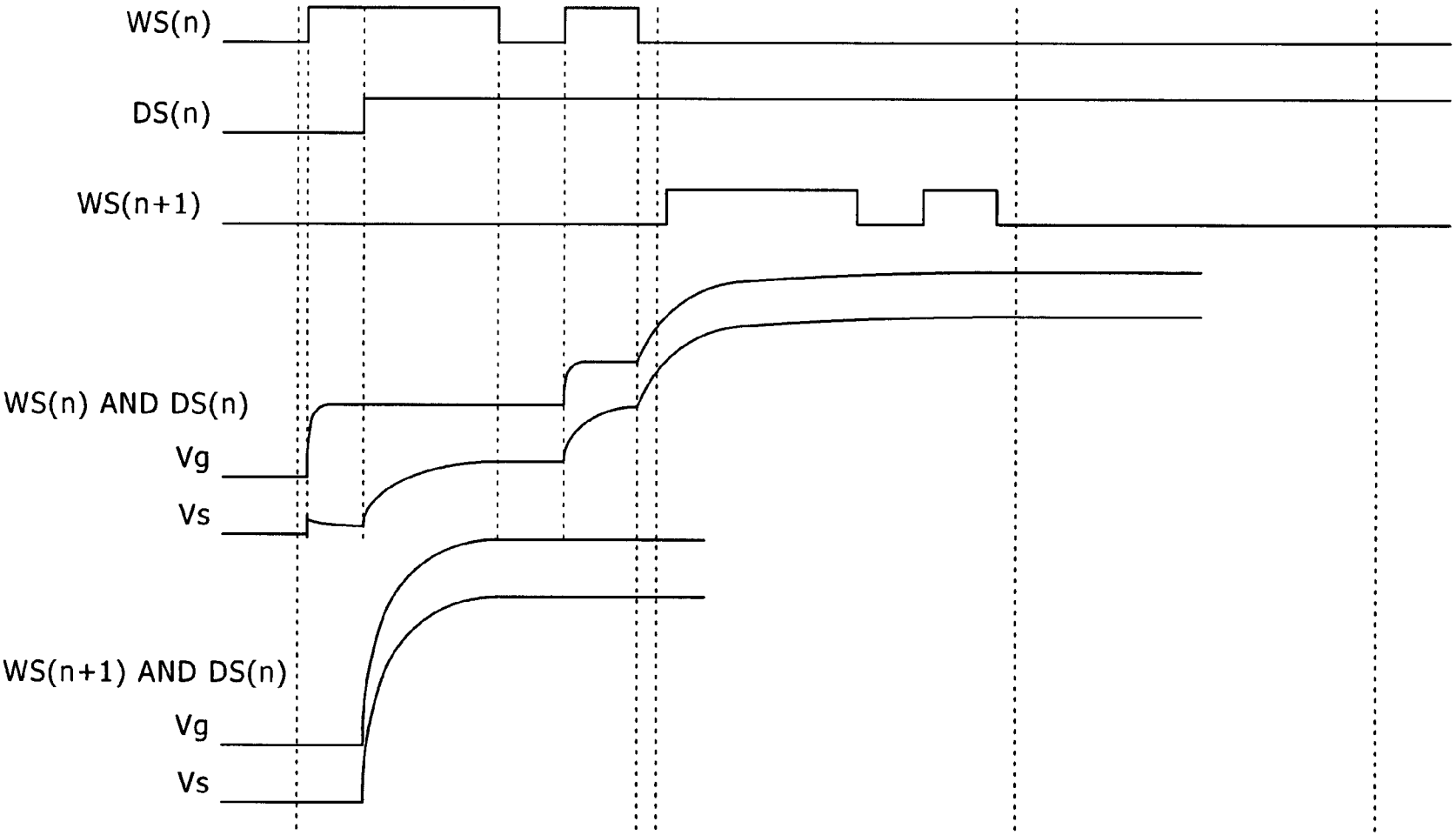
FIG. 7A is a timing chart for explaining the operation of a display device according to a reference example.

The Vth cancel operation (threshold voltage correction operation) is carried out only one time in some cases, and is repeatedly carried out in a time-division manner over plural horizontal periods in other cases. FIG. 7A shows the gate potential Vg and the source potential Vs of the drive transistor when the pixel configuration of the embodiment of the present invention is employed and the divided Vth cancel operation is not carried out. In FIG. 7A, two sets of changes in Vg and Vs are shown as the potential changes in two pixels. One set corresponds to Vg and Vs of the drive transistor driven by WS(n) and DS(n), and the other corresponds to Vg and Vs of the drive transistor driven by WS(n+1) and DS(n). According to the former set of potential changes, the initialization, the Vth cancel, and the writing (and the mobility correction) are normally carried out, and thus the desired light emission can be achieved. In contrast, according to the latter set, the potentials Vg and Vs return to those in the light-emission period of the previous field and thus the light emission occurs again instantaneously because DS is switched to Vcc_H before WS is turned on (the light emission is stopped by switching DS to Vcc_L in the circuit of FIG. 1B, and hence returning DS to Vcc_H again causes the restart of the light emission with the same Vgs). This is not the desired operation and therefore is not preferable.

Figure 7B:
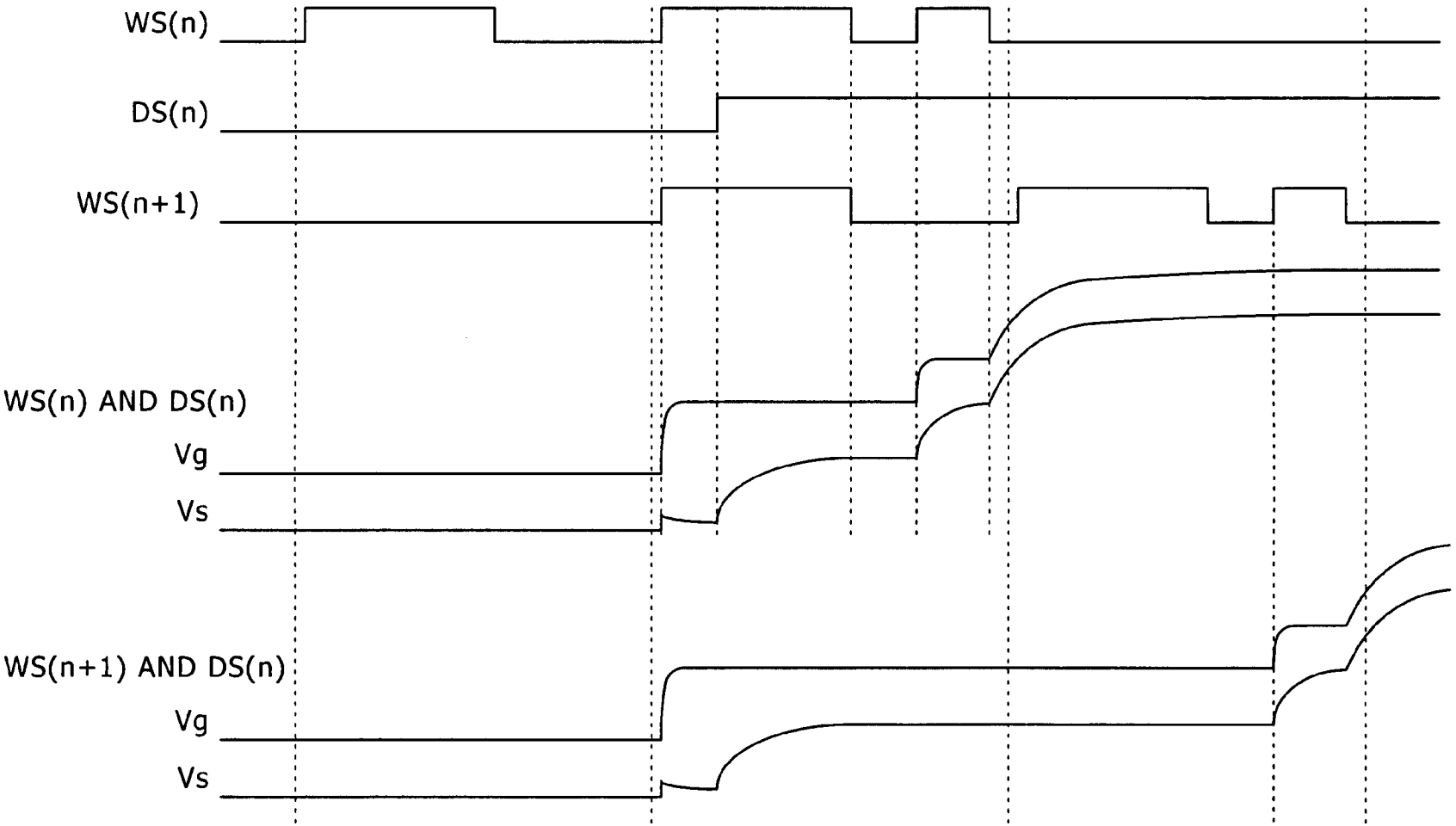
FIG. 7B is a timing chart for explaining the operation of the display device according to the embodiment of the present invention.

FIG. 7B shows the gate potential Vg and the source potential Vs of the drive transistor when the pixel configuration of the embodiment of the present invention is employed and the divided Vth cancel operation is carried out. In FIG. 7B, two sets of changes in Vg and Vs are shown as the potential changes in two pixels, similarly to FIG. 7A. Differently from FIG. 7A, WS is turned on first and thus the initialization is normally carried out in both combinations of WS and DS, so that both the pixels can achieve the desired light emission. As is apparent from FIGS. 6A to 6G and FIG. 7B, in the case of driving based on the pixel configuration according to the embodiment of the present invention, the number of times of the divided Vth cancel operation is different by one time between the pixel lines that share an output. Therefore, it is important to sufficiently carry out the Vth cancel operation through increase in the number of times of the divided Vth cancel operation or extension of the operation period per one time of the Vth cancel operation. It is expected that a problem that the light-emission luminance differs from stage to stage occurs even when the same sampling potential is applied unless the Vth cancel operation is sufficiently carry out.

Figure 8:
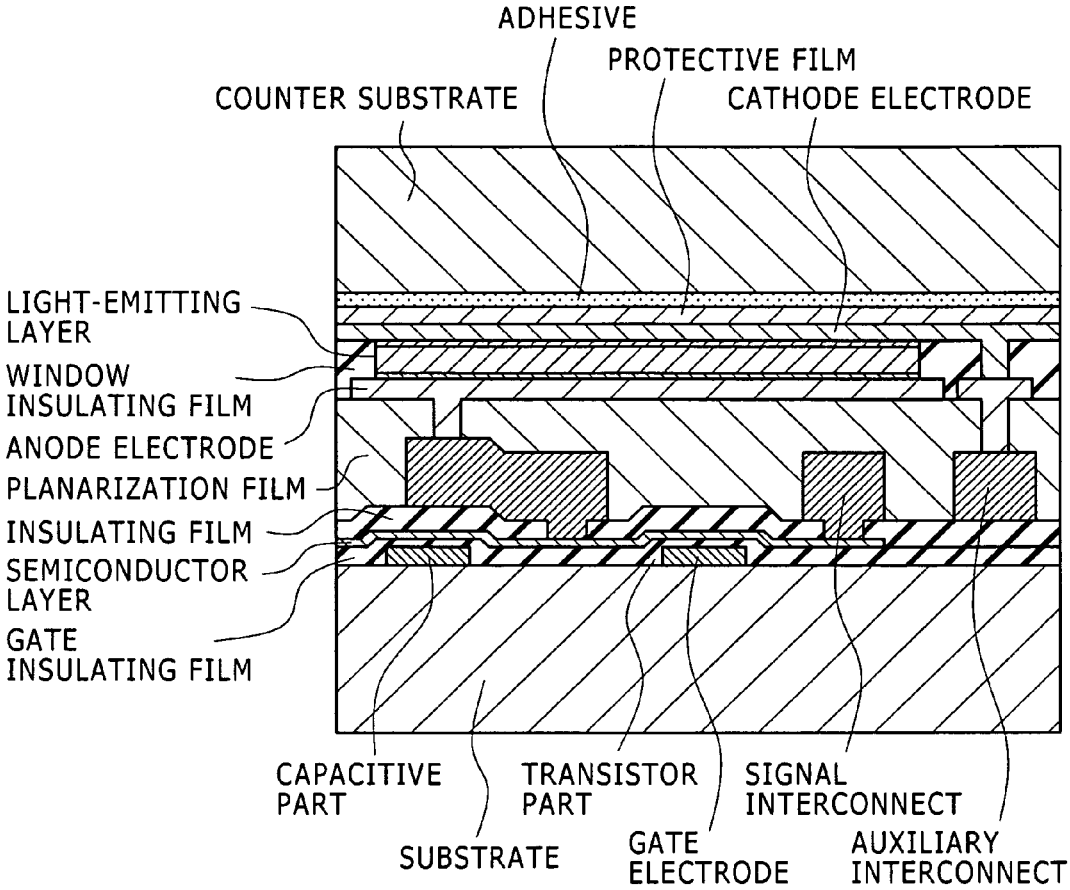
FIG. 8 is a sectional view showing the device structure of the display device according to the embodiment of the present invention.

The display device according to the embodiment of the present invention has a thin film device structure like that shown in FIG. 8. FIG. 8 shows the schematic sectional structure of a pixel formed over an insulating substrate. As shown in FIG. 8, the pixel includes a transistor part having plural thin film transistors (one TFT is shown in FIG. 8), a capacitive part such as a hold capacitor, and a light-emitting part such as an organic EL element. The transistor part and the capacitive part are formed on the substrate by a TFT process, and the light-emitting part such as an organic EL element is stacked thereon. A transparent counter substrate is attached over the light-emitting part with the intermediary of an adhesive, so that a flat panel is obtained.

Figure 9:
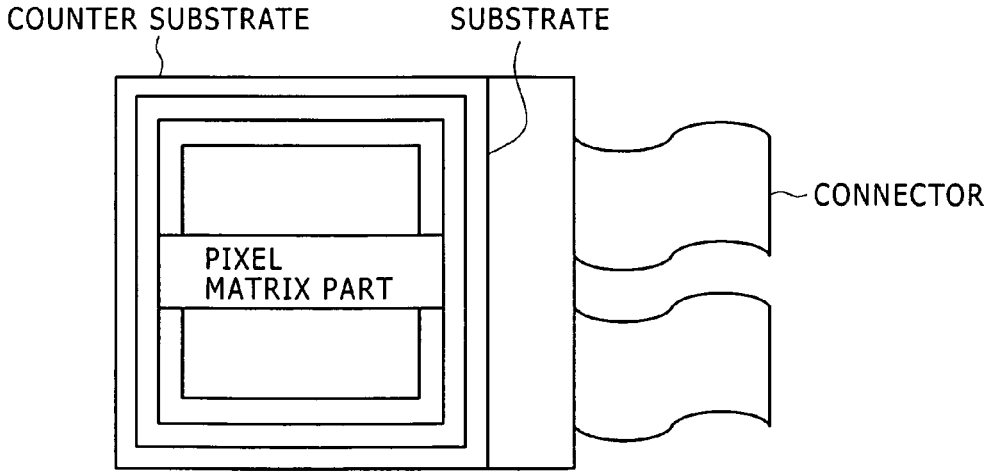
FIG. 9 is a plan view showing the module structure of the display device according to the embodiment of the present invention.

The display device according to the embodiment of the present invention encompasses a display module having a flat module shape like that shown in FIG. 9. For example, this display module is obtained as follows. A pixel array part in which pixels each including an organic EL element, thin film transistors, a thin film capacitor, and so on are integrally formed into a matrix is provided on an insulating substrate. Furthermore, an adhesive is so disposed as to surround this pixel array part (pixel matrix part), and a counter substrate composed of glass or the like is bonded to the substrate. This transparent counter substrate may be provided with e.g. a color filter, protective film, and light-blocking film according to need. The display module may be provided with e.g. a flexible printed circuit (FPC) as a connector for inputting/outputting of signals and so forth to/from the pixel array part from/to the external.

The display device according to the above-described embodiment can be applied to a display that has a flat panel shape and is incorporated in various kinds of electronic apparatuses in any field with a function to display image or video based on a video signal input to the electronic apparatus or produced in the electronic apparatus, such as a digital camera, notebook personal computer, cellular phone, and video camera. Examples of such electronic apparatuses to which the display device is applied will be described below.

Figure 10:
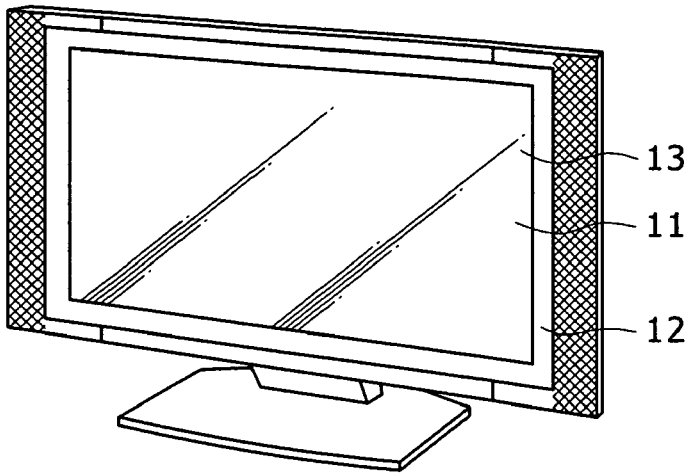
FIG. 10 is a perspective view showing a television set including the display device according to the embodiment of the present invention.

FIG. 10 shows a television to which the embodiment of the present invention is applied. This television includes a video display screen 11 composed of a front panel 12, a filter glass 13, and so on, and is fabricated by using the display device according to the embodiment of the present invention as the video display screen 11.

Figure 11:
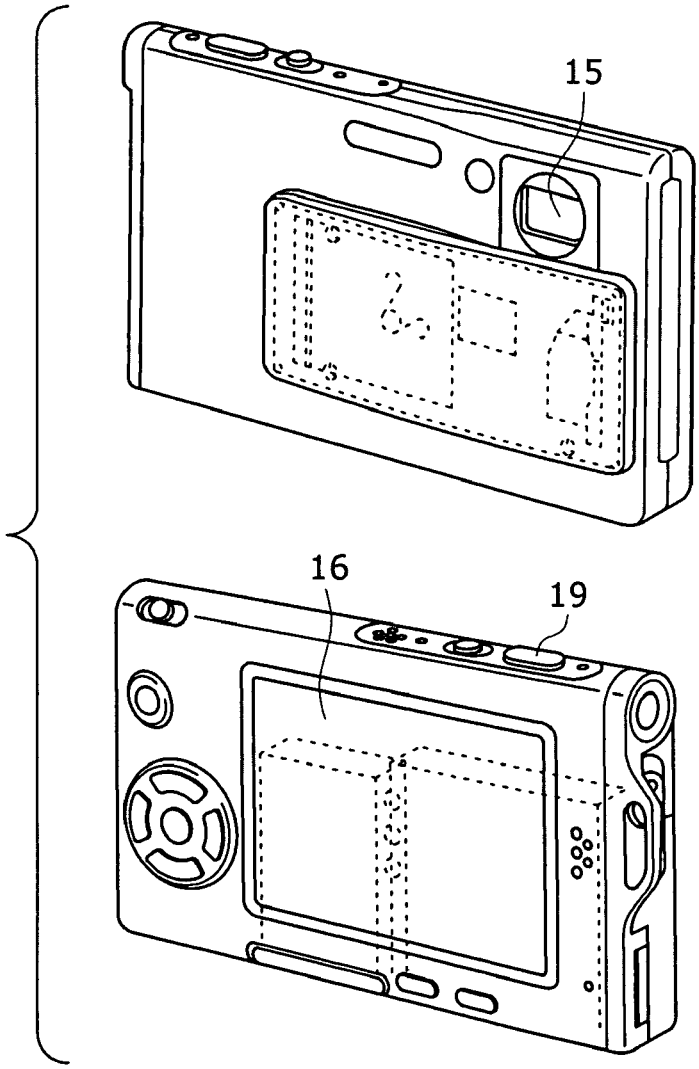
FIG. 11 is a perspective view showing a digital still camera including the display device according to the embodiment of the present invention.

FIG. 11 shows a digital camera to which the embodiment of the present invention is applied: the upper diagram is a front view and the lower diagram is a rear view. This digital camera includes an imaging lens, a light emitter 15 for flash, a display part 16, a control switch, a menu switch, a shutter button 19, and so on, and is fabricated by using the display device according to the embodiment of the present invention as the display part 16.

Figure 12:
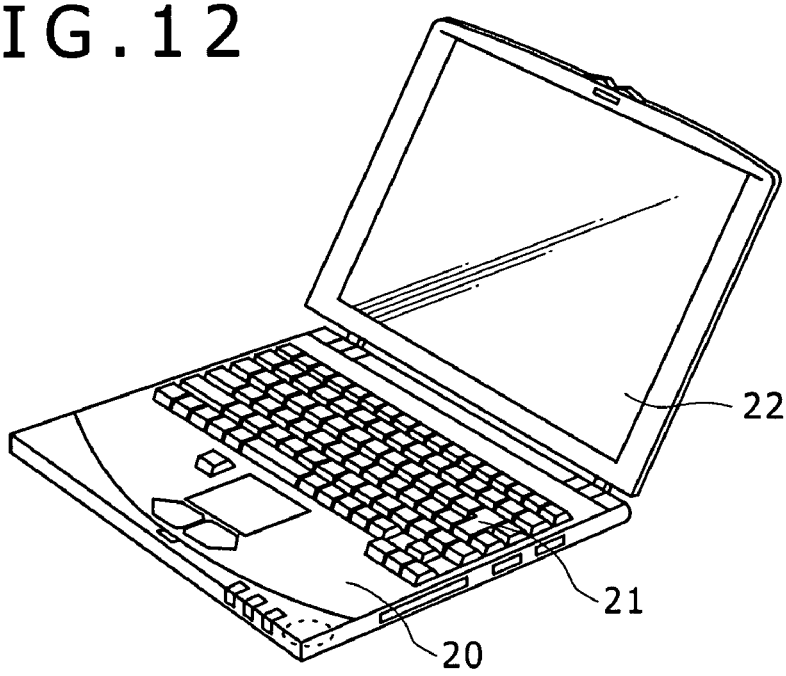
FIG. 12 is a perspective view showing a notebook personal computer including the display device according to the embodiment of the present invention.

FIG. 12 shows a notebook personal computer to which the embodiment of the present invention is applied. A main body 20 thereof includes a keyboard 21 that is operated in inputting of characters and so on, and the body cover thereof includes a display part 22 for image displaying. This notebook personal computer is fabricated by using the display device according to the embodiment of the present invention as the display part 22.

Figure 13:
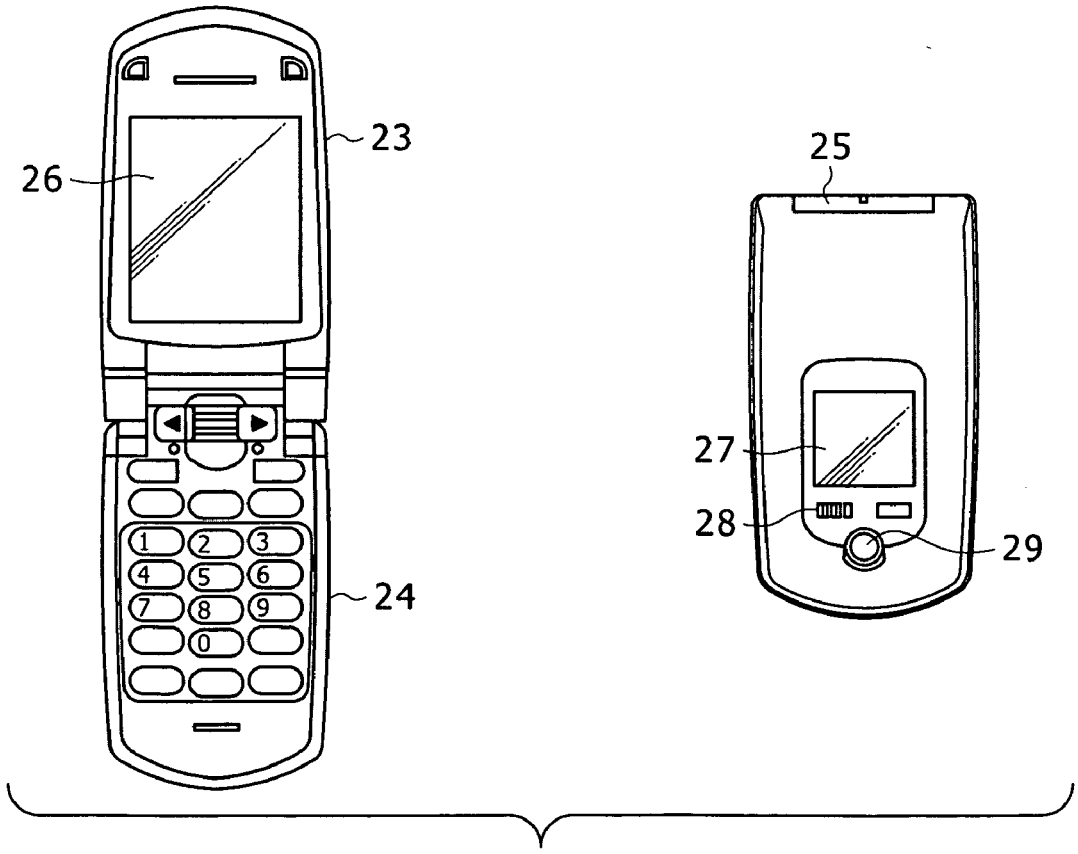
FIG. 13 is a schematic diagram showing a portable terminal apparatus including the display device according to the embodiment of the present invention.

FIG. 13 shows a portable terminal apparatus to which the embodiment of the present invention is applied: the left diagram shows the opened state and the right diagram shows the closed state. This portable terminal apparatus includes an upper casing 23, a lower casing 24, a connection (hinge) 25, a display 26, a sub-display 27, a picture light 28, a camera 29, and so on. This portable terminal apparatus is fabricated by using the display device according to the embodiment of the present invention as the display 26 and the sub-display 27.

Figure 14:
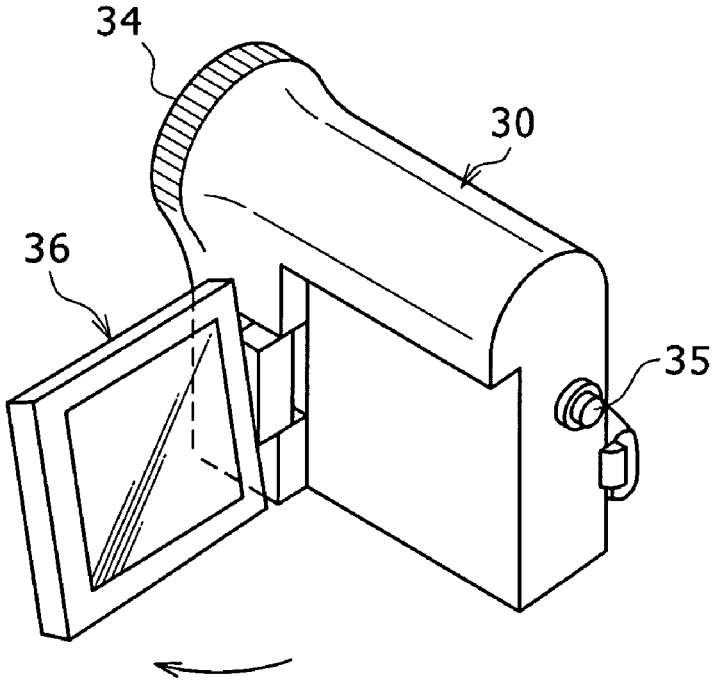
FIG. 14 is a perspective view showing a video camera including the display device according to the embodiment of the present invention.

FIG. 14 shows a video camera to which the embodiment of the present invention is applied. This video camera includes a main body 30, a lens 34 that is disposed on the front side of the camera and used to capture a subject image, a start/stop switch 35 for imaging operation, a monitor 36, and so on. This video camera is fabricated by using the display device according to the embodiment of the present invention as the monitor 36.

It should be understood by those skilled in the art that various modifications, combinations, sub-combinations and alterations may occur depending on design requirements and other factor in so far as they are within the scope of the appended claims or the equivalents thereof.

What is claimed is:

1. A display device comprising:

a pixel array part configured to be formed of an aggregation of pixels arranged in a matrix and include row first drive lines disposed corresponding to rows of the pixels, row second drive lines disposed corresponding to the rows of the pixels, and column signal lines disposed corresponding to columns of the pixels; and a drive part configured to drive the pixel array part and include a horizontal drive circuit that supplies a video signal to the column signal lines and a first vertical drive circuit and a second vertical drive circuit that cause light-emission operation of the pixels on a row-by-row basis via the row first drive lines and the row second drive lines, respectively, to thereby allow displaying of an image dependent upon a video signal on the pixel array part, wherein the first vertical drive circuit simultaneously drives the pixels on two rows adjacent to each other, the second vertical drive circuit simultaneously drives the pixels on two rows adjacent to each other, and a pair of rows of the pixels simultaneously driven by the first vertical drive circuit and a pair of rows of the pixels simultaneously driven by the second vertical drive circuit are shifted from each other by one row, for light-emission operation of the pixels on a row-by-row basis, wherein the drive part divides operation for displaying an image of one frame on the pixel array part into operation in a former field and operation in a latter field, in the former field, the first vertical drive circuit sequentially drives pairs of rows of the pixels and the second vertical drive circuit selectively drives every other pair of rows of the pixels so that the pixels on one row of each of the pairs of rows of the pixels driven by the first vertical drive circuit carry out light-emission operation, and in the latter field, the first vertical drive circuit sequentially drives the pairs of rows of the pixels and the second vertical drive circuit selectively drives pairs of rows of the pixels that were not driven in the former field, of all the pairs of rows of the pixels so that the pixels on the other row of each of the pairs of rows of the pixels driven by the first vertical drive circuit carry out light-emission operation.

2. The display device according to claim 1, wherein in the pixel array part, the pixels on two rows adjacent to each other are disposed with inversion symmetry with respect to each other, and the first drive line is shared by the pixels on two rows adjacent to each other and the second drive line is shared by the pixels on two rows adjacent to each other.

3. The display device according to claim 1, wherein the pixel includes:

at least a sampling transistor;

a drive transistor;

a hold capacitor; and a light-emitting element;

a control terminal of the sampling transistor is connected to a scan line as one of the first drive line and the second drive line, and a pair of current terminals of the sampling transistor are connected between the signal line and a control terminal of the drive transistor, one of a pair of current terminals of the drive transistor is connected to the light-emitting element, and the other of the pair of current terminals of the drive transistor is connected to a power feed line as the other of the first drive line and the second drive line, the hold capacitor is connected between the control terminal of the drive transistor and the current terminal of the drive transistor, and in the pixel, the sampling transistor is turned on in response to a drive signal supplied from the scan line to thereby sample a video signal from the signal line and write the video signal to the hold capacitor, and the drive transistor operates in response to a drive signal supplied from the power feed line to thereby supply a drive current dependent upon the video signal written to the hold capacitor to the light-emitting element.

4. The display device according to claim 3, wherein at a timing before writing of the video signal to the hold capacitor, the pixel carries out correction operation in response to drive signals supplied from the scan line and the power feed line to thereby add a correction amount for cancelling variation in a threshold voltage of the drive transistor to a voltage held in the hold capacitor.

5. The display device according to claim 3, wherein in writing of the video signal to the hold capacitor, the pixel subtracts a correction amount for cancelling variation in mobility of the drive transistor from a voltage held in the hold capacitor.

6. A method for driving a display device including a pixel array part formed of an aggregation of pixels arranged in a matrix and a drive part that drives the pixel array part, the pixel array part including row first drive lines disposed corresponding to rows of the pixels, row second drive lines disposed corresponding to the rows of the pixels, and column signal lines disposed corresponding to columns of the pixels, the drive part including a horizontal drive circuit that supplies a video signal to the column signal lines and a first vertical drive circuit and a second vertical drive circuit that cause light-emission operation of the pixels on a row-by-row basis via the row first drive lines and the row second drive lines, respectively, to thereby allow displaying of an image dependent upon a video signal on the pixel array part, the method comprising the steps of:

simultaneously driving the pixels on two rows adjacent to each other by the first vertical drive circuit; and simultaneously driving the pixels on two rows adjacent to each other by the second vertical drive circuit, wherein a pair of rows of the pixels simultaneously driven by the first vertical drive circuit and a pair of rows of the pixels simultaneously driven by the second vertical drive circuit are shifted from each other by one row, for light-emission operation Of the pixels on a row-by-row basis, wherein the drive part divides operation for displaying an image of one frame on the pixel array part into operation in a former field and operation in a latter field, in the former field, the first vertical drive circuit sequentially drives pairs of rows of the pixels and the second vertical drive circuit selectively drives every other pair of rows of the pixels so that the pixels on one row of each of the pairs of rows of the pixels driven by the first vertical drive circuit carry out light-emission operation, and in the latter field, the first vertical drive circuit sequentially drives the pairs of rows of the pixels and the second vertical drive circuit selectively drives pairs of rows of the pixels that were not driven in the former field, of all the pairs of rows of the pixels so that the pixels on the other row of each of the pairs of rows of the pixels driven by the first vertical drive circuit carry out light-emission operation.

7. An electronic apparatus comprising:

a display device including a pixel array part configured to be formed of an aggregation of pixels arranged in a matrix and include row first drive lines disposed corresponding to rows of the pixels, row second drive lines disposed corresponding to the rows of the pixels, and column signal lines disposed corresponding to columns of the pixels, and a drive part configured to drive the pixel array part and include a horizontal drive circuit that supplies a video signal to the column signal lines and a first vertical drive circuit and a second vertical drive circuit that cause light-emission operation of the pixels on a row-by-row basis via the row first drive lines and the row second drive lines, respectively, to thereby allow displaying of an image dependent upon a video signal on the pixel array part, wherein the first vertical drive circuit simultaneously drives the pixels on two rows adjacent to each other, the second vertical drive circuit simultaneously drives the pixels on two rows adjacent to each other, and a pair of rows of the pixels simultaneously driven by the first vertical drive circuit and a pair of rows of the pixels simultaneously driven by the second vertical drive circuit are shifted from each other by one row, for light-emission operation of the pixels on a row-by-row basis, wherein the drive part divides operation for displaying an image of one frame on the pixel array part into operation in a former field and operation in a latter field, in the former field, the first vertical drive circuit sequentially drives pairs of rows of the pixels and the second vertical drive circuit selectively drives every other pair of rows of the pixels so that the pixels on one row of each of the pairs of rows of the pixels driven by the first vertical drive circuit carry out light-emission operation, and in the latter field, the first vertical drive circuit sequentially drives the pairs of rows of the pixels and the second vertical drive circuit selectively drives pairs of rows of the pixels that were not driven in the former field, of all the pairs of rows of the pixels so that the pixels on the other row of each of the pairs of rows of the pixels driven by the first vertical drive circuit carry out light-emission operation.

* * * * *